US007509089B2

(12) United States Patent
Kikkoji et al.

(10) Patent No.: US 7,509,089 B2
(45) Date of Patent: Mar. 24, 2009

(54) REPRODUCTION DEVICE, REPRODUCTION METHOD, AND PROGRAM

(75) Inventors: Hiroyuki Kikkoji, Tokyo (JP); Nozomu Okuzawa, Tokyo (JP); Shinsuke Yamashita, Kanagawa (JP); Jun Moriya, Tokyo (JP); Yasuhiro Murase, Tokyo (JP)

(73) Assignee: Sony Corporation, Tokyo (JP)

( * ) Notice: Subject to any disclaimer, the term of this patent is extended or adjusted under 35 U.S.C. 154(b) by 486 days.

(21) Appl. No.: 10/560,229

(22) PCT Filed: May 18, 2004

(86) PCT No.: PCT/JP2004/007050

§ 371 (c)(1),
(2), (4) Date: Dec. 12, 2005

(87) PCT Pub. No.: WO2005/006615

PCT Pub. Date: Jan. 20, 2005

(65) Prior Publication Data

US 2006/0276124 A1 Dec. 7, 2006

(30) Foreign Application Priority Data

| | | |
|---|---|---|
| Jul. 14, 2003 | (JP) | 2003-274302 |
| Aug. 11, 2003 | (JP) | 2003-291741 |
| Sep. 4, 2003 | (JP) | 2003-313167 |
| Sep. 29, 2003 | (JP) | 2003-338519 |

(51) Int. Cl.
*H04H 1/00* (2006.01)

(52) U.S. Cl. ..... 455/3.01; 455/414.4; 455/186.1; 455/3.03

(58) Field of Classification Search ..... 455/3.01–3.05, 455/415, 414.1–414.4, 411, 456.3, 179.1, 455/150.1, 188.1, 151.1, 154.1, 186.1, 7, 455/550.1; 725/63; 386/95
See application file for complete search history.

(56) References Cited

U.S. PATENT DOCUMENTS 6,487,720 B1 * 11/2002 Ohishi ..... 725/31

(Continued)

FOREIGN PATENT DOCUMENTS

JP 5-219053 8/1993

(Continued)

OTHER PUBLICATIONS

U.S. Appl. No. 10/526,902, filed Aug. 16, 2005, Yamashita et al.

(Continued)

*Primary Examiner*—John J Lee
(74) *Attorney, Agent, or Firm*—Oblon, Spivak, McClelland, Maier & Neustadt, P.C.

(57) ABSTRACT

The broadcast signal receiving means 2 receives the broadcast signal of the broadcast station 32*a*. While the broadcast signal reproduction means 3 reproduces the broadcast signal, the request information transmission means 4 transmits the request information for requesting the associated information of the broadcast station 32*b* which is different from the broadcast station 32*a*. The associated information receiving means 5 receives the associated information corresponding to the request information. The associated information display means 6 displays the associated information. Therefore, it is possible to browse the associated information of the broadcast station 32*b* when listening to the broadcast of the broadcast station 32*a*. This also means it is possible to acquire the associated information of the broadcast station 32*b* at the same time as its broadcast.

12 Claims, 25 Drawing Sheets

U.S. PATENT DOCUMENTS

| | | | | |
|---|---|---|---|---|
| 2002/0184038 | A1* | 12/2002 | Costello et al. | 704/500 |
| 2004/0198279 | A1* | 10/2004 | Anttila et al. | 455/179.1 |
| 2005/0060701 | A1 | 3/2005 | Murase | |
| 2005/0091679 | A1 | 4/2005 | Tanaka et al. | |

FOREIGN PATENT DOCUMENTS

| | | |
|---|---|---|
| JP | 7-500715 | 1/1995 |
| JP | 7-236099 | 9/1995 |
| JP | 9-247565 | 9/1997 |
| JP | 9-270673 | 10/1997 |
| JP | 10-336169 | 12/1998 |
| JP | 2000-222360 | 8/2000 |
| JP | 2001-157136 | 6/2001 |
| JP | 2002-358283 | 12/2002 |
| JP | 2003-18488 | 1/2003 |
| JP | 2003-44477 | 2/2003 |
| JP | 2003-46459 | 2/2003 |
| JP | 2003-69915 | 3/2003 |
| JP | 2003-92556 | 3/2003 |

OTHER PUBLICATIONS

U.S. Appl. No. 10/554,542, filed Oct. 25, 2005, Iwatsu et al.
U.S. Appl. No. 10/564,317, filed Jan. 12, 2006, Kikkoji et al.
U.S. Appl. No. 10/557,207, filed Nov. 17, 2005, Kikkoji et al.
U.S. Appl. No. 10/555,654, filed Nov. 4, 2005, Kikkoji et al.
U.S. Appl. No. 10/556,944, filed Nov. 16, 2005, Kikkoji et al.
U.S. Appl. No. 10/563,258, filed Jan. 4, 2006, Iwatsu et al.
U.S. Appl. No. 10/557,141, filed Nov. 17, 2005, Murase et al.
U.S. Appl. No. 10/556,728, filed Nov. 14, 2005, Iwatsu et al.
U.S. Appl. No. 10/563,315, filed Jan. 4, 2006, Iwatsu et al.
U.S. Appl. No. 10/557,193, filed Nov. 17, 2005, Kikkoji et al.
U.S. Appl. No. 10/566,630, filed Jan. 31, 2006, Sakoh et al.
U.S. Appl. No. 10/561,187, filed Dec. 16, 2005, Araki et al.
U.S. Appl. No. 10/565,965, filed Jan. 26, 2006, Iwatsu.
U.S. Appl. No. 10/564,058, filed Jan. 10, 2006, Kikkoji et al.
U.S. Appl. No. 10/556,893, filed Nov. 15, 2005, Sakoh et al.
U.S. Appl. No. 10/557,040, filed Nov. 16, 2005, Kikkoji et al.
U.S. Appl. No. 10/556,729, filed Nov. 14, 2005, Kikkoji et al.
U.S. Appl. No. 10/555,990, filed Nov. 8, 2005, Murase et al.
U.S. Appl. No. 10/560,229, filed Dec. 12, 2005, Kikkoji et al.
U.S. Appl. No. 10/564,062, filed Jan. 10, 2006, Kikkoji et al.
U.S. Appl. No. 10/567,689, filed Feb. 9, 2006, Kikkoji et al.
U.S. Appl. No. 10/567,033, filed Feb. 3, 2006, Sakoh et al.
U.S. Appl. No. 10/572,743, filed Mar. 21, 2006, Kikkoji et al.
U.S. Appl. No. 10/564,414, filed Jan. 12, 2006, Sakoh et al.
U.S. Appl. No. 10/571,540, filed Mar. 10, 2006, Sakoh et al.
U.S. Appl. No. 10/567,776, filed Feb. 9, 2006, Iwatsu et al.
U.S. Appl. No. 10/568,968, filed Feb. 22, 2006, Okuzawa.
U.S. Appl. No. 10/569,227, filed Feb. 23, 2006, Yasuda.
U.S. Appl. No. 10/573,580, filed Mar. 24, 2006, Sakoh et al.
U.S. Appl. No. 10/573,418, filed Mar. 27, 2006, Iwatsu et al.
U.S. Appl. No. 10/571,458, filed Mar. 13, 2006, Iwatsu et al.
U.S. Appl. No. 10/571,774, filed Mar. 15, 2006, Sakoh et al.
U.S. Appl. No. 10/573,647, filed Mar. 28, 2006, Kikkoji et al.

* cited by examiner

GEO TARGETING TABLE

| POSTAL CODE NUMBER | REGIONAL BLOCK | |
|---|---|---|
| | MAJOR DIVISION | MINOR DIVISION |
| 001 | HOKKAIDO | SAPPORO |
| • • • | • • • | • • • |
| 030 | NORTH OF TOHOKU | AOMORI |
| • • • | • • • | • • • |
| 960 | SOUTH OF TOHOKU | FUKUSHIMA |
| • • • | • • • | • • • |
| 108 | METROPOLITAN AREA | TOKYO |
| • • • | • • • | • • • |
| 400 | METROPOLITAN AREA | YAMANASHI |
| • • • | • • • | • • • |

FIG. 6

BROADCAST STATION TARGETING TABLE

| REGIONAL BLOCK | BROADCAST STATION | | |
|---|---|---|---|
| | BROADCAST STATION NAME | FREQUENCY | CALL SIGN |
| METROPOLITAN AREA | FM TOKYO | 80.0 | JOAU |
| METROPOLITAN AREA | FM TOKYO | 76.7 | JOAU |
| METROPOLITAN AREA | FM TOKYO | 84.3 | JOAU |
| METROPOLITAN AREA | J-Wave | 81.3 | JOAV |
| METROPOLITAN AREA | FM YOKOHAMA | 84.7 | JOTU |
| METROPOLITAN AREA | FM YOKOHAMA | 80.2 | JOTU |
| METROPOLITAN AREA | • • • | • • • | • • • |
| METROPOLITAN AREA | NHK YAMANASHI | 84.7 | JOKG |
| METROPOLITAN AREA | • • • | • • • | • • • |

FIG. 7

REPRODUCTION DEVICE, REPRODUCTION METHOD, AND PROGRAM

TECHNICAL FIELD

The present invention relates to a reproduction apparatus, reproduction method and program, and more particularly to a reproduction apparatus, reproduction method and program for receiving broadcast signals from a broadcast station, reproducing the broadcast signals, and acquiring information associated with the broadcast. The information is supplied from the broadcast station via a network.

BACKGROUND ART

Severs of a radio station and the like supply information associated with music being broadcast by the radio station via a network. The information includes a song name, an artist name, a name and number of a CD (Compact Disc) or the like on which the music is recorded, a release year, a selling agency, a date and time of the broadcast. Personal computers (PC) and the like acquire the information.

Conventionally, there is proposed a system in which a broadcast detail information provision server memorizes information associated with music broadcast by a radio station. When the broadcast detail information provision server receives a request of retrieval of information from a radio-equipped cellular-phone, the broadcast detail information provision server makes the radio-equipped cellular-phone display the associated information that corresponds to the request on its display (see Patent Document 1, for example).

Patent Document 1: Japanese Patent Laid-Open No. 2003-92556 (paragraph number [0008] to [0079], and FIG. 1 to FIG. 9)

However, the acquisition of the particular associated information typically requires predetermined user operations of PCs, cellular-phones or the like to access servers, and therefore the acquisition may be awkward. The user also can not obtain the associated information without listening to the broadcast in real time. Also, the-user can not obtain information about music being played on a radio station while listening to the broadcast of other radio stations. It is difficult to acquire the associated information of music at once.

DISCLOSURE OF THE INVENTION

The present invention has been made in view of the above points and is intended to provide a reproduction apparatus, reproduction method and program that are capable of acquiring and browsing the associated information of multiple broadcast stations at the same time as the broadcast, regardless of whether or not receiving and reproducing the broadcast.

To solve the above problem, a reproduction apparatus in accordance with the present invention comprises: broadcast signal receiving means for receiving a broadcast signal of a specific frequency; broadcast signal reproduction means for reproducing the broadcast signal received by the broadcast signal receiving means; request information transmitting means for transmitting request information for requesting associated information of a broadcast station which is different from the broadcast station being reproduced by the broadcast signal reproduction means; associated information receiving means for receiving the associated information corresponding to the request information; and associated information display means for displaying the associated information received by the associated information receiving means.

In this reproduction apparatus, the broadcast signal receiving means receives a broadcast signal of a specific frequency, the broadcast signal reproduction means reproduces the broadcast signal received by the broadcast signal receiving means, the request information transmitting means transmits request information for requesting associated information of a broadcast station which is different from the broadcast station being reproduced by the broadcast signal reproduction means, the associated information receiving means receives the associated information corresponding to the request information, and the associated information display means displays the associated information received by the associated information receiving means.

In accordance with the present invention, a reproduction method comprises: a broadcast signal receiving step of receiving a broadcast signal of a specific frequency; a broadcast signal reproduction step of reproducing the received broadcast signal; a request information transmitting step of transmitting request information for requesting associated information of a broadcast station which is different from the broadcast station being reproduced; an associated information receiving step of receiving the associated information corresponding to the request information; and an associated information display step of displaying the received associated information.

In this reproduction method, receiving a broadcast signal of a specific frequency at the broadcast signal receiving step, reproducing the received broadcast signal at the broadcast signal reproduction step, transmitting request information for requesting associated information of a broadcast station which is different from the broadcast station being reproduced at the request information transmitting step, receiving the associated information corresponding to the request information at the associated information receiving step, and displaying the received associated information at the associated information display step.

In accordance with the present invention, a program for causing a computer to execute processing of: receiving a broadcast signal of a specific frequency; reproducing the received broadcast signal; transmitting request information for requesting associated information of a broadcast station which is different from the broadcast station being reproduced; receiving the associated information corresponding to the request information; and displaying the received associated information.

Based on this program, the computer receives a broadcast signal of a specific frequency, reproduces the received broadcast signal, transmits request information for requesting associated information of a broadcast station which is different from the broadcast station being reproduced, receives the associated information corresponding to the request information, and displays the received associated information.

In the present invention, when receiving a broadcast signal of a specific frequency and reproducing it, it requests associated information of a broadcast station which is different from the broadcast station being reproduced, and receives the associated information, and displays it. This allows a user to browse the associated information of the broadcast station when not receiving the broadcast signal of its broadcast station. Therefore, the user can browse associated information of a plurality of the broadcast stations when listening to the broadcast. The user also can change what the user listens to when finding another interesting broadcast based on the associated information, and also acquire the associated information thereof.

BRIEF DESCRIPTION OF THE DRAWINGS

FIG. 6 is an example of a geo targeting table.

FIG. 7 is an example of a broadcast station targeting table.

BEST MODE FOR CARRYING OUT THE INVENTION

An embodiment of the present invention will be described in detail with reference to the accompanying drawings.

Figure 1:
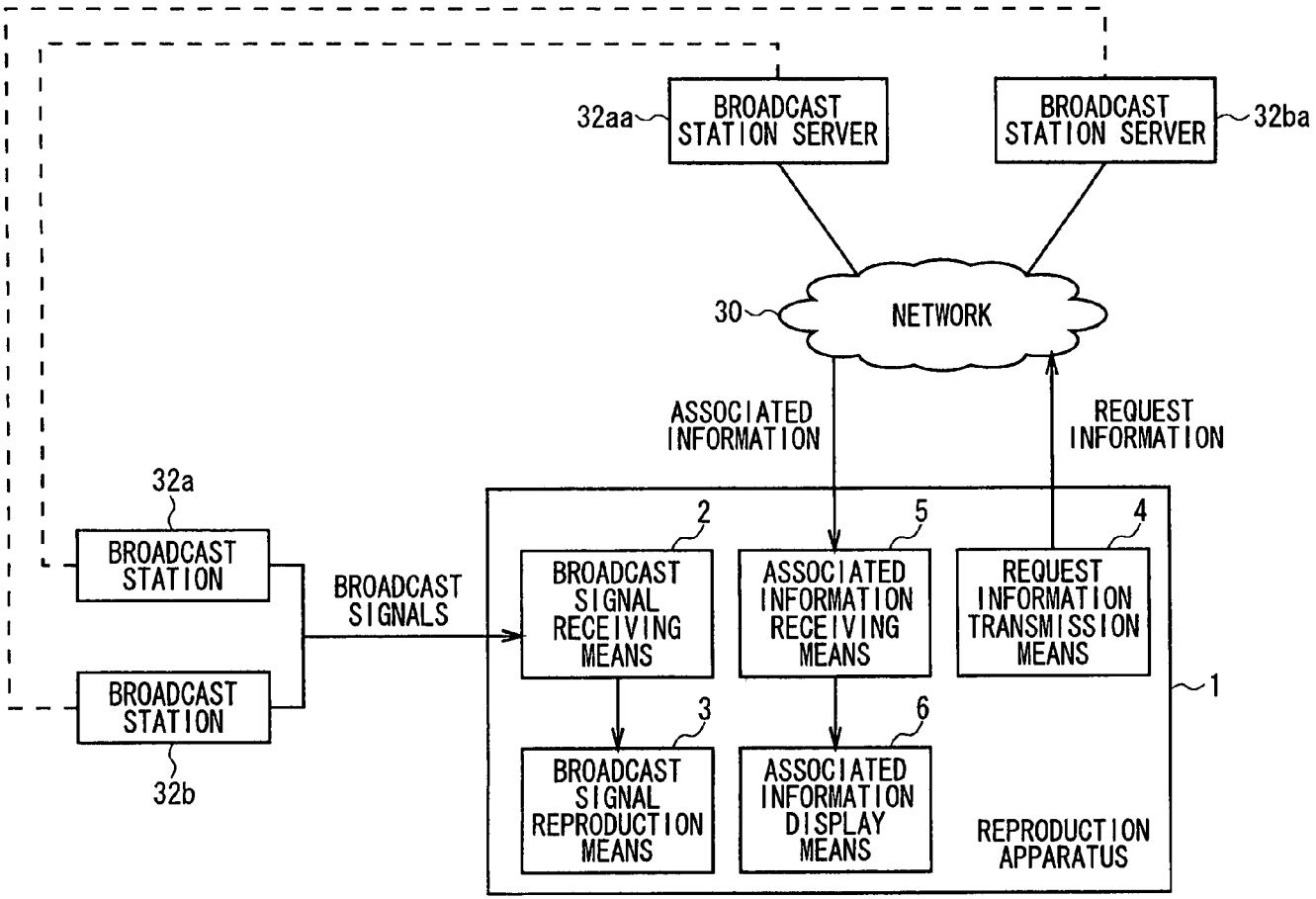
FIG. 1 is an explanation diagram showing the principle of the structure of a reproduction apparatus in accordance with the present invention.

FIG. 1 is an explanation diagram showing the principle of the structure of a reproduction apparatus in accordance with the present invention.

As shown in FIG. 1, the reproduction apparatus 1 is capable of receiving each broadcast signal from multiple broadcast stations and reproducing it. The reproduction apparatus 1 is also capable of receiving associated information of each broadcast station and displaying it. The associated information is supplied via a network.

The reproduction apparatus 1 has a broadcast signal receiving means 2 for receiving the broadcast signal broadcast by each broadcast station (In this case, broadcast stations 32*a*, 32*b*) in particular frequencies. The reproduction apparatus 1 also has a broadcast signal reproduction means 3 for reproducing the broadcast signal received by the broadcast signal receiving means 2.

Also, the reproduction apparatus 1 has a request information transmission means 4. For example, when the reproduction apparatus 1 receives the broadcast signal of the broadcast station 32*a* and reproduces it, the request information transmission means 4 transmits request information for requesting the associated information of the broadcast stations 32*a*, 32*b* to broadcast station servers 32*aa*, 32*ba* that are controlled by the broadcast stations 32*a*, 33*b* respectively via a network 30.

The reproduction apparatus 1 also has an associated information receiving means 5. The associated information receiving means 5 receives the associated information that corresponds to the request information transmitted to the broadcast station servers 32*aa*, 32*ba* by the request information transmission means 4. The reproduction apparatus 1 also has an associated information display means 6 for displaying the associated information received by the associated information receiving means 5.

The reproduction apparatus 1 previously memorizes the broadcast station name of each of the broadcast stations 32*a*, 32*b*, with its frequency and call sign. They are preset, for example. For example, when a user performs a broadcast station selection operation of selecting the broadcast station 32*a* from the broadcast stations 32*a*, 32*b*, the reproduction apparatus 1 receives its broadcast signal by the broadcast signal receiving means 2 and reproduces it by the broadcast signal reproduction means 3.

In this example, the reproduction apparatus 1 under given conditions receives the associated information of the broadcast station 32*a* and displays it when receiving the broadcast signal of the broadcast station 32*a* and reproducing it. At this time, the reproduction apparatus 1 transmits the request information using the call sign of the broadcast station 32*a* that was selected by the broadcast station selection operation via the network 30, and receives the associated information that corresponds to the request information from the broadcast station server 32*aa*, and displays it.

When the reproduction apparatus 1, during receiving the broadcast signal from the broadcast station 32*a*, transmits the request information for requesting the associated information of the broadcast station 32*b* instead of the broadcast station 32*a* by the request information transmission means 4 in response to a user operation, the reproduction apparatus 1 transmits the request information using the call sign of the broadcast station 32*b* to the broadcast station server 32*ba* via the network 30. Therefore, the reproduction apparatus 1 receives the associated information that corresponds to the request information from the broadcast station server 32*ba* and displays it.

At this time, the reproduction apparatus 1 for example changes the displayed information; from the associated information of the broadcast station 32*a* from which the reproduction apparatus 1 is receiving the broadcast signal to that of the broadcast station 32*b* from which the reproduction apparatus 1 is not receiving the broadcast signal. This allows the user of the reproduction apparatus 1 to see the associated information of the broadcast station 32*b* during listening to the broadcast of the broadcast station 32*a*. During watching the associated information of the broadcast station 32*b*, the user of the reproduction apparatus 1 can change what the user listens to whenever the user wants; from the broadcast of the broadcast station 32*a* to that of the broadcast station 32*b* by doing a broadcast station selection operation in which a received frequency is changed.

Also, the reproduction apparatus 1, during receiving the broadcast signal of the broadcast station 32*a* or the broadcast station 32*b* and reproducing it, is capable of requesting the associated information of the two broadcast stations 32*a*, 32*b* by using the stored call signs, and receiving them, and displaying them at once. In this case, the reproduction apparatus 1 for example requests the associated information from the servers 32*aa*, 32*ba* of the broadcast stations 32*a*, 32*b* at a specific interval of time, receives the associated information of each broadcast station 32*a*, 33*b*, and continues to display it until receiving next associated information. Thereby, the user of the reproduction apparatus 1, for example, during listening to the broadcast of the broadcast station 32*a* and browsing its associated information, can also browse the associated information of the broadcast station 32*b* that is different from the broadcast station 32*a* at the same time.

The reproduction apparatus 1 also presents whether or not the displayed associated information is associated information of the broadcast station from which the reproduction apparatus 1 is now receiving the broadcast signal. For example, the reproduction apparatus 1 displays the associated information of the broadcast station from which the reproduction apparatus 1 is now receiving the broadcast signal by larger letters compared to the other associated information.

Therefore, the reproduction apparatus 1 described above, for example, allows a user to browse the associated information of the broadcast station 32*b* during listening to the broadcast of the broadcast station 32*a*. And if the user of the reproduction apparatus 1 wants to listen to the broadcast of the broadcast station 32*b*, the user is able to listen to it by changing the received frequency of broadcast signals based on the displayed associated information, and also is able to browse the associated information of the broadcast station 32*a*. Thereby, the user can browse the associated information of the broadcast station 32*a*, 33*b* at the same time as the broadcasts, regardless of whether or not the reproduction apparatus 1 receives and reproduces the broadcasts. Furthermore, the reproduction apparatus 1 can acquire the associated information to be browsed by the user.

FIG. 1 just shows the broadcast stations 32*a*, 33*b*, but the number of the broadcast stations is not limited to this. The broadcast station may include a radio station, a television station, and a cable television station.

Hereinafter, a system in which the noted-above reproduction apparatus 1 is applied will be described. In this embodiment, the network system in which, the reproduction apparatus 1 is used as a terminal device that is connected to servers of broadcast stations or the like via a network and users of the terminal device can receive broadcast signals from the broadcast stations and acquire associated information supplied by the broadcast station servers via the network, will be described as an example.

For example, the associated information of broadcast stations includes a name of music broadcast by a broadcast station, an artist name of the music, a name and number of a CD or the like on which the music is recorded, a release year, a selling agency, a date and time of the broadcast of the music. The associated information also includes now-on-air information (to be described later). Hereinafter, the process of recording the associated information is referred to as a "clip", and the associated information clipped is referred to as "clipped information".

Figure 2:
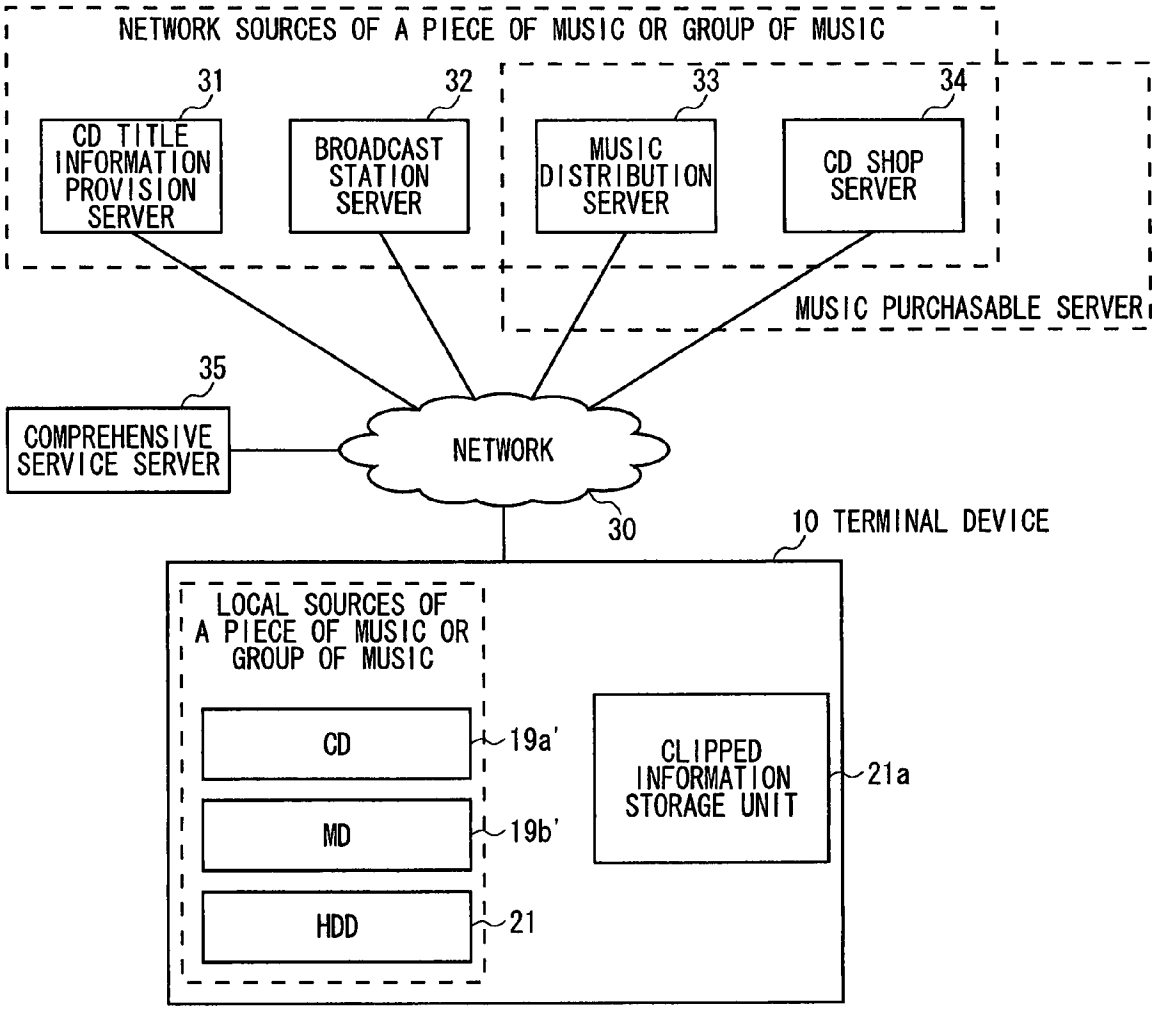
FIG. 2 is a diagram showing a network system in accordance with an embodiment of the present invention.

FIG. 2 is a diagram showing the network system in accordance with an embodiment of the present invention.

In this network system, the terminal device 10 connects to various types of servers via the network 30. The network 30, for example, is the Internet. The servers, for example, include a CD title information provision server 31, a broadcast station server 32, a music distribution server 33, a CD shop server 34, and a comprehensive service server 35 for providing various types of comprehensive services.

The CD title information provision server 31 provides distribution services. In the distribution services, the CD title information provision server 31 distributes the associated information of music recorded on a commercially available CD.

The broadcast station server 32 is managed by the broadcast station such as a FM broadcast station, a television station or the like. The broadcast station server 32 provides provision services. In the provision services, the broadcast station server 32 provides the associated information of music that is broadcast. The broadcast station server 32 has mainly two functions for supplying the associated information. The first function is for supplying the associated information of music that is being broadcast now (now-on-air). The second function is for supplying associated information lists (on-air-list) of music that has been already broadcast. The associated information lists are supplied in response to a request from the terminal device 10. For example, the broadcast station server 32 supplies the associated information of music broadcast in a designated program. The broadcast station server 32 also supplies the associated information of music broadcast in a designated period of time.

The music distribution server 33 provides distribution services. In the distribution services, the music distribution server 33 distributes music digital data (music data). For example, the music distribution server 33 delivers music data only to the terminal device 10 of the user who has done a procedure to purchase it. The music distribution server 33 is also capable of supplying the associated information of the distribution music.

The CD shop server 34 provides services such as accepting online order of CDs. The CD shop server 34 also provides distribution services of distributing demo audio data and the like. The CD shop server 34 also provides provision services of providing the associated information of music recorded on a CD for sale.

As just described, these servers perform provision services in which they supply information associated with a piece of music or group of music at the network 30. It means that each server works as sources of a piece of music or group of music at the network 30.

The servers shown in FIG. 2 are an example of devices that distribute a piece of music or group of music as sources. That is to say, the devices that have a piece of music or group of music accessible from other devices via the network 30 can work as sources of a piece of music or group of music at the network 30.

The music distribution server 33 and the CD shop server 34 work as music purchasable servers. The music distribution server 33 and the CD shop server 34 have a function to sell audio data of a piece of music or group of music online. The user can purchase a piece of music or group of music via the network 30 by operating the terminal device 10 to access the music purchasable servers. The user of the terminal device 10 can download audio data from the music distribution server 33 by doing a purchasing procedure for the music distribution server 33. The user also can get CDs shipped to the user's house by doing a purchasing procedure for the CD shop server 34.

The terminal device 10 has sources of a piece of local music or group of local music in a recording medium such as a CD 19*a*', a MD (Mini Disc) 19*b*', a Hard Disk Drive (HDD) 21. These sources may differ depending on purposes or models of the terminal device 10.

The sources of a piece of local music or group of local music as shown in FIG. 2 are one of examples. Other recording media that store a piece of music or group of music at the local of the terminal device 10 can work as sources of a piece of local music or group of local music.

The terminal device 10 also has a clipped information storage unit 21*a* to store the clipped associated information. The clipped information storage unit 21*a* is a second storage unit in the terminal device 10. For example, a part of the HDD 21 or the like may become the clipped information storage unit 21*a*. The terminal device 10 can make a clip not only for a piece of music, but also for a group of music. Therefore, if the user just performs one clip operation for a FM broadcast or an Album CD or the like that includes many pieces of interesting music, the terminal device 10 stores the associated information of all these pieces of interesting music.

In this embodiment, the terminal device 10 also works as audio equipment having a music reproduction function.

Figure 3:
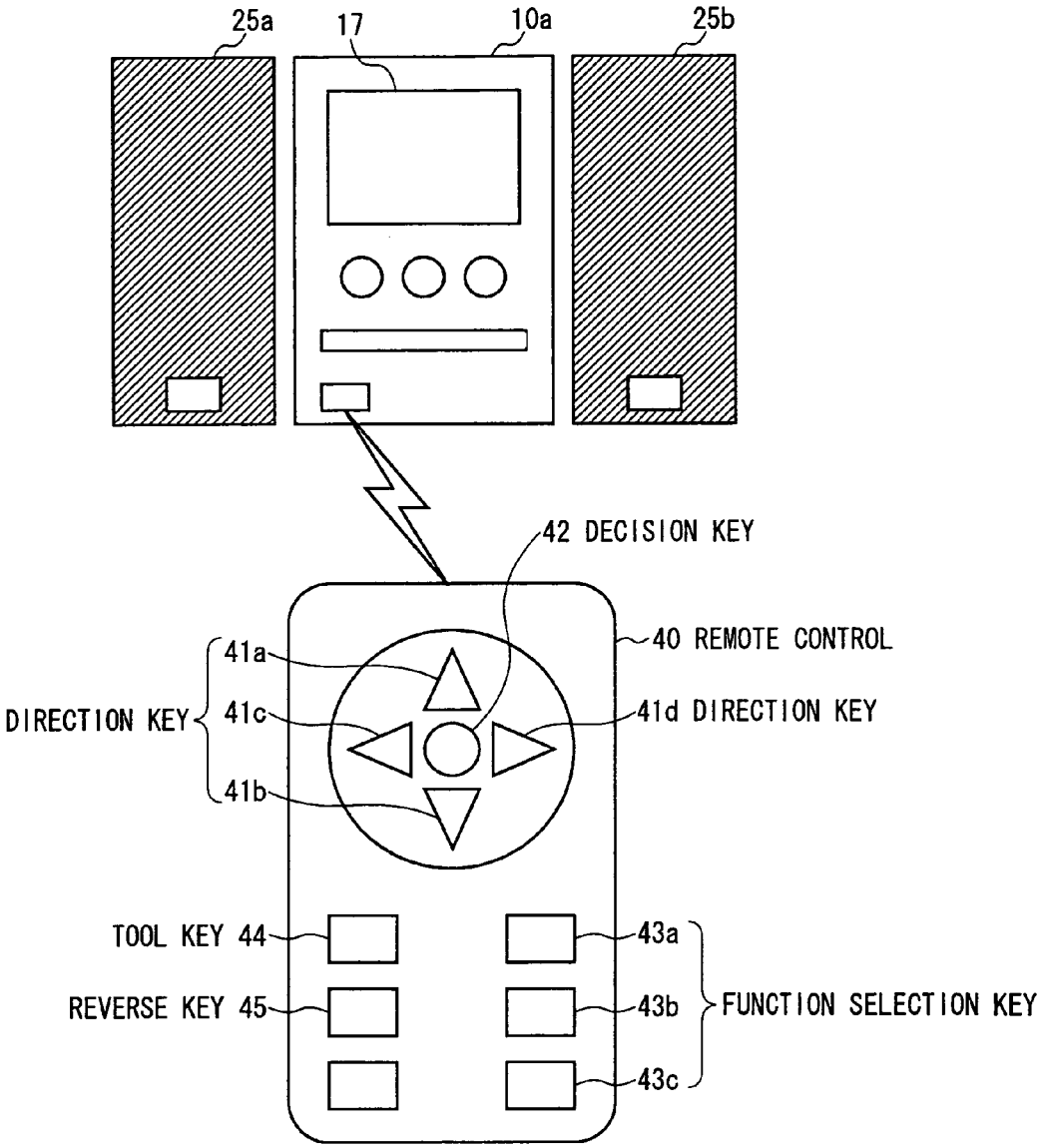
FIG. 3 is an appearance diagram showing a terminal device.

FIG. 3 is an appearance diagram showing the terminal device.

As shown in FIG. 3, the terminal device 10 in this embodiment has the same appearance as a general system-component. The terminal device 10 consists of a device body 10*a*, speakers 25*a*, 25*b*, and a remote control 40. The device body 10*a* has a reproduction function of CDs and DVDs (Digital Versatile Disc), a recording/reproduction function of MDs, and a receiving function of a FM broadcast and a television broadcast. Audio signals reproduced by the device body 10 are supplied to the speakers 25*a*, 25*b* which generates an audio output.

The device body 10*a* also has a display unit 17. The display unit 17 displays the associated information of music being played, the clipped associated information, and the like.

The remote control 40 is an input device for remote controlling the device body 10*a*. The remote control 40 has a plurality of operation keys. A user operation of pushing the operation keys transmits signals that correspond to the pushed key from the remote control 40 to the device body 10*a* via a radio communication means such as infrared radiation.

The operation keys include direction keys 41*a* through 41*d*, a decision key 42, function selection keys 43*a* through 43*c*, a tool key 44, and a reverse key 45.

The direction keys 41*a* through 41*d*, for example, are used to move a cursor or a focus location on the display unit 17.

These four direction keys 41*a* through 41*d* correspond to the direction of "up", "down", "left", and "right" respectively. The cursor or the like moves in the direction corresponding to the pressed direction key.

The decision key 42, for example, is used to decide contents displayed on the display unit 17.

The function selection keys 43*a* through 43*c* are used to select functions. For example, these three function selection keys 43*a* through 43*c* correspond to a utilization function of the comprehensive services, a tuner function, and a local content management function respectively. An operation of pushing one of the function selection keys 43*a* through 43*c* places the device body 10*a* in an operation mode of function that corresponds to the pushed function selection key.

The tool key 44 is a button for displaying a tool menu on display unit 17. The tool menu shows some commands corresponding to the contents displayed on the display unit 17. A user selection of one of these commands in the tool menu runs the terminal device 10, so as to execute a process that corresponds to the selected command. For example, when the user selects one of the commands by using the direction keys 41*a* through 41*d* and decides it by using the decision key 42, the process corresponding to the selected command is executed in the device body 10*a*. For example, when the display unit 17 shows the now-on-air information of music being broadcast, a user operation of selecting a clip-command by using the tool key 44 and the direction key 41*a* through 44*d* and pressing the decision key 42 runs the device body 10, so as to clip a piece of music regarding the displayed information.

The reverse key 45 is a button for-changing information displayed on the display unit 17 to the last displayed information.

In addition, the remote control 40 may have operation keys other than those shown in FIG. 3. For example, the remote control 40 may have a volume control key, a reproduction key for CD reproduction, a stop key and the like.

The internal structure of the terminal device 10 will be described hereinafter.

Figure 4:
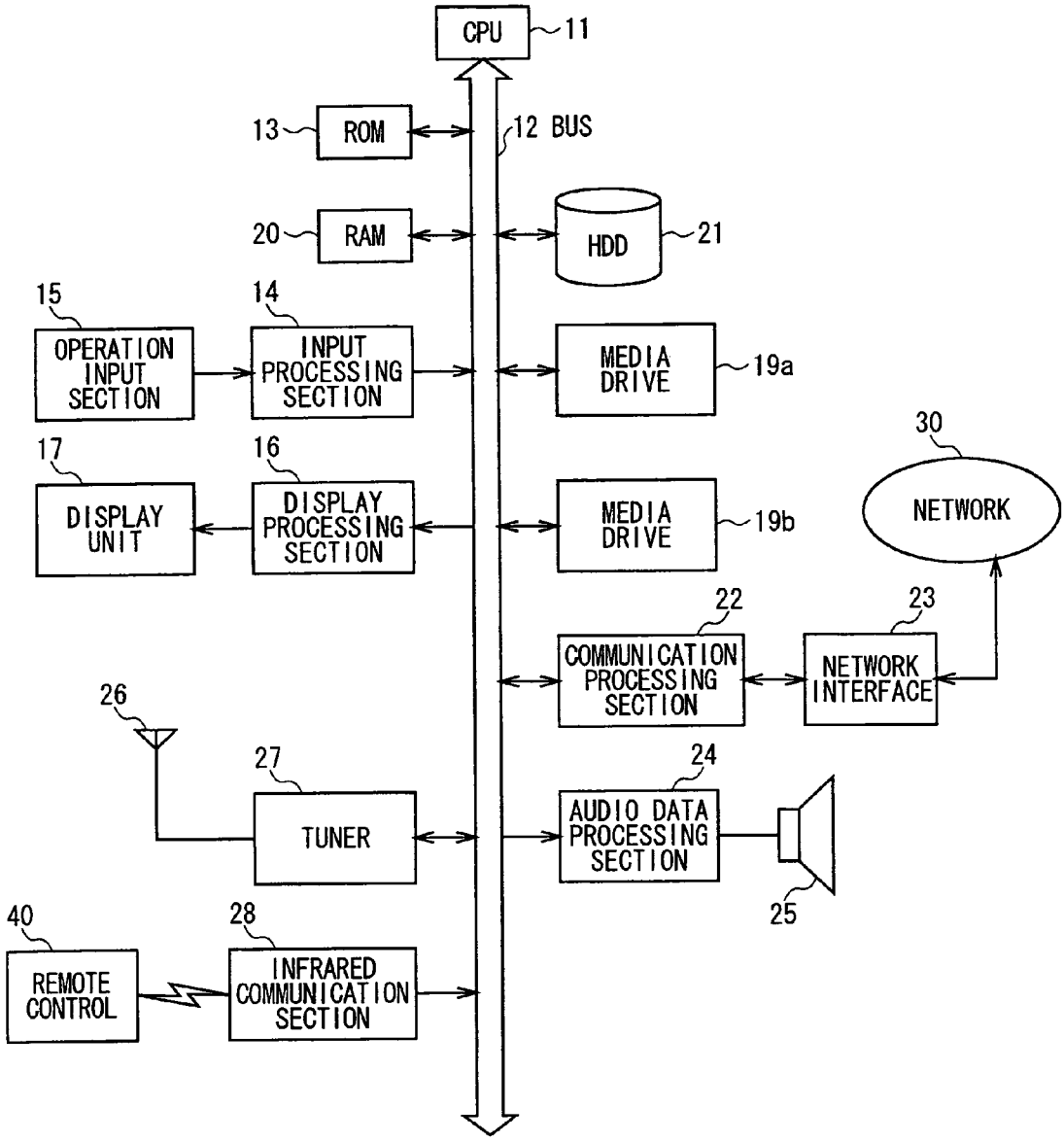
FIG. 4 is a block diagram showing the hardware structure of the terminal device.

FIG. 4 is a block diagram showing the hardware structure of the terminal device.

The terminal device 10 shown in FIG. 4 is able to manage, record, and reproduce a broad range of sources such as a piece of music.

CPU (Central Processing Unit) 11 takes overall control of the terminal device 10 based on running programs. The CPU 11 also performs arithmetic processes based on the running programs. For example, the CPU 11 performs a communication operation for communication via the network 30, an input/output operation for users, a content reproduction operation for reproducing contents from a medium, a clip operation, a content memorization operation and its management operation on HDD 21, an information retrieval operation for retrieving via the network 30 based on the clipped associated information, and the like. In this embodiment, the terminal device 10 is able to record and reproduce content data such as audio data, motion picture data. The CPU 11 exchanges control signals and data with each circuit section via a bus 12.

A ROM (Read Only Memory) 13 memorizes operation programs executed by the CPU 11, a program loader, some calculation coefficients, parameters used in the programs. The programs executed by the CPU 11 are loaded into a RAM (Random Access Memory) 20. The RAM 20 is also used for the data area and task area that are necessary for the CPU 11 to run various processes.

An operation input section 15 includes operation means such as operation keys, a jog-dial, and a touch panel. The operation means are disposed on the cabinet of the terminal device 10. The operation input section 15 may include a keyboard or a mouse for GUI (Graphical User Interface) operation. An input processing section 14 processes information input from the operation input section 15 in a prescribed manner to generate an operation command. The input processing section 14 sends the operation command to the CPU 11. The CPU 11 performs control processes and calculations, so as to exhibit behavior corresponding to the operation command.

The display unit 17, such as a liquid crystal display, is also connected and displays a wide variety of information. The CPU 11 supplies display data based on operational state, input state, and communication state to a display processing section 16, and the display processing section 16 makes the display unit 17 perform a displaying operation based on the supplied display data. For example, the display unit 17 displays the received broadcast information, the contents distributed from servers, the associated information of the contents, the clipped information, and the like. The display unit 17 also displays retrieval results, when retrieval processes of music or the like were done via the network 30.

Media drives 19*a*, 19*b* are able to play back and record music on a transportable storage medium (The media drives 19*a*, 19*b* may only play back, depending on a kind of storage medium). The media drives 19*a*, 19*b* may play back and record not only on a specific kind of medium, but also-on various kinds of media. For example, the media drive 19*a* play back on CDs and DVDS, while the media drive 19*b* play back and record on MDs.

The transportable storage medium that stores contents such as music include not only such an optical storage as a CD, a DVD, but also such a semiconductor memory as a flash-memory, for example. In such case, a reader-writer device for a flash-memory is connected to the bus 12.

The user inserts the storage medium (CDs, DVDs, MDs or the like) on which some contents are recorded into the media drives 19*a*, 19*b*, and operates the remote control 40 or otherwise the operation input section 15 in a prescribed manner. The user therefore can listen to music. For example, when the user directs the reproduction of the media drive 19*a* by operating the remote control 40, the CPU 11 orders the media drive 19*a* to play back contents. The media drive 19*a* in response to the order accesses to the designated content in the inserted medium, and read this content.

If the content read from the inserted medium is an audio content, the decoding of the content and the like are executed by the CPU 11 when needed. And the content is transferred to an audio data processing section 24. The audio data processing section 24 performs an acoustic field process such as an equalizing. The audio data processing section 24 also performs volume control, digital-analog conversion, amplification and the like. The audio data processing section 24 then outputs the audio content from the speaker 25. Specifically, the speaker 25 consists of a plurality of speakers 25*a*, 25*b* as shown in FIG. 3, and capable of outputting audio in stereo.

Also, the contents played back by the media drive 19*a*, 19*b* can be stored in the HDD 21 as an audio data file by the control of the CPU 11. The format of CDs, which uses the sampling frequency of 44.1 KHz and 16-bit quantization, may apply to that of the audio data file. In addition, this audio data file may be compressed in a prescribed manner for effective use of the capacity of the HDD 21. The compression method may include, but not limited to, the ATRAC (Advanced Transform Acoustic Coding (Trademark)) and MP3 (MPEG Audio Layer-3).

A tuner 27, for example, corresponds to an AM/FM tuner. The tuner 27 demodulates broadcast signals received by an antenna 26 under the control of CPU 11. Also, the tuner 27 may include a television tuner, a satellite broadcast tuner, a digital broadcast tuner, and the like. The audio data processing section 24 processes the demodulated broadcast signal in a prescribed manner, and outputs it as broadcast sound from the speaker 25. Alternatively, the display processing section 16 processes the demodulated broadcast signal in a prescribed manner, and displays it on the display unit 17.

A communication processing section 22 encodes transmit data and decodes receive data under the control of the CPU 11. A network interface 23 transmits the transmit data encoded by the communication processing section 22 to external devices capable of network communication via the network. The network interface 23 transfers information, which was transmitted from external devices via the network, to the communication processing section 22. The communication processing section 22 receives the information and delivers it to the CPU11. The information that the terminal device 10 transmits via the network 30 includes the request information for requesting the associated information of contents, for example, the associated information of music played on a FM radio. The information received by the terminal device 10 includes the associated information of contents.

The infrared communication section 28 communicates with the remote control 40 by using wireless communication means such as infrared radiation. The infrared communication section 28 processes the signals received from the remote control 40 in a prescribed manner and delivers them as operation commands to the CPU11. The CPU 11 performs control processes and calculations, so as to exhibit behavior corresponding to the inputted operation commands.

The hardware structure described above makes possible the processes and functions of this embodiment.

The structure of the terminal device 10 may have more variety, and need not be limited to that of FIG. 4. For example, the terminal device 10 may include interfaces, which use such a communication method as the USB (Universal Serial Bus), the IEEE1394, the Bluetooth, for communication with peripheral devices. The terminal device 10 therefore can store not only the audio contents that are downloaded by the network interface 23 via the network 30, but also the audio contents that are transferred via such interfaces as the USB, the IEEE1394, to the HDD 21. The terminal device 10 also may include end terminals, such as a terminal for microphones, a terminal for connection with external headphones, a video output terminal used for the DVD reproduction, a line connection terminal, an optical digital connection terminal, and the like. Also, the terminal device 10 may include slots, such as the PCMCIA slot, the memory card slot, and the like, for exchanging data with an external information-processing device or an external audio device.

The structure of program modules of the system of this embodiment will be described. The program modules are data in which the processes executed by the terminal device 10 are described. The program modules enable the terminal device 10 to perform prescribed functions.

Figure 5:
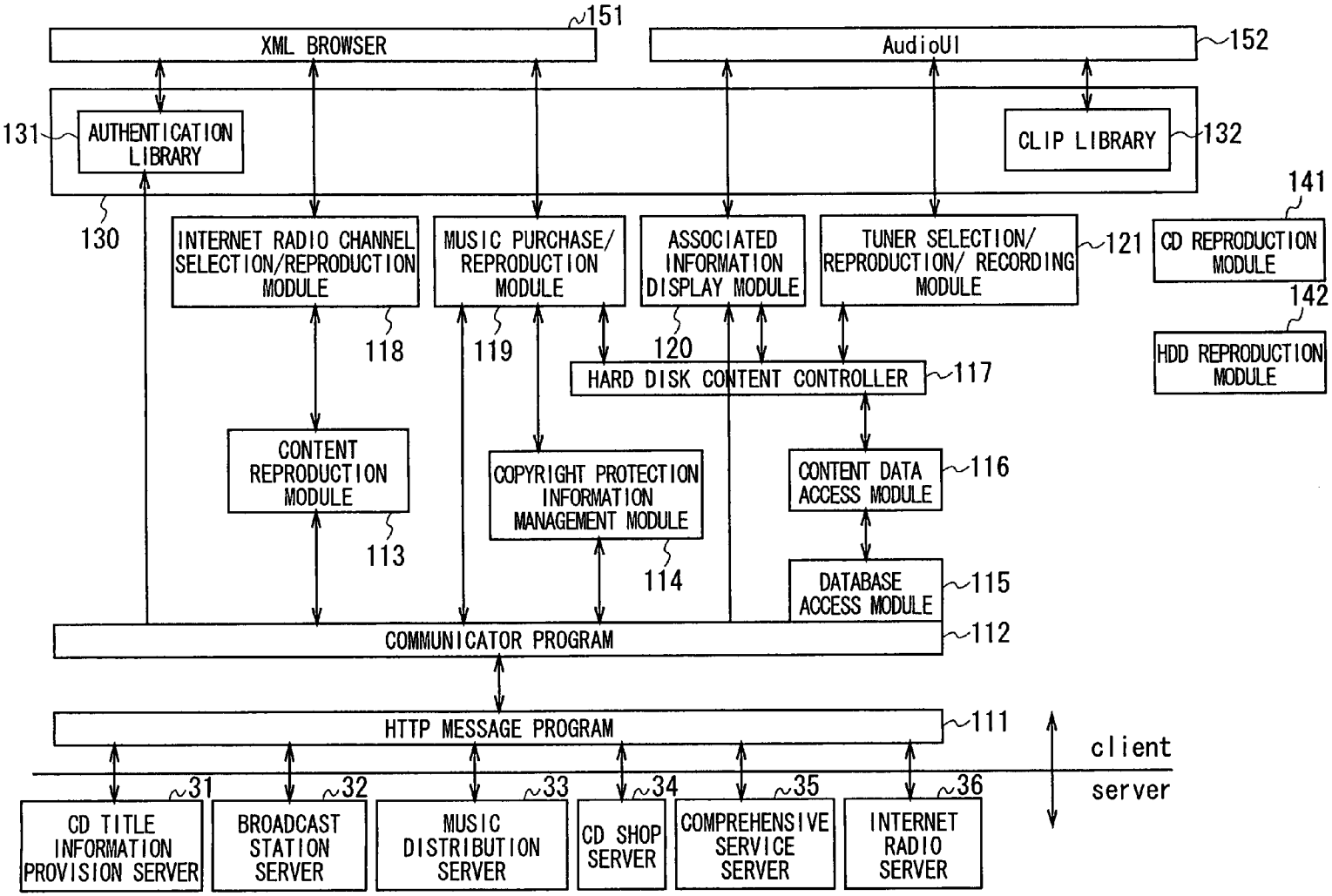
FIG. 5 is a diagram showing the structure of program modules of the terminal device.

FIG. 5 is a diagram showing the structure of the program modules of the terminal device.

As shown in FIG. 5, the program modules of the terminal device 10 operate on OS (Operating System). The terminal device 10 is able to interact with various servers, such as a CD title information provision server 31, a broadcast station server 32, a music distribution server 33, a CD shop server 34, a comprehensive service server 35 for providing comprehensive services, and an Internet radio server 36, by using functions of the program modules.

A HTTP (Hyper Text Transfer Protocol) message program 111 interacts with various servers, such as the CD title information provision server 31, the broadcast station server 32, the CD shop server 34, and the comprehensive service server 35, in the HTTP communication. A communicator program 112 can variously communicates with the comprehensive service server 35 and the like.

A content reproduction module 113 for reproducing contents based on the interpretation of the codec of the content, and a copyright protection information management module 114 for dealing with information regarding the copyright protection, are disposed above the communicator program 112, where is close to a user interface. An Internet radio channel selection/reproduction module 118 for selecting an Internet radio and playing back the Internet radio is disposed above the content reproduction module 113. A music purchase/reproduction module 119 for controlling the purchase of music and the playback of demo-music is disposed above the copyright protection information management module 114.

A XML (extensible Markup Language) browser 151 is disposed above the Internet radio channel selection/reproduction module 118 and the music purchase/reproduction module 119. The XML browser 151 interprets the XML files that are transmitted from various servers, and displays them on the display unit 17. Also, the XML browser 151 interprets contents that are input by a user operation of the terminal device 10, when the terminal device 10 remains in a comprehensive service utilization mode. And the XML browser 151 sends a processing request or the like corresponding to the inputted contents to the other modules. For example, the music purchase/reproduction module 119 purchases music that was designated by the user via the XML browser 151. The purchased music is then stored in the HDD 21 via a hard disk content controller 117.

The communicator program 112 connects with an authentication library 131 of a library 130. The authentication library 131 authenticates various servers such as the comprehensive service server 35.

A database access module 115, a content data access module 116 and the hard disk content controller 117 are disposed above the communicator program 112. The database access module 115 accesses various databases in the HDD 21. The content-data access module 116 accesses contents stored in the HDD 21. The hard disk content controller 117 manages the contents stored in the HDD 21.

An associated information display module 120, a tuner selection/reproduction/recording module 121, and the music purchase/reproduction module 119 are disposed above the hard disk content controller 117. The associated information display module 120 displays a music name and artist name corresponding to music broadcast by a radio station on the display unit 17. The tuner selection/reproduction/recording module 121 selects a radio channel, and records music content received form the radio station on the HDD 21, and the like.

For example, music received from the radio station to which the user tuned in via an audio user interface 152 is recorded on HDD 21 via the content data access module 116.

The associated information display module 120 receives the associated information (such as an artist name and music name that correspond to music broadcast by the radio station selected by the tuner selection/reproduction/recording module 121) from the CD title information provision server 31 or the broadcast station server 32 or the like via the HTTP message program 111. And the associated information display module 120 displays it on the display unit 17 via the audio user interface 152.

The associated information to be displayed on the display unit 17 via the audio user interface 152 may be temporarily stored in a clip library 132 of the library 130. The associated information may be finally stored in the HDD 21 via the database access module 115 upon user instruction.

In addition, the program modules of the terminal device 10 include a CD reproduction module 141 for playing back CDs, and a HDD reproduction module 142 for playing back the HDD 21. The CD reproduction module 141 and the HDD reproduction module 142 output the playback results via the audio data processing section 24 and the speaker 25 in order.

The terminal device 10 described above can receive the associated information from the servers and clip it. At the same time as clipping, the terminal device 10 can also search for music and purchase it.

The following is the description of a process in which, the terminal device 10 receives the broadcast signal from one of a plurality of the registered broadcast stations and reproduces it, and receives the associated information of the broadcast stations and displays it.

A registration process of each broadcast station for the terminal device 10 will be described. In the registration (preset) of each broadcast station, the terminal device 10 memorizes the name of each broadcast station, with the frequency of broadcast signals of each broadcast station and unique call sign of each broadcast station. In this case, the terminal device 10 determines available broadcast stations (from which the terminal device 10 can receive broadcast signals) based on the area where the terminal device 10 is used. The frequency and corresponding call sign of each available broadcast station are registered together with the terminal device 10. The area, the frequency, and the call sign are determined by using a geo targeting table and a broadcast station targeting table shown in FIG. 6 and FIG. 7, for example.

FIG. 6 is an example of the geo targeting table.

The geo targeting table shown in FIG. 6 connects each region (a major division and a small division) with a corresponding postal code number. The terminal device 10 can therefore specify the region where this terminal device 10 is used based on the postal code number data. This table could be the other structure in which the terminal device 10 can specify the region where this terminal device 10 is used based on telephone numbers, addresses or the like.

FIG. 7 is an example of the broadcast station targeting table.

The broadcast station targeting table shown in FIG. 7 shows the relationship between broadcast station names, frequencies, and call signs. They are classified into each region. After specifying the region where the terminal device 10 is used based on the geo targeting table shown in FIG. 6, the terminal device 10 can specify the available broadcast stations of the specified region based on the broadcast station targeting table shown in FIG. 7.

The comprehensive service server 35 usually memorizes the geo targeting table and the broadcast station targeting table. In such case, the comprehensive service server 35 performs search of the region and broadcast stations in response to a request from the terminal device 10, and transmits the search results to the terminal device 10. Alternatively, the terminal device 10 can memorizes the geo targeting table and the broadcast station targeting table in advance.

Figure 8:
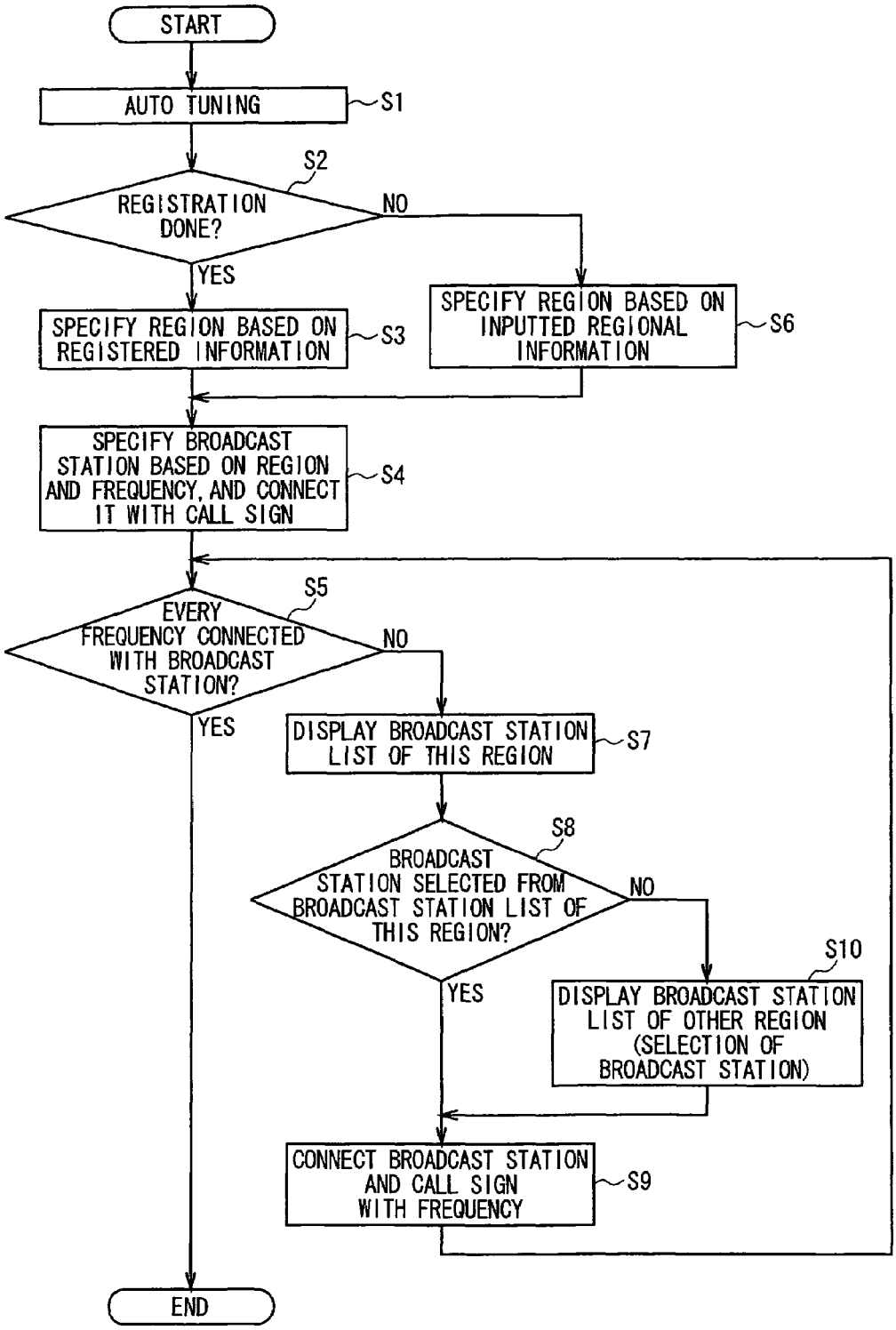
FIG. 8 is a diagram showing an example of the overall flow of broadcast station registration.

FIG. 8 is a diagram showing an example of the overall flow of the broadcast station registration.

The terminal device 10 detects the frequencies of the broadcast signals available in the region where the terminal device 10 is used by using a typical auto tuning function (step S1).

The comprehensive service server 35 then checks whether or not a registration was done (step S2). In this case, this registration allows the terminal device 10 to receive the associated information (the now-on-air information, for example) supplied from the broadcast station.

In this system, the completion of the registration makes it possible to receive the broadcast and acquire the now-on-air information. The comprehensive service server 35 manages the registered information, which includes regional information such as the address, postal code number, and telephone number of the location where the terminal device 10 is used. After the completion of the registration, Identification information such as a unique ID, password and the like that represents the completion of the registration is given to the terminal device 10. At step S2, the comprehensive service server 35 checks whether or not the terminal device 10 has been registered based on the identification information.

At step S2, when recognizing that the terminal device 10 has been registered, the comprehensive service server 35 specify the region where the terminal device 10 is used by using the registered information and the geo targeting table shown in FIG. 6 (step S3).

The comprehensive service server 35 then specifies the broadcast station, based on the specified region, the frequencies obtained by the terminal device's auto tuning, and the broadcast station targeting table shown in FIG. 7. And the comprehensive service server 35 connects it with its frequency and call sign (step S4). The frequency, the broadcast station name, and the call sign are transferred to the terminal device 10.

If the terminal device 10 has the geo targeting table and the broadcast station targeting table, the processing of specifying the region at step S3 and specifying the broadcast station at step S4 is done at the terminal device 10 after the authentication of step S2 is done at the comprehensive service server 35.

After step S4, the terminal device 10 checks whether or not to have connected every available frequency, which was obtained by auto tuning, with the broadcast station (step S5). If the every available frequency was connected with the broadcast station, the registration process of broadcast stations ends. The frequency, the broadcast name, and the call sign are stored in the terminal device 10.

At step S2, when recognizing that the registration, which allows the terminal device 10 to receive the now-on-air information, was not done, the comprehensive service server 35 specifies the region where the terminal device 10 is used by using the geo targeting table and regional information input by the user via the terminal device 10 (step S6), and then proceeds to step S4.

At step S5, when recognizing that the every available frequency, which was obtained by auto tuning, was not connected with the broadcast station, the terminal device 10 proceeds to next step S7 and the following. This case might be caused by the situation in which, the frequency that was obtained by auto tuning is not the frequency that was usually received in the region where this terminal device 10 is used, or this terminal device 10 is receiving the broadcast signal through a cable television system, or the like.

When recognizing that the every available frequency was not connected with the broadcast station, the terminal device 10 displays the list of all broadcast stations that exist in this region (a broadcast station list of this region) by using the registered or inputted regional information (step S7). In this case, the terminal device 10 also prepares to show the list of broadcast stations that are usually not available in this region (a broadcast station list of other region), to deal with the frequencies of the broadcast stations that are not available in this region. For example, the broadcast station list of other region shows listed information, like the regional broadcast station list shown in the major division of the geo targeting table, or national broadcast station lists, or the like. Information that is necessary to display the broadcast station list of this region and the broadcast station list of other region is pre-stored in the comprehensive service server 35 or the terminal device 10.

If the user selects a broadcast station from the broadcast station list of this region for the frequency that has not been connected with the broadcast station (step S8), the terminal device 10 connects the selected broadcast station with the frequency and also connects it with the call sign by using the broadcast station targeting table (step S9). On the other hand, when the user does not select a broadcast station from the broadcast station list of this region at step S8, the terminal device 10 displays the broadcast station list of other region (step S10). And the terminal device 10 proceeds to step S9, when the user selects a broadcast station from the broadcast station list of other region.

The terminal device 10 repeats the process of step S7 through S10 until every frequency that the terminal device 10 can receive is connected with broadcast stations.

As described above, the terminal device 10 makes the connection between the frequency, the broadcast name, and the call sign, and stores them together, by using the tables shown in FIG. 6 and FIG. 7. Even if the broadcast name is changed by the user, for example, the connection between the frequency, the broadcast name, and the call sign allows the terminal device 10 to acquire the now-on-air information by using the connected call sign. And also, even if some different broadcast stations have the same frequency, the terminal device 10 can specify each broadcast station by the call sign, and acquire the now-on-air information of the specified broadcast station.

In addition, if frequencies of broadcast stations (such as a community FM) that are not listed in the broadcast station list of this region and of other region exist, the user of the terminal device 10 can manually input the broadcast station name for this frequency. In this case, the call sign of the broadcast station might not be connected with the frequency. But it is usually enough for the user only to listen to the broadcast of the broadcast station, because this kind of broadcast station often does not provide the now-on-air information. The terminal device 10 can receive and reproduce broadcast signals even if the terminal device 10 is not registered.

As described-above, the registration of frequencies, broadcast station names, and call signs with the terminal device 10 allows the user of the terminal device 10 to receive the broadcast signals of the registered frequencies and reproduce them. Thereby, the user of the terminal device 10 can listen to the broadcasts. The terminal device 10 also can obtain the associated information such as the now-on-air information of each broadcast station by using the call sign, while receiving the broadcast signal. This terminal device 10 can obtain not only the associated information of the broadcast station from which the terminal device 10 is receiving the broadcast signal, but also the associated information of the broadcast station from which the terminal device 10 is not receiving the broadcast signal.

Figure 9:
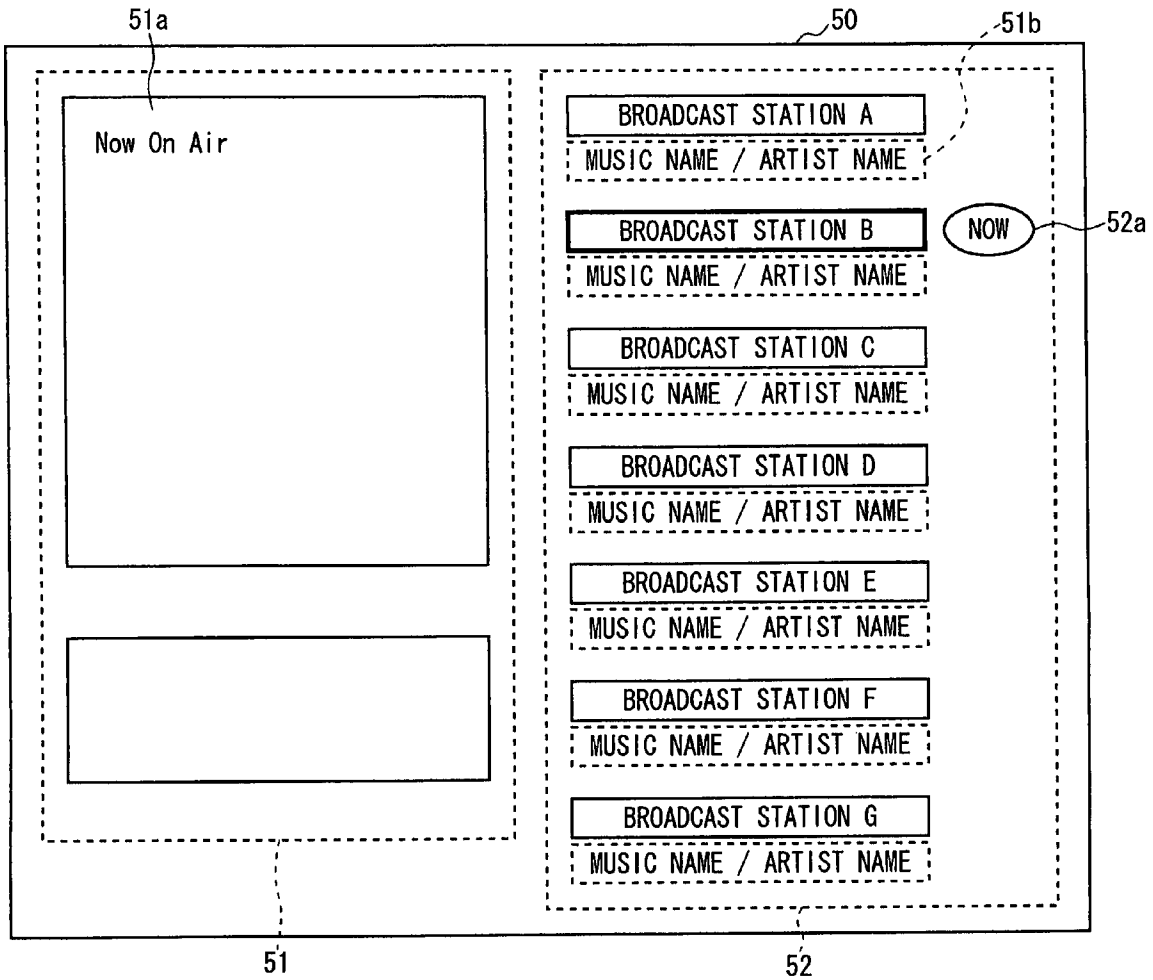
FIG. 9 is an example of displaying associated information of the broadcast station from which broadcast signals are being received.
Figure 10:
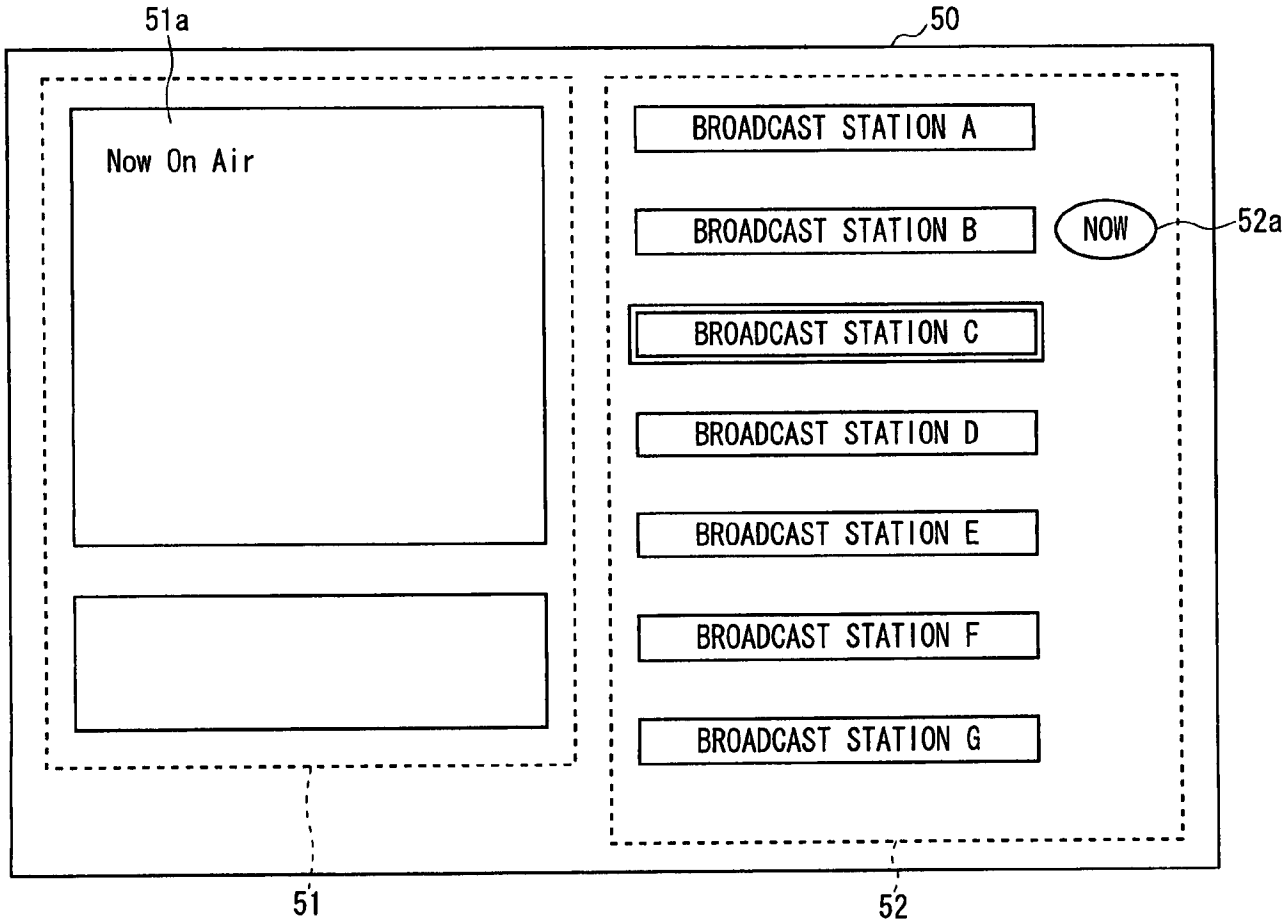
FIG. 10 is an example of displaying the associated information of the broadcast station from which broadcast signals are not being received.

FIG. 9 shows an example of displaying the associated information of the broadcast station from which the terminal device 10 is receiving the broadcast signal. FIG. 10 shows an example of displaying the associated information of the broadcast station from which the terminal device 10 is not receiving the broadcast signal.

As shown in FIG. 9 and FIG. 10, the display unit 17 of the terminal device 10 has a large screen 50. The screen 50 has a now-on-air information display area 51 for displaying the now-on-air information of the broadcast station, and a broadcast station list display area 52 for displaying the list of the registered broadcast station from which the terminal device 10 can receive the broadcast signal.

The broadcast station list display area 52 shows the list of broadcast stations (7 broadcast stations A through G, for example). The frequency, broadcast station name, and call sign thereof were registered together with the terminal device 10 by presetting. The terminal device 10 displays a mark 52*a* for the broadcast station from which the terminal device 10 receives the broadcast signal. In the example as shown in FIG. 9 and FIG. 10, it is seen that the terminal device 10 is receiving the broadcast signal of the broadcast station B.

When the terminal device 10 transmits the request information that includes the call sign of the broadcast station B to request the now-on-air information, the broadcast station server of the broadcast station B transmits the now-on-air information of the broadcast station B in response to the request information. The terminal device 10 receives the now-on-air information and displays it on the now-on-air information display area 51.

At this time, the now-on-air information display area 51 displays "Now On Air" (indicated by the reference numeral 51*a*) in a large way and boldface as shown in FIG. 9. Whereas the now-on-air information display area 51 displays "Now On Air" (indicated by the reference numeral 51*a*) in a small way and fine writing as shown in FIG. 10, if the terminal device 10 requests, receives, and displays the now-on-air information of the broadcast station other than the broadcast station B from which the terminal device 10 is receiving broadcast signals (for example, it is the situation where the terminal device 10 receives the now-on-air information of the broadcast station C while receiving the broadcast signal of the broadcast station B).

Figure 11:
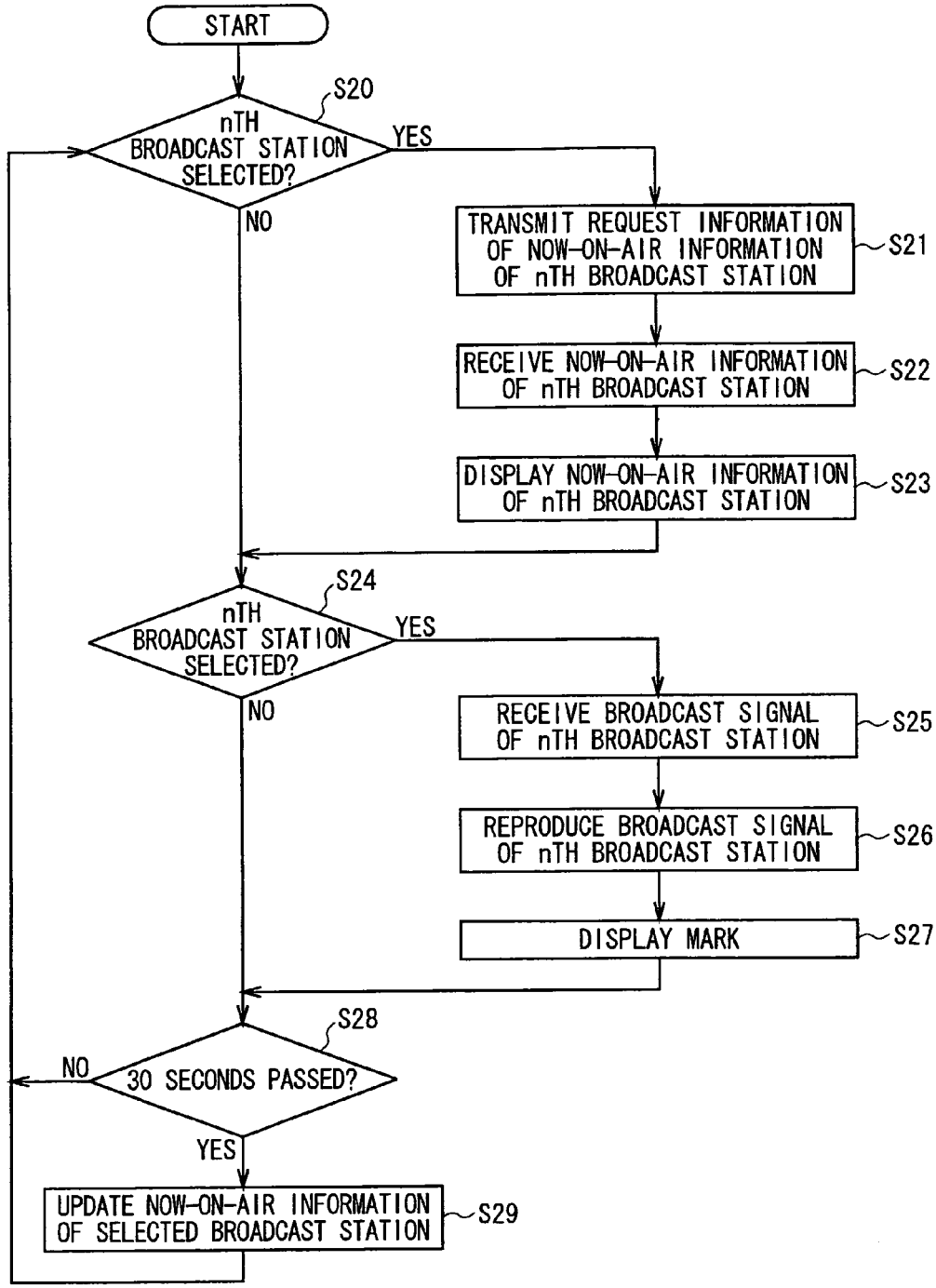
FIG. 11 is a diagram showing an example of the flow in which the terminal device performs a broadcast signal receive/reproduce process and an associated information acquisition process.

FIG. 11 is a diagram showing an example of the flow in which the terminal device performs a broadcast signal receive/reproduce process and an associated information acquisition process.

In the terminal device 10, the user operates the remote control 40 to move a focus so that the nth broadcast station in the broadcast station list is being focused. As a result, the nth broadcast station is selected to display its now-on-air information (step S20).

When the nth broadcast station is selected, the terminal device 10 transmits the request information that includes the call sign of this broadcast station to request the now-on-air information (step S21). And the terminal device 10 receives the now-on-air information corresponding to the request information (step S22). And then, the terminal device 10 displays the received now-on-air information on the now-on-air information display area 51 (step S23). The terminal device 10 continues to display the now-on-air information of the selected broadcast station until the focus in the broadcast station list is changed.

The terminal device 10 checks whether or not the terminal device 10 accepts the user's instruction that instructs the terminal device 10 to receive the broadcast signal of the broadcast station displayed on the now-on-air information display area 51 (step S24). If the terminal device 10 accepts the user's instruction that instructs the terminal device 10 to receive the broadcast signal of the nth broadcast station, the terminal device 10 receives the broadcast signal of the nth broadcast station (step S25), and reproduce it (step S26), and displays the mark 52*a* for the nth broadcast station in the broadcast station list display area 52 (step SP27). The selection of the broadcast station to receive the broadcast signal is done by the appropriate operation in which, the user moves the focus to the now-on-air information display area and pushes the decision key by using the remote control 40 and the like, or the user selects a broadcast receiving item from a tool menu, or the like.

And the terminal device 10 checks whether or not a certain period of time (30 seconds, for example) has passed after the terminal device 10 started to display the now-on-air information of the nth broadcast station of the broadcast station list (step S28). When 30 seconds have passed, the terminal device 10 updates the now-on-air information of the selected nth broadcast station (step S29), and then returns to step S20.

At step S20, if the nth broadcast station is not selected, the terminal device 10 proceeds to step S24. At step S24, if the terminal device 10 does not accept the user's instruction that instructs the terminal device 10 to receive the broadcast signal, the terminal device 10 proceeds to step S28. At step S28, when recognizing that 30 seconds have not passed yet, the terminal device 10 returns to step S20.

As described above, the terminal device 10 switches the displayed now-on-air information to that of the other broadcast station in response to the user's selection of the broadcast station from the broadcast station list. When the user wants to receive the broadcast signal of the displayed broadcast station, the user selects this displayed broadcast station by the prescribed operation. Thereby, the terminal device 10 receives and reproduces its broadcast signal.

And also, it is possible to automatically switch the displayed now-on-air information.

Figure 12:
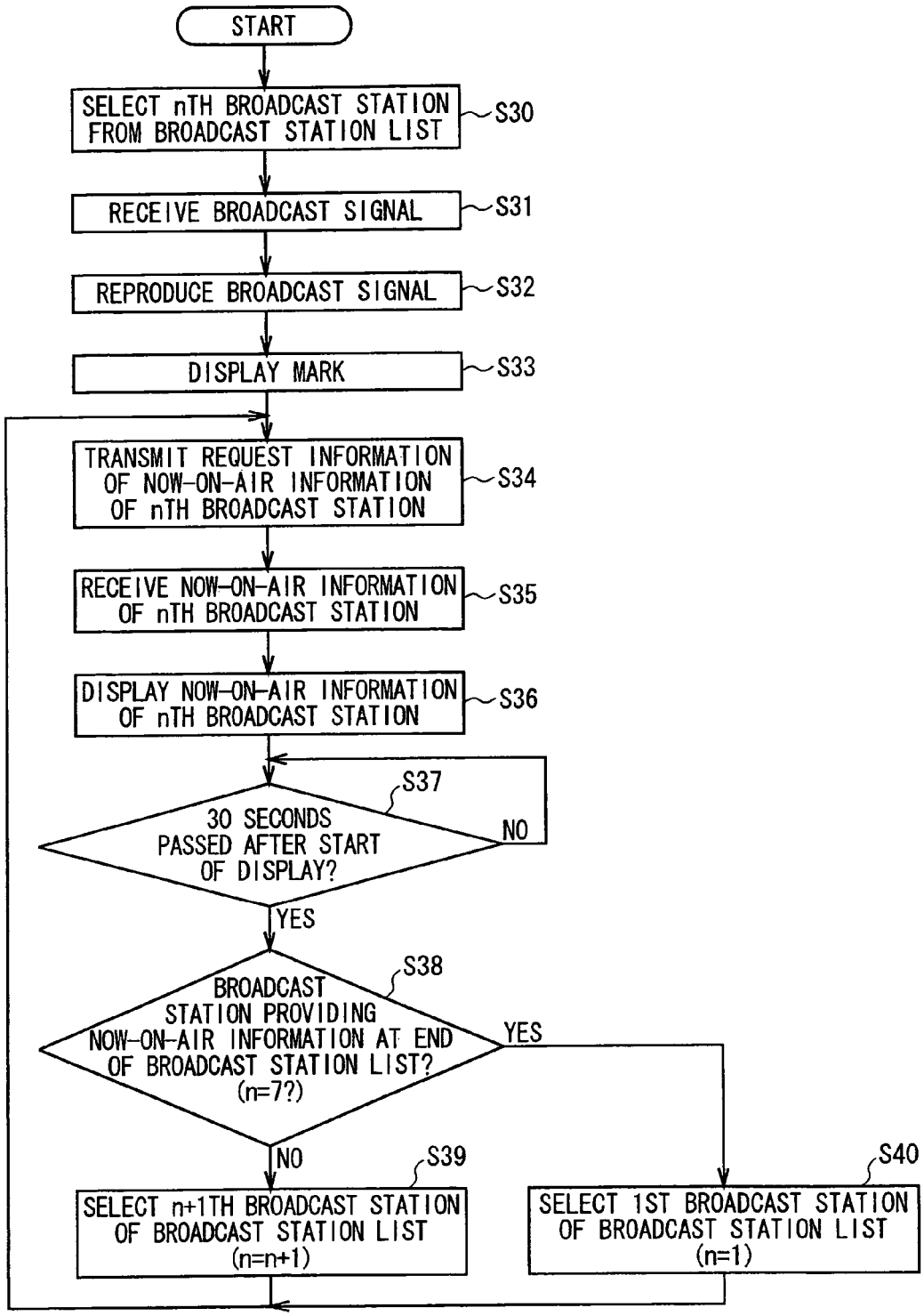
FIG. 12 is a diagram showing another example of the flow in which the terminal device performs a broadcast signal receive/reproduce process and an associated information acquisition process.

FIG. 12 is a diagram showing another example of the flow in which the terminal device performs a broadcast signal receive/reproduce process and an associated information acquisition process. In the following description, the broadcast station list includes 7 broadcast stations like the example shown in FIG. 9 and FIG. 10.

The user sets up the terminal device 10 to run its tuner function and moves the focus and pushes the decision key by using the remote control 40 or the like. Therefore, the focused broadcast station, that is to say, the nth (n=1 through 7) broadcast station from the top of the broadcast station list is selected (step S30). The terminal device 10 in response to the selection of-the broadcast station chooses the frequency of this broadcast station from registered information as its receiver frequency to receive the broadcast signal of this broadcast station (step S31), and reproduces the received broadcast signal (step S32). At this time, the terminal device 10 displays a mark 52*a* for the nth broadcast station in the broadcast station list display area 52 (step S33).

In addition, the terminal device 10 transmits the request information that includes the call sign of the nth broadcast station selected by moving the focus to request the now-on-air information (step S34). And then, the terminal device 10 receives the now-on-air information corresponding to the request information (step S35), and displays the received now-on-air information on the now-on-air information display area 51 (step S36). In this case, "Now On Air" (indicated by the reference numeral 51*a*) is displayed in a large way and boldface.

And the terminal device 10 checks whether or not a certain period of time (30 seconds, for example) has passed after the terminal device 10 started to display the now-on-air information of the nth broadcast station (step S37). At this step S37, the terminal device 10 continues to display this now-on-air information on the now-on-air information display area 51 until recognizing the 30 seconds have passed.

At step 37, if the terminal device 10 recognizes that 30 seconds have passed, the terminal device 10 checks whether or not the broadcast station that is now providing the now-on-air information to be displayed is listed at the end of the broadcast station list, which is to say the broadcast station that is now providing the now-on-air information to be displayed is the broadcast station G (n=7) in the example of FIG. 9 and FIG. 10 (step S38).

At step 38, if the terminal device 10 recognizes that the broadcast station is not the broadcast station G (n=7), the terminal device 10 automatically selects the n+1th broadcast station from the top of the broadcast station list (step S39). Whereas if the terminal device 10 recognizes that the broadcast station is the broadcast station G (n=7), the terminal device 10 automatically selects the broadcast station A (n=1), which is at the top of the broadcast station list (step S40).

If the terminal device 10 selects the n+1th broadcast station from the top of the broadcast station list at step S39, the terminal device 10 returns to step S34 (n=n+1 or 1) and repeats the following steps. And if the terminal device 10 selects the 1st broadcast station A of the broadcast station list at step 40, the terminal device 10 also returns to step S34 (n=n+1 or 1) and repeats the following steps.

The process described above allows the terminal device 10 to sequentially display now-on-air information (for example, a broadcast station name, a music name and artist name of the broadcasted music, a program name, a broadcast time, and the like) of each broadcast station in the broadcast station list on the now-on-air information display area 51 at a certain interval of time, while receiving the broadcast signal of a certain broadcast station.

When the user of the terminal device 10 finds interesting now-on-air information during watching the now-on-air information being sequentially displayed on the now-on-air information display area 51, the user can make the terminal device 10 receive and reproduce the broadcast signal of the broadcast station that provides the interesting now-on-air information by doing the operation in which the user forcibly moves the focus of the broadcast station list to this broadcast station and selects it by using the remote control 40 or the like. The terminal device 10 does the same process as that of FIG. 12, even after its receiver frequency is changed.

In the above description, the associated information such as now-on-air information of each broadcast station is sequentially displayed on just one place, which is the now-on-air information display area 51 disposed on the screen. But it is also possible to display the associated information of every broadcast station on the screen 50 at once.

Figure 13:
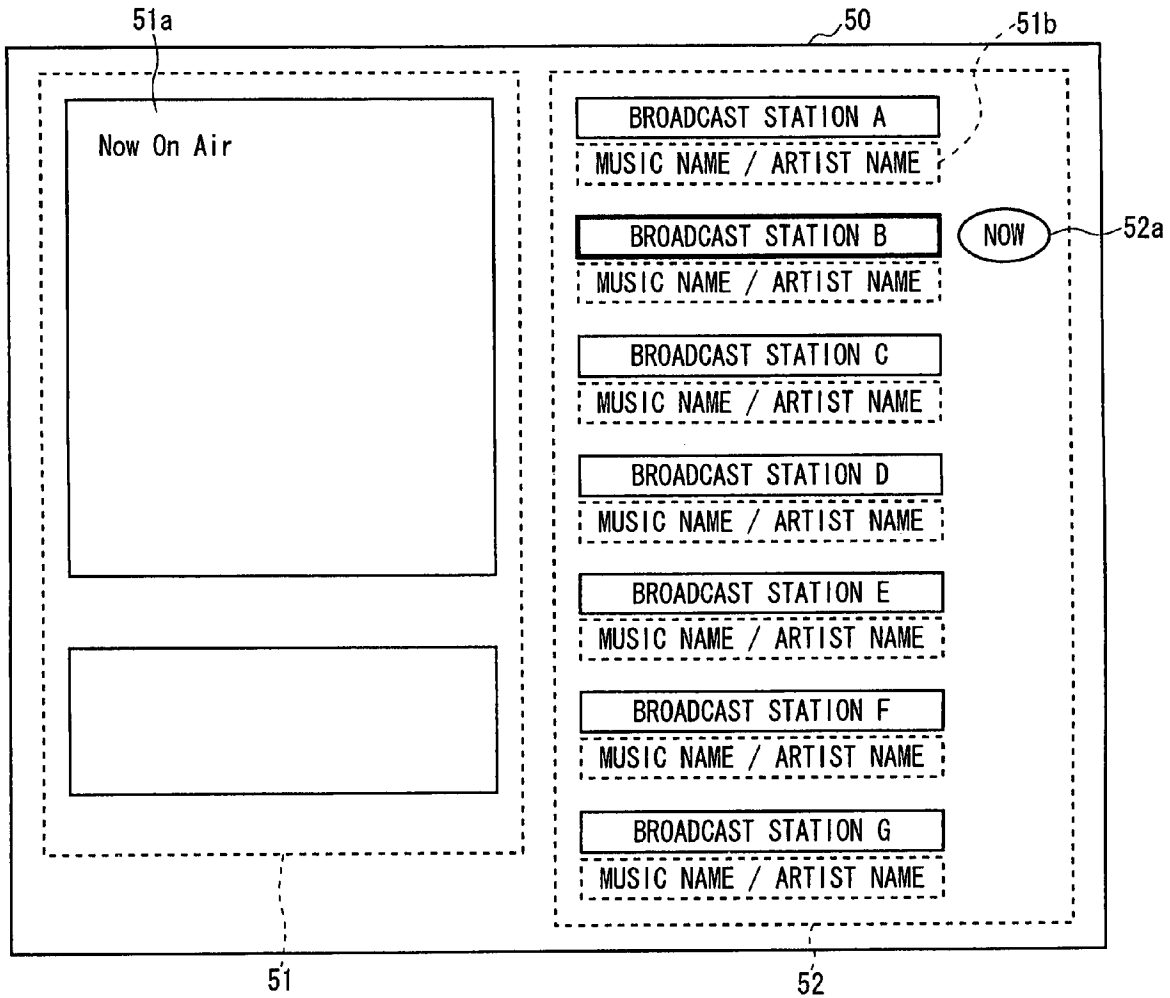
FIG. 13 is an example of displaying the associated information of every broadcast station at once.

FIG. 13 shows an example of displaying the associated information of every broadcast station at once.

In this example shown in FIG. 13, the screen 50 has a now-on-air information display area 51 and a broadcast station list display area 52 as well as that of FIG. 9 and FIG. 10. This broadcast station list area 52 has small and belt-shaped areas. They are now-on-air information display areas 51*b* for displaying the now-on-air information of each broadcast station A through G.

The process described in FIG. 12 sequentially displays the now-on-air information on the now-on-air information display area 51. The small now-on-air information display areas 51*b*, which correspond to each broadcast station, show the whole or part of the now-on-air information (for example, a music name and an artist name as shown in FIG. 13), when the process described in FIG. 12 receives the now-on-air information to be displayed on the now-on-air information display area 51. And the small now-on-air information display areas 51*b* continue to display the part of the now-on-air information until receiving the next now-on-air information of these broadcast stations.

The displaying of now-on-air information of each broadcast station-in this manner allows the user to read the now-on-air information of all registered broadcast stations on the screen 50 at once. It is also possible to sequentially change the displayed information on-the now-on-air information display areas 51*b* that correspond to each broadcast station, while displaying the now-on-air information of either the broadcast station from which the terminal device 10 is receiving the broadcast signal or the broadcast station selected by the user on the now-on-air information display area 51.

Also, it is possible to repeatedly perform a process at a certain interval of time in which, the terminal device 10 transmits the request information that includes the call signs of every broadcast station and receives the now-on-air information corresponding to them and displays it.

The number of the registered broadcast stations in the broadcast station list is not limited to that of the described example.

As described above, the user can clip the now-on-air information displayed on the now-on-air information display area 51 by moving a cursor or the like and selecting it by using the remote control 40 or the like.

The clipped information is utilized for searching for music, purchasing audio data, purchasing CDs and DVDs, or the like, when the terminal device 10 accesses the CD title information provision server 31, the music distribution server 33, the CD shop server 34, or the like.

The programs that the CPU 11 of the terminal device 10 executes make possible the processes and functions described above. The programs, for example, are stored in the HDD 22 or the ROM 13.

Alternatively, the programs may be permanently or temporarily stored in a removable storage medium, such as flexible disk, a CD-ROM, a MO (Magneto-Optical) disk, a DVD, a Magnetic Disk, a semiconductor memory. The storing of the programs in these removable media makes it possible to provide the programs as packaged software.

In this embodiment, for example, the storing of the programs in the medium that the media drives 19*a*, 19*b* support makes it possible to provide the programs as packaged software. Thereby, the terminal device 10 can read the programs from the medium by controlling the media drives 19*a*, 19*b*, and install them on the HDD 21 or the ROM 13. The packaged software also makes it possible to install the programs to which this invention is applied on a general-purpose personal computer.

Except for installing from the removable storage media as described above, it is also possible to download from servers or the like that memorizes the programs via a network such as LAN (Local Area Network), the Internet.

Also, it is possible to make the updated program that has additional processes and functions to which this invention is applied, and deliver the updated program as packaged software or distribute it via the network. In this case, when the user obtains the updated program, the user can install it on the computer on which the former version of the program has been installed.

An example of a service system in which one of a plurality of servers provides the now-on-air information of broadcast stations will be described in detail with reference to FIG. 14 through FIG. 26. A music related service provision system 1000 shown in FIG. 14 has a single sign-on function. The reproduction apparatus 1 (terminal device 10) described above corresponds to a client terminal 1002. The broadcast station servers 32*aa*, 32*ba* described above correspond to a radio broadcast information delivery server 1006. The network 30 described above corresponds to a network NT1000.

(1) Music Related Service Provision System (1-1) System Configuration

Figure 14:
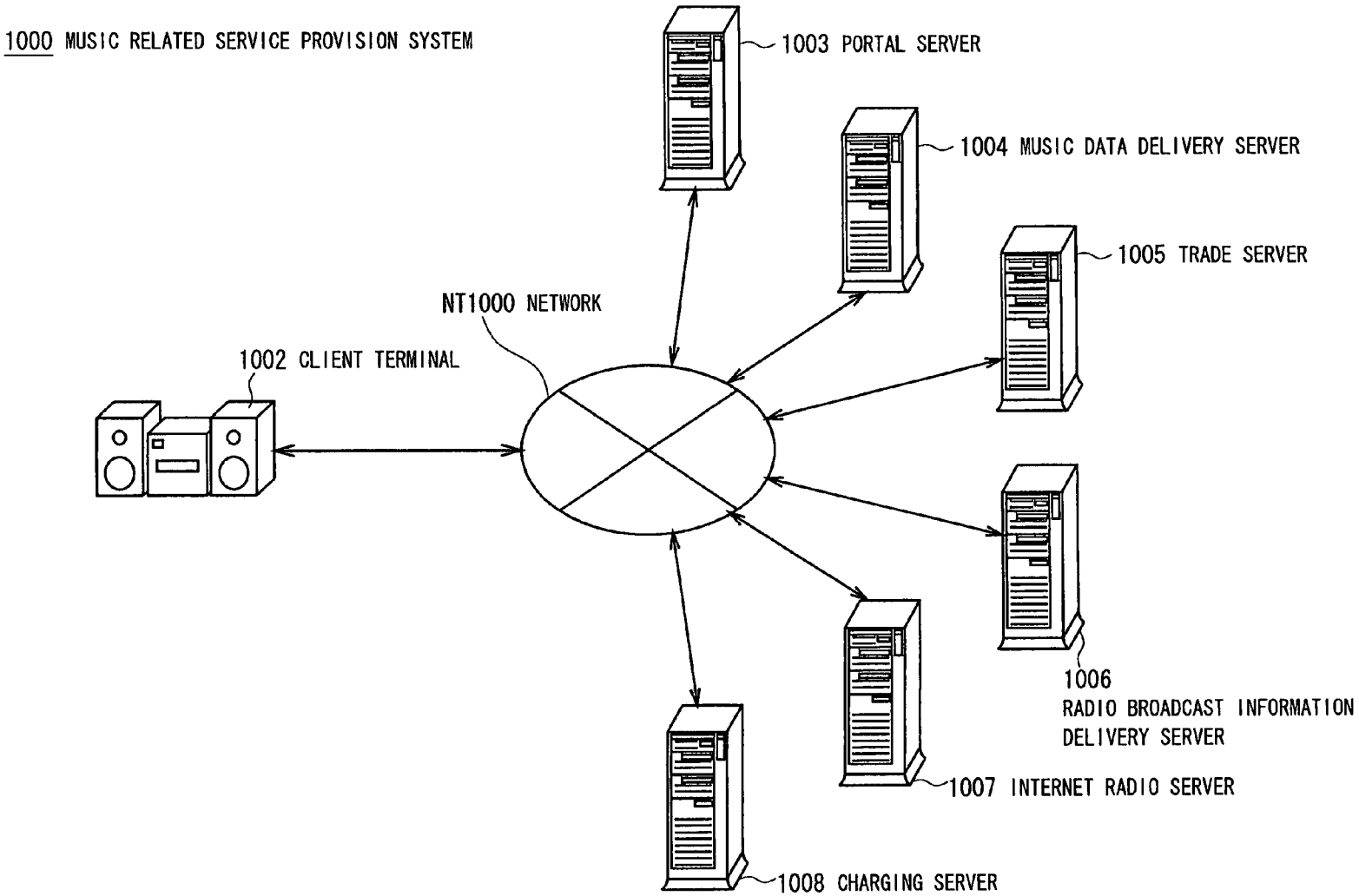
FIG. 14 is a schematic diagram showing the overall configuration of a music related service provision system in accordance with the present embodiment.

Referring to FIG. 14, the reference numeral 1000 denotes a music related service provision system as a whole. The system 1000 comprises a client terminal 1002 and a plurality of service servers. The client terminal 1002 belongs to a user who makes a contract with a service provider of the music related service provision system 1000. The service servers include: a portal server 1003 to manage the client terminal 1002; and the other servers 1004 through 1008 to provide the client terminal 1002 with various services related to the music.

According to this embodiment, the music data delivery server 1004 provides music data delivery services to deliver music data as content data to the client terminal 1002. The content data complies with such formats as ATRAC3 (Adaptive Transform Acoustic Coding 3), AAC (Advanced Audio Coding), WMA (Windows Media Audio), RealAUDIO G2 Music Codec, and MP3 (MPEG Audio Layer-3).

A trade server 1005 provides trade services to sell CD (Compact Disc), DVD (Digital Versatile Disc), and the like to the user via the client terminal 1002.

Further, the radio broadcast information delivery server 1006 provides radio broadcast information delivery services to deliver radio broadcast information to the client terminal 1002. Specifically, the radio broadcast information includes radio programs, music, and the like broadcast from a radio station.

The Internet radio server 1007 provides Internet radio broadcast services to broadcast radio broadcast data to the client terminal 1002 via the network NT1000 equivalent to the Internet. The radio broadcast data is delivered in streaming format.

In addition, a charging server 1008 performs a charging process to charge users for various fees in response to requests from the portal server 1003 and the like.

(1-2) Configuration of Client Terminal 1002

(1-2-1) Functional Circuit Block Configuration of Client Terminal 1002

Figure 15:
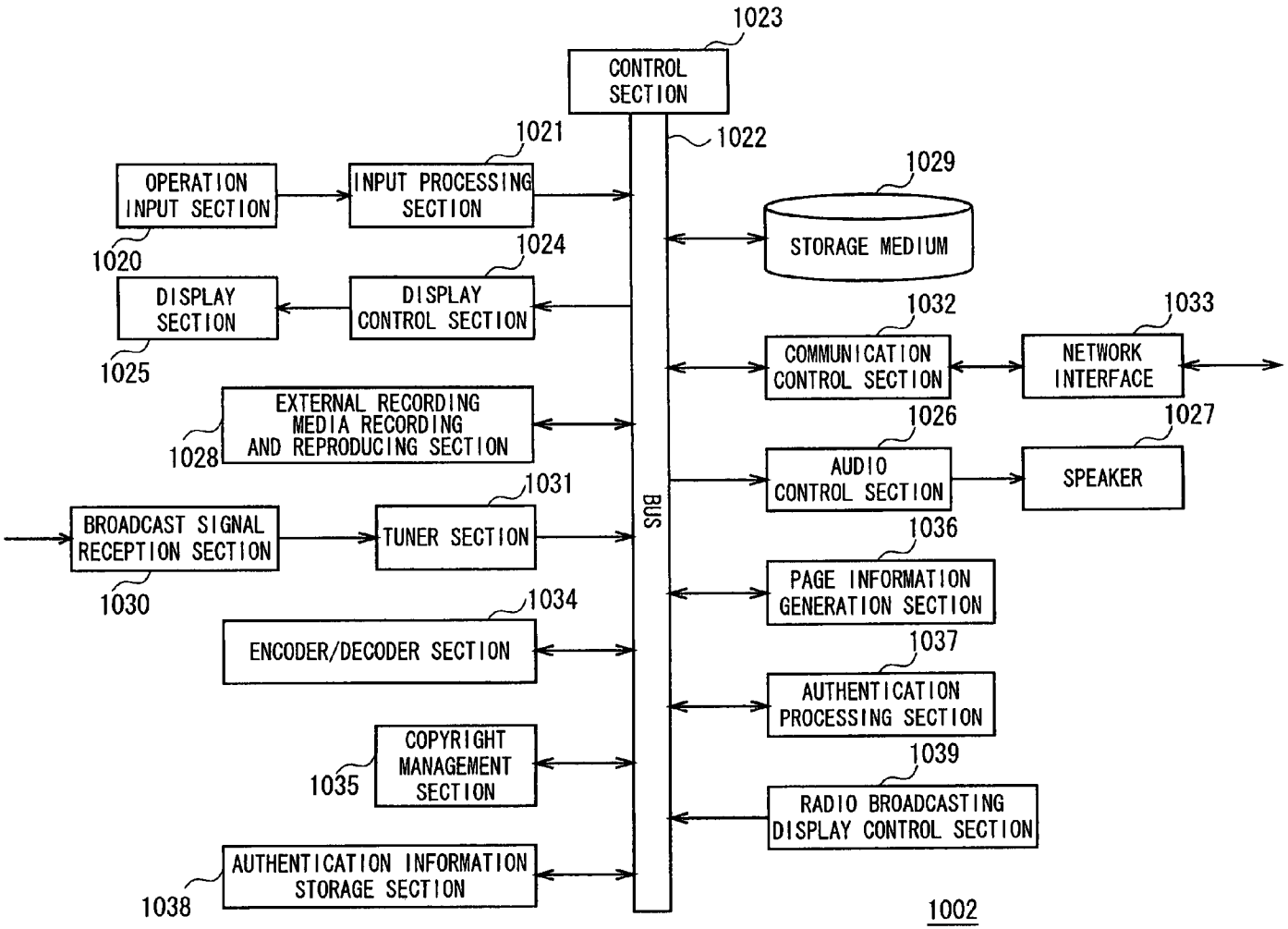
FIG. 15 is a block diagram showing the hardware configuration of a client terminal using functional circuit blocks.

The following describes the hardware configuration of the client terminal 1002 using functional circuit blocks. As shown in FIG. 15, the client terminal 1002 has an operation input section 1020 comprising various operation buttons provided on the surface of the client terminal cabinet or a remote controller (not shown). When a user operates the operation input section 1020, it detects the user operation and sends an input operation signal corresponding to the operation to an input processing section 1021.

The input processing section 1021 is supplied with the input operation signal from the operation input section 1020, converts the signal into a specific operation command, and sends it to a control section 1023 via a bus 1022.

The control section 1023 is supplied with operation commands and control signals from circuits connected to the bus 1022. Based on these operation commands and control signals, the control section 1023 controls operations of these circuits.

A display control section 1024 is supplied with video data via the bus 1022 and applies digital-analog conversion to the video data to generate an analog video signal. The display control section 1024 sends the resulting analog video signal to a display section 1025.

The display section 1025 represents a display device such as a liquid crystal display and may be directly attached to the surface of the main unit cabinet or may be externally connected.

The display section 1025 is supplied with processing results from the control section 1023 and various video data as an analog video signal via the display control section 1024. The display section 1025 displays a video based on the analog video signal.

An audio control section 1026 applies digital-analog conversion to audio data supplied via the bus 1022 and sends a resulting analog audio signal to a speaker 1027. The speaker 1027 outputs audio based on the analog audio signal supplied from the audio control section 1026.

An external recording media recording and reproducing section 1028 reads and reproduces content data from external recording media such as CDs and Memory Stick (registered trademark), and records targeted content data on the external recording media. Memory Stick comprises flash memory enclosed in a packaging case.

The external recording media recording and reproducing section 1028 reads video data as content data from an external recording medium and supplies the read video data to the display control section 1024 via the bus 1022.

The display control section 1024 is supplied with the video data read as content data from the external recording medium by the external recording media recording and reproducing section 1028. The display control section 1024 then converts the video data into an analog video signal and sends it to the display section 1025.

The external recording media recording and reproducing section 1028 reads audio data as content data from the external recording medium and supplies the read audio data to the audio control section 1026 via the bus 1022.

When the external recording media recording and reproducing section 1028 reads audio data as content data from the external recording medium, the audio control section 1026 converts the audio data into an analog audio signal and supplies it to the speaker 1027.

When the external recording media recording and reproducing section 1028 reads the content data from the external recording medium, the control section 1023 sends that content data to a storage medium 1029 in the client terminal 1002 via the bus 1022. The control section 1023 can store the content data in the storage medium 1029. Storing content data in the storage medium 1029 is also referred to as ripping.

When reading video data such as image data as content data from the storage medium 1029, the control section 1023 supplies the read video data to the display control section 1024 via the bus 1022.

When reading audio data as content data from the storage medium 1029, the control section 1023 supplies the read audio data to the audio control section 1026 via the bus 1022.

In addition, the control section 1023 can read music data from the storage medium 1029 and transfers it to the external recording media recording and reproducing section 1028 which can then record the music data on the external recording medium.

A broadcast signal reception section 1030 receives radio broadcasting waves transmitted from radio stations and supplies them to the tuner section 1031.

As mentioned above, the broadcast signal reception section 1030 receives radio broadcasting waves. Under the control of the control section 1023, the tuner section 1031 extracts such radio broadcasting signals from the received radio broadcasting waves as to have a broadcasting frequency corresponding to the radio station specified by the operation input section 1020, for example. The tuner section 1031 then applies specified reception processing to the extracted signals. The tuner section 1031 sends resulting audio data to the audio control section 1026 via the bus 1022.

The audio control section 1026 converts the audio data supplied from the tuner section 1031 into an analog audio signal and sends this signal to the speaker 1027. The speaker 1027 outputs the audio of the radio program broadcast from the radio station. In this manner, the user can listen to the radio program's audio.

The control section 1023 can record audio of radio programs. To do this, the control section 1023 sends audio data acquired by the tuner section 1031 to the storage medium 1029 for storage.

Further, the control section. 1023 can connect to a network NT1000 via a communication control section 1032 and a network interface 1033 in order. Consequently, the control section 1023 can access the portal server 1003, and the other servers 1004 through 1007 on the network NT1000. In this manner, the client terminal can interchange various information and data with the portal server 1003, and the other servers 1004 through 1007, and the like.

Compressed and encoded content data is received from the network NT1000 via the network interface 1033 and the communication control section 1032 in order. Alternatively, compressed and encoded content data is read from the storage medium 1029 and external recording media. An encoder/decoder section 1034 decodes such content data and sends it to the display control section 1024 or the audio control section 1026.

Further, the encoder/decoder section 1034 compresses and encodes neither compressed nor encoded content data read from external recording media or audio data supplied from the tuner section 1031. The encoder/decoder section 1034 sends the compressed and encoded content data to the storage medium 1029.

Under the control of the control section 1023, content data is compressed and encoded in the encoder/decoder section 1034 and is stored in the storage medium 1029.

A copyright management section 1035 generates copyright management information corresponding to content data that is downloaded from the network NT1000 via the network interface 1033 and the communication control section 1032 in order or is read from external recording media by the external recording media recording and reproducing section 1028.

Under the control of the control section 1023, the copyright management information generated in the copyright management section 1035 is associated with the content data and is registered to the recording medium 1029.

The copyright management section 1035 is used to check out content data associated with the copyright management information from the storage medium 1029 to a specific external recording medium and to check in the content data associated with the copyright management information from the specific external recording medium to the storage medium 1029. The copyright management section 1035 appropriately updates contents of the copyright management information corresponding to the content data to protect the copyright of the content data.

The client terminal receives XML (extensible Markup Language) or HTML (Hyper Text Markup Language) files from the network NT1000 via the network interface 1033 and the communication control section 1032 in order. A page information generation section 1036 interprets page information of these files and generates video data to be displayed on the display section 1025. The page information generation section 1036 then sends the generated video data to the display control section 1024.

An authentication processing section 1037 performs authentication processes such as sending authentication information to the portal server 1003 and the other servers 1004 through 1007 on the network NT1000 connected via the network interface 1033, via the communication control section 1032 and the network interface 1033 in order.

An authentication information storage section 1038 stores authentication information needed for the authentication processing section 1037 to access the portal server 1003, the other servers 1004 through 1007, and the like.

A radio broadcasting display control section 1039 sends a request signal to the radio broadcast information delivery server 1006 via the communication control section 1032 and the network interface 1033 in order. This request signal is used to request information about the radio broadcast currently received by the user for listening. The radio broadcast information delivery server 1006 corresponds to the radio station that carries the radio broadcast being received.

As a result, the radio broadcasting display control section 1039 receives the radio broadcast information received from the radio broadcast information delivery server 1006 on the network NT1000 via the network interface 1033 and the communication control section 1032 in order. In addition, the radio broadcasting display control section 1039 sends the received radio broadcast information to the display control section 1024. This allows the display section 1025 to display the radio broadcast information comprising a name of the currently received radio program, a title and an artist name of the currently received music, and the like.

(1-2-2) Directory Management

Figure 16:
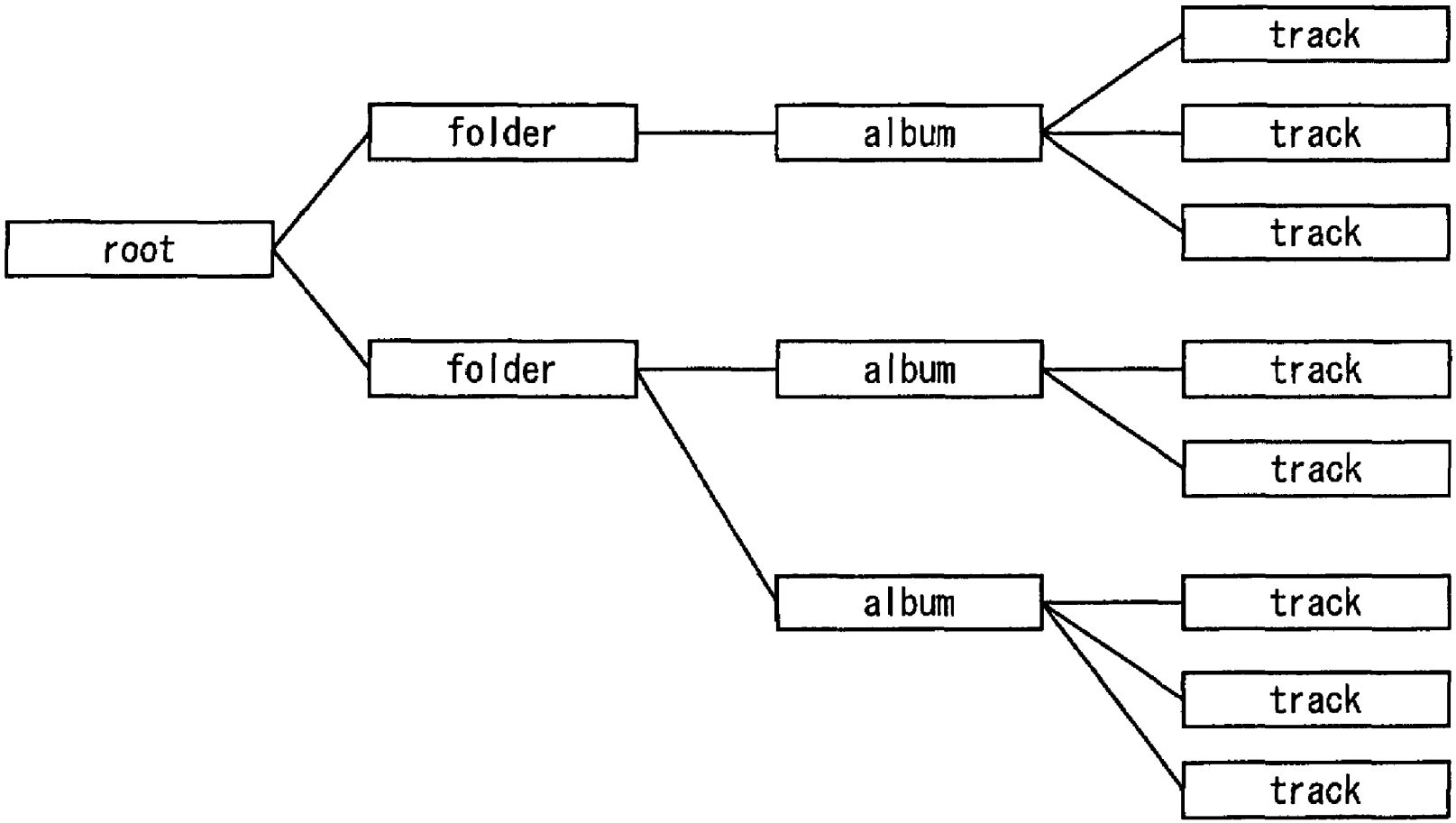
FIG. 16 is a schematic diagram showing a directory structure.

The control-section 1023 of the client terminal 1002 manages the content data to be stored in the storage medium 1029 based on the structure of directory as shown in FIG. 16. Some number of "folder" directories can be created within a specified range under a "root" directory. For example, the "folder" directory is created to correspond to a genre of contents, an owner user, or the like.

Some number of "album" directories can be created within a specified range under the "folder" directories. For example, each "album" directory corresponds to an album title. One or more "track" files are stored under the "album" directory, so as to belong to this directory. The "track" file corresponds to a piece of music, or a piece of content. The directory management of content data is controlled by database files stored in the storage medium 1029.

(1-3) Functional Circuit Block Configuration of Portal Server 1003

Figure 17:
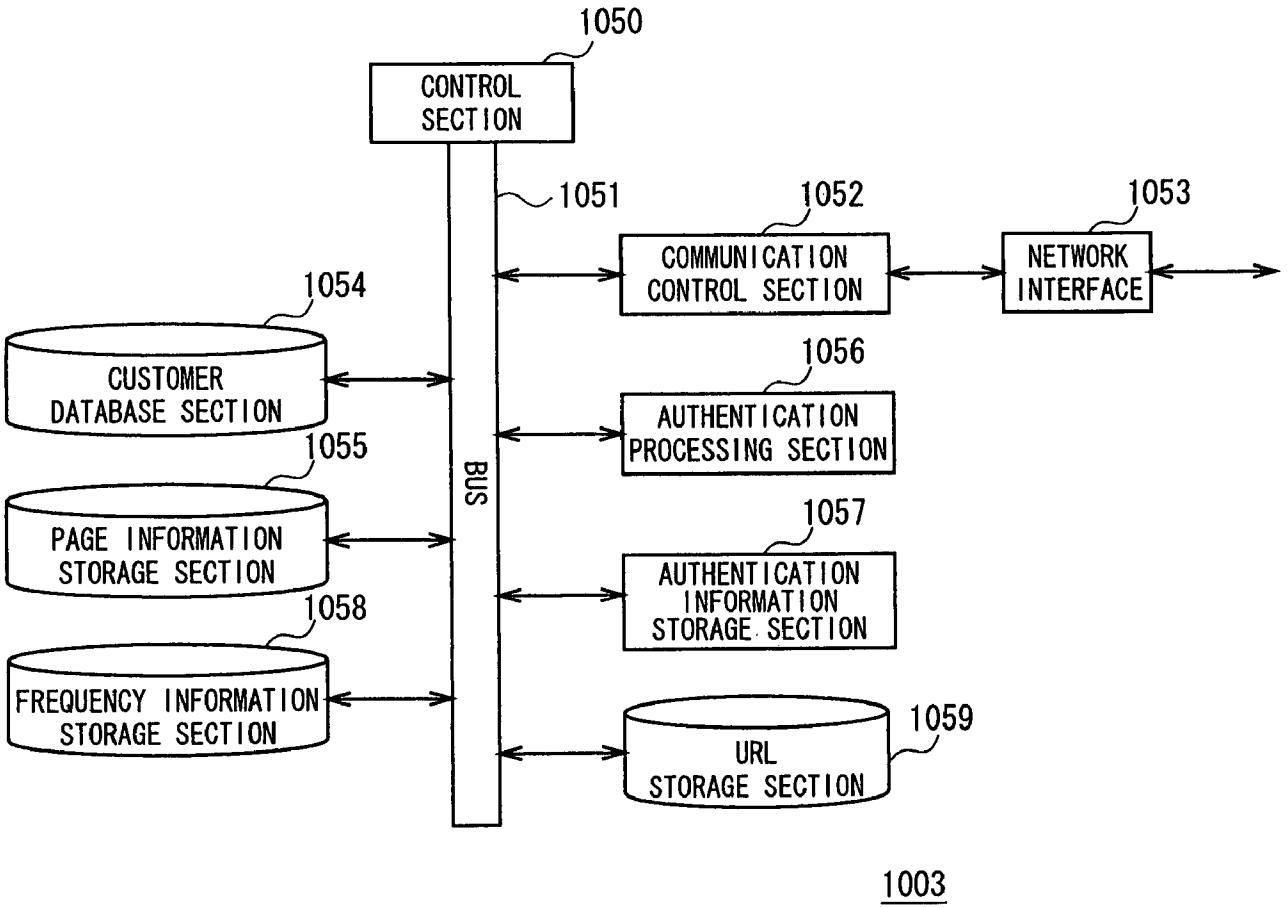
FIG. 17 is a block diagram showing the hardware configuration of a portal server using functional circuit blocks.

With reference to FIG. 17, the following describes the hardware configuration of the portal server 1003 using functional circuit blocks. A control section 1050 in the portal server 1003 controls operations of circuits connected via a bus 1051.

Under the control of the control section 1050, a communication control section 1052 interchanges various information with the client terminal 1002, the other servers 1004 through 1008, and the like via a network interface 1053.

A customer database section 1054 registers customer information comprising user ID (identification) information and associated password information of a user who has completed a, contract with a service provider of a music related service provision system 1000.

A page information storage section 1055 stores page information and the like managed by the music related service provision system's service provider.

The page information is written in languages such as XML and includes URL (Uniform Resource Locator) information to access a music data delivery server 1004, a trade server 1005, a video broadcast information delivery server 1006, an Internet radio server 1007 and the like.

An authentication processing section 1056 receives the user ID information and the password information sent from the client terminal 1002 via the network interface 1053 and the communication control section 1052 in order. The authentication processing section 1056 then performs a user authentication process to confirm whether or not the customer database section 1054 stores the received user ID information and password information as the customer information.

Upon completion of the user authentication process, the authentication processing section 1056 issues portal authentication result information (authentication session ID information to be described later) indicating the result of the user authentication process. The authentication processing section 1056 temporarily stores the issued portal authentication result information in the authentication information storage section 1057.

Let us assume that the user is authenticated to be a registered user as a result of the user authentication process by the authentication processing section 1056. In this case, the control section 1050 sends page information about a contractor page stored in the page information storage section 1055 as well as the portal authentication result information to the client terminal 1002 via the communication control section 1052 and the network interface 1053 in order.

Next, let us assume that the user is not authenticated to be a registered user as a result of the user authentication process by the authentication processing section 1056. In this case, the control section 1050 may be configured to send authentication error information as well as unsuccessful authentication notification page information indicating the unsuccessful authentication to the client terminal 1002 via the communication control section 1052 and the network interface 1053 in order. The unsuccessful authentication notification page information is stored in the page information storage section 1055.

As a result of performing authentication processes for the user from the music data delivery server 1004, the trade server 1005, the radio broadcast information delivery server 1006 and the like, the authentication processing section 1056 receives portal authentication result information (authentication ticket to be described later) via the network interface 1053 and the communication control section 1052 in order. The portal authentication result information is acquired and sent from the user's client terminal 1002. Then, the authentication processing section 1056 compares the received portal authentication result information with the portal authentication result information that is temporarily stored in the authentication information storage section 1057 corresponding to the user.

The authentication processing section 1056 performs a confirmation process, as an authentication process for the portal authentication result information received from the music data delivery server 1004, the trade server 1005, the radio broadcast information delivery server 1006 and the like. Specifically, the authentication processing section 1056 confirms whether or not the portal authentication result information is authenticated. The authentication processing section 1056 then returns confirmation result information indicating a confirmation result to the music data delivery server 1004, the trade server 1005, the radio broadcast information delivery server 1006 and the like via the communication control section 1052 and the network interface 1053 in order.

A frequency information storage section 1058 stores the following associated with each other: an area code such as a postal guide number capable of specifying an area; frequency information indicating broadcast frequencies for radio broadcasts receivable in the area indicated by the area code; a name of the radio station (hereafter referred to as a radio station name) that broadcasts the radio broadcast; and the call sign that is identification information unique to each radio station.

A URL storage section 1059 stores the following associated with each other: a call sign for radio broadcast corresponding to each radio station; and URL information capable of acquiring radio broadcast information (hereafter referred to specifically as now-on-air information). This information concerns a currently broadcast radio program provided by the radio station corresponding to the call sign and comprises a name of the radio program, a title of the music currently broadcast in the radio program, and the like.

(1-4) Functional Circuit Block Configuration of Music Data Delivery Server 1004

Figure 18:
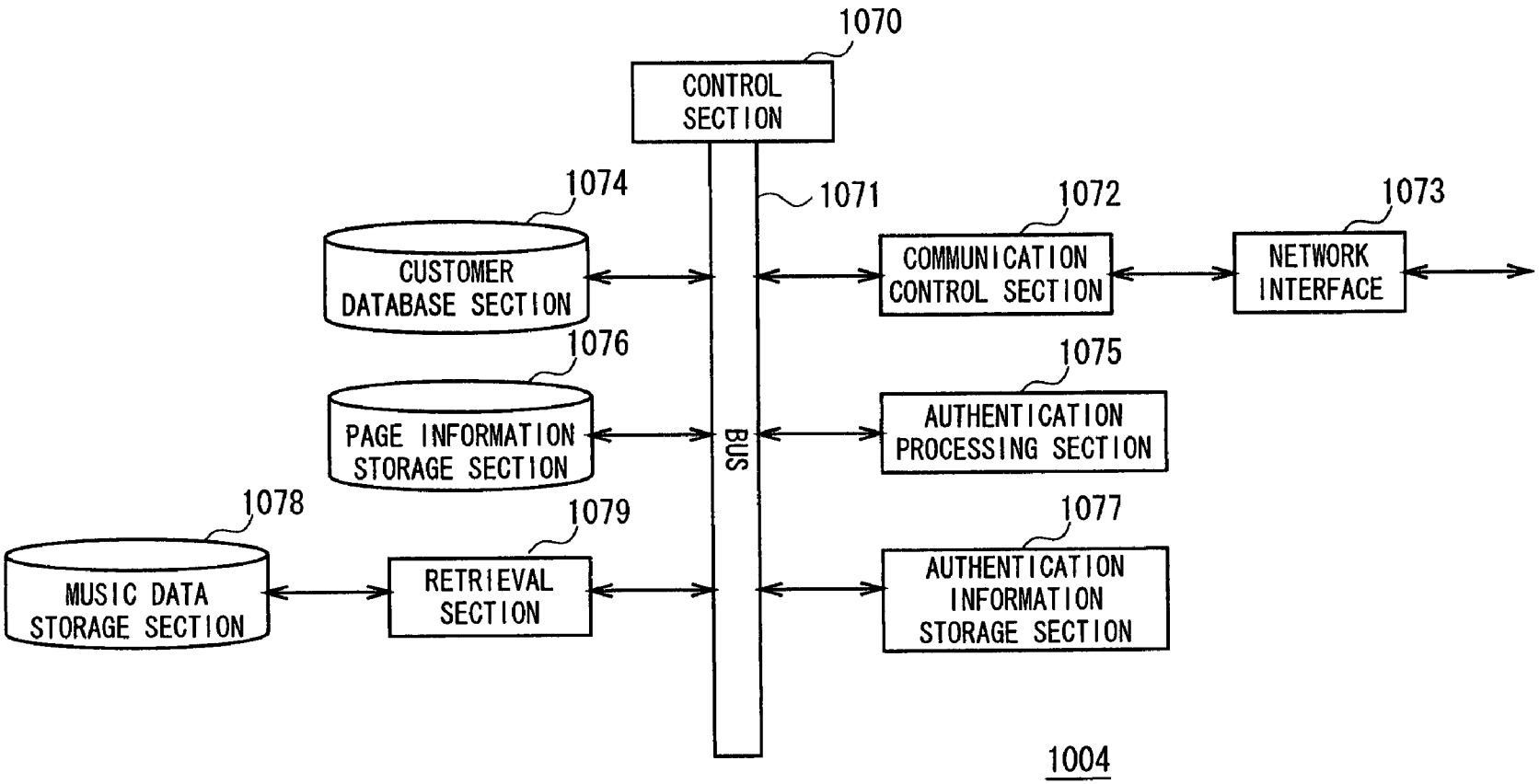
FIG. 18 is a block diagram showing the hardware configuration of a music data delivery server using functional circuit blocks.

Referring now to FIG. 18, the following describes the hardware configuration of the music data delivery server 1004 using functional circuit blocks. A control section 1070 in the music data delivery server 1004 controls operations of circuits connected via a bus 1071.

Under control of the control section 1070, a communication control section 1072 interchanges various information and data such as content data with the client terminal 1002, the portal server 1003, and the like via a network interface 1073.

A customer database section 1074 stores customer information comprising a corresponding combination of user ID information and password information about users who have completed contracts with a service provider of the music data delivery server 1004. An authentication processing section 1075 may have a function to authenticate users based on portal authentication result information that is issued by the portal server 1003 and is transmitted from the client terminal 1002. In such case, the customer database section 1074 may be omitted.

A page information storage section 1076 stores information such as page information about music data delivery pages for presenting downloadable music data. The music data delivery server 1004 manages this information.

The page information about music data delivery pages is written in languages such as XML. This enables a user of the client terminal 1002 to select intended music data to be downloaded.

The control section 1070 receives a page information acquisition request signal transmitted from the client terminal 1002 via the network interface 1073 and the communication control section 1072 in order. The page information acquisition request signal requests page information about music data delivery pages. According to the received page information acquisition request signal, the control section 1070 transmits the page information about music data delivery pages to the client terminal 1002 via the communication control section 1072 and the network interface 1073 in order. The page information about music data delivery pages is stored in the page information storage section 1076.

The authentication processing section 1075 receives the user ID information and the password information about the user of the client terminal 1002 from it via the network interface 1073 and the communication control section 1072 in order. The authentication processing section 1075 then performs a user authentication process to confirm whether or not the customer database section 1074 stores the received user ID information and password information as the customer information.

Further, the authentication processing section 1075 uses a user authentication technique that differs from the user authentication process using the user ID information and the password information. That is to say, the authentication processing section 1075 receives portal authentication result information (authentication ticket to be described later) that is issued by the portal server 1003 and is transmitted from the client terminal 1002 via the network interface 1073 and the communication control section 1072 in order. The authentication processing section 1075 then transmits the received portal authentication result information to the portal server 1003 via the communication control section 1072 and the network interface 1073 in order.

In response to the portal authentication result information transmitted to the portal server 1003, the authentication processing section 1075 receives confirmation result information via the network interface 1073 and the communication control section 1072 in order. The confirmation result information is returned from the portal server 1003 as a result of applying the authentication process (i.e., the above-mentioned confirmation process) to the portal authentication result information. Based on the received confirmation result information, the authentication processing section 1075 confirms whether or not the user is a registered user who completed a contract with the service provider of the music related service provision system 1000.

Upon completion of the user authentication process, the authentication processing section 1075 issues the server authentication result information (service session ID information to be described later) indicating the result of the user authentication process.

Let us assume that the user is authenticated to be a registered user as a result of the user authentication process by the authentication processing section 1075. In this case, the control section 1070 transmits page information as well as the server authentication result information to the client terminal 1002 via the communication control section 1072 and the network interface 1073 in order. The page information is related to a music data delivery page that is reserved for contractors and is stored in the page information storage section 1076.

By contrast, let us assume that the user is not authenticated to be a registered user as a result of the user authentication process by the authentication processing section 1075. In this case, the control section 1070 transmits authentication error information as well as unsuccessful authentication notification page information to the client terminal 1002 via the communication control section 1072 and the network interface 1073 in order. The unsuccessful authentication notification page information is stored in the page information storage section 1076 and indicates unsuccessful authentication.

The authentication information storage section 1077 temporarily stores server authentication result information issued by the authentication processing section 1075. The authentication information storage section 1077 also stores various types of authentication information needed for the authentication processing section 1075 to authenticate users who use the client terminal 1002.

A music data storage section 1078 stores a plurality of music data compressed and encoded in the above-mentioned formats such as ATRAC3 and MP3. The music data are associated with retrieval keys such as content ID information.

As mentioned above, the control section 1070 transmits the page information about the music data delivery page to the client terminal 1002. As a result, the client terminal 1002 transmits a download request signal that stores a retrieval key for retrieving music data intended for download and requests the download of intended music data. The music data delivery server 1004 receives the download request signal via the network interface 1073 and the communication control section 1072 in order. In this case, the retrieval section 1079 retrieves the corresponding retrieval key from the received download request signal.

Based on the retrieval key, the retrieval section 1079 searches a plurality of pieces of music data in the music data storage section 1078 for music data intended for download, i.e., one matching a retrieval condition indicated by the retrieval key.

The control section 1070 then transmits the retrieved music data intended for download to the client terminal 1002 via the communication control section 1072 and the network interface 1073 in order.

At this time, the control section 1070 transmits charging information to the charging server 1008 via the communication control section 1072 and the network interface 1073 in order. The charging information is used to charge-the user who downloaded the music data to the client terminal 1002. In this manner, the control section 1070 allows the charging server 1008 to perform a charging process corresponding to the music data downloaded by the user.

(1-5) Functional Circuit Block Configuration of Trade Server 1005

Figure 19:
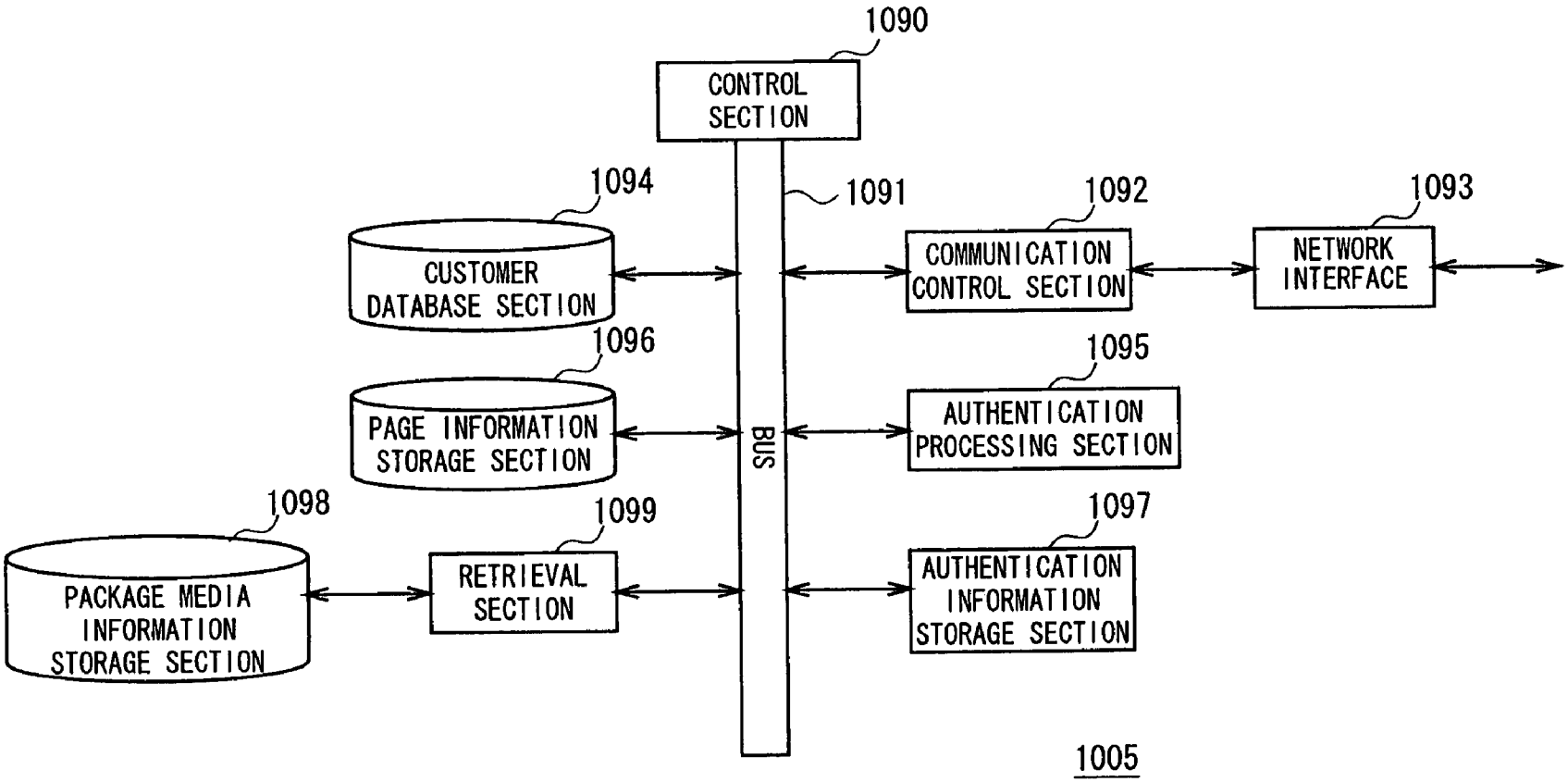
FIG. 19 is a block diagram showing the hardware configuration of a trade server using functional circuit blocks.

Referring now to FIG. 19, the following describes the hardware configuration of the trade server 1005 using functional circuit blocks. A control section 1090 in the trade server 1005 controls operations of circuits connected via a bus 1091.

Under control of the control section 1090, a communication control section 1092 interchanges various types of information with the client terminal 1002, the portal server 1003, and the like via a network interface 1093.

A customer database section 1094 stores customer information comprising a corresponding combination of user ID information and password information about users who have completed contracts with a service provider of the trade server 1005. An authentication processing section 1095 may have a function to authenticate users based on portal authentication result information that is issued by the portal server 1003 and is transmitted from the client terminal 1002. In such case, the customer database section 1094 may be omitted.

A page information storage section 1096 stores information such as page information about package media sales pages for presenting package media such as CD and DVD for sale. The trade server 1005 manages this information.

The page information about package media sales pages is written in languages such as XML. This enables a user of the client terminal 1002 to select intended package media such as CD and DVD to be purchased.

The control section 1090 receives a page information acquisition request signal transmitted from the client terminal 1002 via the network interface 1093 and the communication control section 1092 in order. The page information acquisition request signal requests page information about package media sales pages. According to the received page information acquisition request signal, the control section 1090 transmits the page information about package media sales pages to the client terminal 1002 via the communication control section 1092 and the network interface 1093 in order. The page information about package media sales pages is stored in the page information storage section 1096.

The authentication processing section 1095 receives the user ID information and the password information about the user of the client terminal 1002 from it via the network interface 1093 and the communication control section 1092 in order. The authentication processing section 1095 then performs a user authentication process to confirm whether or not the customer database section 1094 stores the received user ID information and password information as the customer information.

Further, the authentication processing section 1095 uses a user authentication technique that differs from the user authentication process using the user ID information and the password information. That is to say, the authentication processing section 1095 receives portal authentication result information (authentication ticket to be described later) that is issued by the portal server 1003 and is transmitted from the client terminal 1002 via the network interface 1093 and the communication control section 1092 in order. The authentication processing section 1095 then transmits the received portal authentication result information to the portal server 1003 via the communication control section 1092 and the network interface 1093 in order.

In response to the portal authentication result information transmitted to the portal server 1003, the authentication processing section 1095 receives confirmation result information via the network interface 1093 and the communication control section 1092 in order. The confirmation result information is returned from the portal server 1003 as a result of applying the authentication process (i.e., the above-mentioned confirmation process) to the portal authentication result information. Based on the received confirmation result information, the authentication processing section 1095 confirms whether or not the user is a registered user who completed a contract with the service provider of the music related service provision system 1000.

Upon completion of the user authentication process, the authentication processing section 1095 issues the server authentication result information (service session ID information to be described later) indicating the result of the user authentication process.

Let us assume that the user is authenticated to be a registered user as a result of the user authentication process by the authentication processing section 1095. In this case, the control section 1090 transmits page information as well as the server authentication result information to the client terminal 1002 via the communication control section 1092 and the network interface 1093 in order. The page information is related to a package media sales page that is reserved for contractors and is stored in the page information storage section 1096.

By contrast, let us assume that the user is not authenticated to be a registered user as a result of the user authentication process by the authentication processing section 1095. In this case, the control section 1090 transmits authentication error information as well as unsuccessful authentication notification page information to the client terminal 1002 via the communication control section 1092 and the network interface 1093 in order. The unsuccessful authentication notification page information is stored in the page information storage section 1096 and indicates unsuccessful authentication.

The authentication information storage section 1097 temporarily stores server authentication result information issued by the authentication processing section 1095. The authentication information storage section 1097 also stores various types of authentication information needed for the authentication processing section 1095 to authenticate users who use the client terminal 1002.

A package media information storage section 1098 stores information (hereafter referred to as package media information) about a plurality of package media such as CD and DVD for sale. The package media information is associated with retrieval keys such as package media ID information.

As mentioned above, the control section 1090 transmits the page information about the package media sales page to the client terminal 1002. As a result, the client terminal 1002 transmits a media information request signal that requests package media information about a specific package medium such as CD and DVD. The media information request signal is received via the network interface 1093 and the communication control section 1092 in order. In this case, the retrieval section 1099 retrieves the corresponding retrieval key for retrieving the specific package medium from the received media information request signal.

Based on the retrieval key, the retrieval section 1099 searches a plurality of pieces of package media information in the package media information storage section 1098 for the package media information about the specific package medium, i.e., the information matching a retrieval condition indicated by the retrieval key.

The control section 1090 then transmits the retrieved package media information to the client terminal 1002 via the communication control section 1092 and the network interface 1093 in order. In this manner, the user is provided with the package media information about the specific package media.

As a result, the client terminal 1002 transmits a purchase request signal to request the purchase of the above-mentioned specific package medium. The control section 1090 receives the purchase request signal via the network interface 1093 and the communication control section 1092 in order. The control section 1090 then performs purchase processes such as shipping the specific package medium to the user of the client terminal 1002.

The control section 1090 transmits charging information to the charging server 1008 via the communication control section 1092 and the network interface 1093 in order. The charging information is used to charge the user who purchased the specific package medium. In this manner, the control section 1090 allows the charging server 1008 to perform a charging process corresponding to the user's purchase of the specific package medium.

When the charging server 1008 completes the charging process for the user, the control section 1090 transmits purchase completion information to the client terminal 1002 via the communication control section 1092 and the network interface 1093 in order. The purchase completion information indicates that the purchase of package media is complete.

(1-6) Functional Circuit Block Configuration of Radio Broadcast Information Delivery Server 1006

Figure 20:
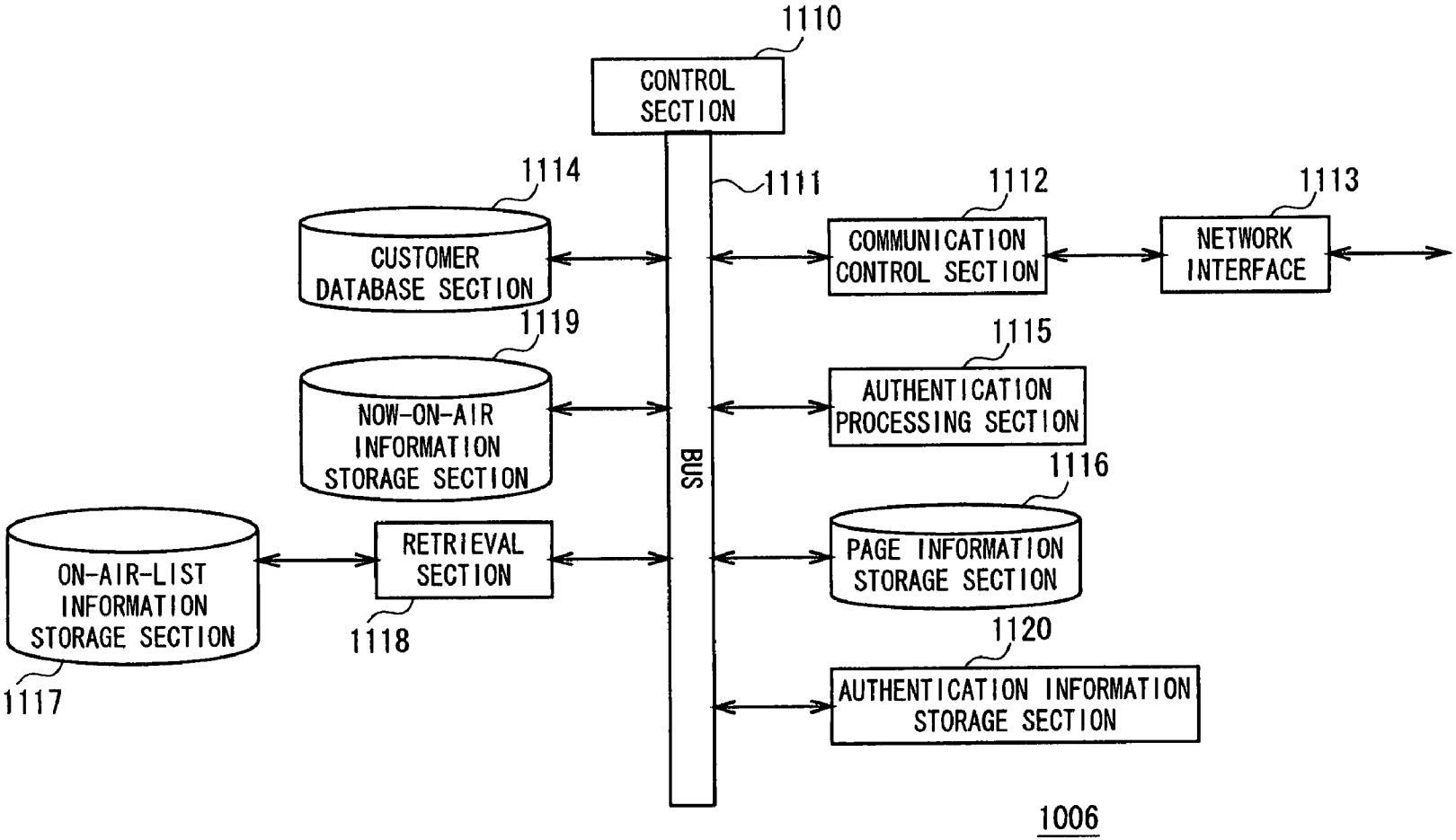
FIG. 20 is a block diagram showing the hardware configuration of a radio broadcast information delivery server using functional circuit blocks.

With reference to FIG. 20, the following describes the hardware configuration of the radio broadcast information delivery server 1006, using functional circuit blocks. A control section 1110 in the radio broadcast information delivery server 1006 controls operations of circuits connected via a bus 1111.

Under the control of the control section 1110, a communication control section 1112 interchanges various types of information with the client terminal 1002, the portal server 1003, and the like via a network interface 1113.

A customer database section 1114 registers customer information comprising user ID information and associated password information of a user who has completed a contract with a service provider of the radio broadcast information delivery server 1006. The authentication processing section 1115 may have a function to authenticate users based on the portal authentication result information that is sent from the client terminal 1002 and is issued by the portal server 1003. In such case, the customer database section 1114 may not be provided.

There is provided radio broadcast information called on-air-list information. This information is managed by the radio broadcast information delivery server 1006 and concerns the radio program already broadcast by the radio station corresponding to the radio broadcast information delivery server 1006. A page information storage section 1116 stores, for example, page information about an on-air-list information delivery page used to acquire the on-air-list information.

Page information about the on-air-list information delivery page is written in a language such as XML. There is provided an input box or the like that allows a user of the client terminal 1002 to enter retrieval keys for intended on-air-list information. For example, retrieval keys include broadcast date information, names, and the like of radio programs.

An on-air-list information storage section 1117 stores the on-air-list information generated in a list format. The on-air-list information includes: the name of the radio program already broadcasted from the radio station corresponding to the radio broadcast information delivery server 1006; program broadcast start time, program broadcast end time, and the like; and title and artist name of a music broadcasted in the radio program, music broadcast start time, and the like.

The control section 1110 receives a page information acquisition request signal to request the page information about the on-air-list information delivery page from the client terminal 1002 via the network interface 1113 and the communication control section 1112 in order. Corresponding to the received page information acquisition request signal, the control section 1110 sends the page information about the on-air-list information delivery page stored in the page information storage section 1116 to the client terminal 1002 via the communication control section 1112 and the network interface 1113 in order.

After the retrieval key is entered for the page information about the on-air-list information delivery page from the client terminal 1002, the retrieval section 1118 stores the retrieval key to retrieve the intended on-air-list information. When an on-air-list information request signal is transmitted to request download of the on-air-list information, the retrieval section 1118 receives the on-air-list information request signal via the network interface 1113 and the communication control section 1112 in order. The retrieval section 1118 then extracts the retrieval key from the received on-air-list information request signal.

Based on the retrieval key, the retrieval section 1118 searches the entire on-air-list information in the on-air-list information storage section 1117 for the targeted on-air-list information within a specified range corresponding to the retrieval condition indicated by the retrieval key.

As a result, the control section 1110 sends the retrieved targeted on-air-list information to the client terminal 1002 via the communication control section 1112 and the network interface 1113 in order.

A now-on-air information storage section 1119 stores radio broadcast information called now-on-air information. This information comprises: program name, program broadcast start time, and program broadcast end time of a radio program currently broadcasted from the radio station corresponding to the radio broadcast information delivery server 1006; and title, artist name, music broadcast start time, and the like of a music composition currently broadcasted in the radio program.

The client terminal 1002 sends not only a now-on-air information request signal to request to acquire the now-on-air information, but also user ID information and password information of the user who uses the client terminal 1002. The authentication processing section 1115 receives these pieces of information via the network interface 1113 and the communication control section 1112 in order. The authentication processing section 1115 then performs the user authentication process to confirm whether or not the received user ID information and password information are registered as the customer information in the customer database section 1114.

Further, the authentication processing section 1115 uses a user authentication technique different from the user authentication process that uses the user ID information and the password information. That is to say, the client terminal 1002 sends the portal authentication result information (authentication ticket to be described later) that is issued from the portal server 1003. The authentication processing section 1115 receives this information via the network interface 1113 and the communication control section 1112 in order. The authentication processing section 1115 then sends the received portal authentication result information to the portal server 1003 via the communication control section 1112 and the network interface 1113 in order.

After the authentication processing section 1115 sends the portal authentication result information to the portal server 1003, the portal server 1003 returns confirmation result information as a result of performing the authentication process (i.e., the above-mentioned confirmation process) corresponding to the portal authentication result information. The authentication processing section 1115 receives the confirmation result information via the network interface 1113 and the communication control section 1112 in order. Based on the received confirmation result information, the authentication processing section 1115 determines whether or not the user is a registered user who has completed a contract with the service provider of a music related service provision system 1000.

After terminating the user authentication process, the authentication processing section 1115 issues server authentication result information (service session ID information to be described later) indicating the result of the user authentication process.

Let us assume that the user is authenticated to be a registered user as a result of the user authentication process performed by the authentication processing section 1115. In this case, the control section 1110 sends the now-on-air information stored in the now-on-air information storage section 1119 as well as the server authentication result information to the client terminal 1002 via the communication control section 1112 and the network interface 1113 in order.

By contrast, let us assume that the user is not authenticated to be a registered user as a result of the user authentication process performed by the authentication processing section 1115. In this case, the control section 1110 sends authentication error information as well as unsuccessful authentication notification page information to the client terminal 1002 via the communication control section 1112 and the network interface 1113 in order. The unsuccessful authentication notification page information is stored in the page information storage section 1116 and indicates unsuccessful authentication.

In this manner, the control section 1110 functions in response to a request to acquire the now-on-air information from the user as follows. When the user is authenticated to be a registered user, the control section 1110 provides the now-on-air information. When the user is not authenticated to be a registered user, however, the control section 1110 prevents the user from receiving radio broadcast information delivery services provided by the radio broadcast information delivery server 1006 such as the now-on-air information delivery service.

The authentication information storage section 1120 temporarily stores the server authentication result information issued from the authentication processing section 1115. The authentication information storage section 1120 also stores various authentication information needed when the authentication processing section 1115 authenticates a user of the client terminal 1002.

(1-7) Process Overview of Each Server

With reference to sequence charts in FIGS. 21 through 26, the following outlines processes performed between the client terminal 1002 and the portal server 1003 and processes performed between the client terminal 1002 and each of the music data delivery server 1004, the trade server 1005, and the radio broadcast information delivery server 1006.

(1-7-1) User Authentication Process between Client Terminal 1002 and Portal Server 1003

Figure 21:
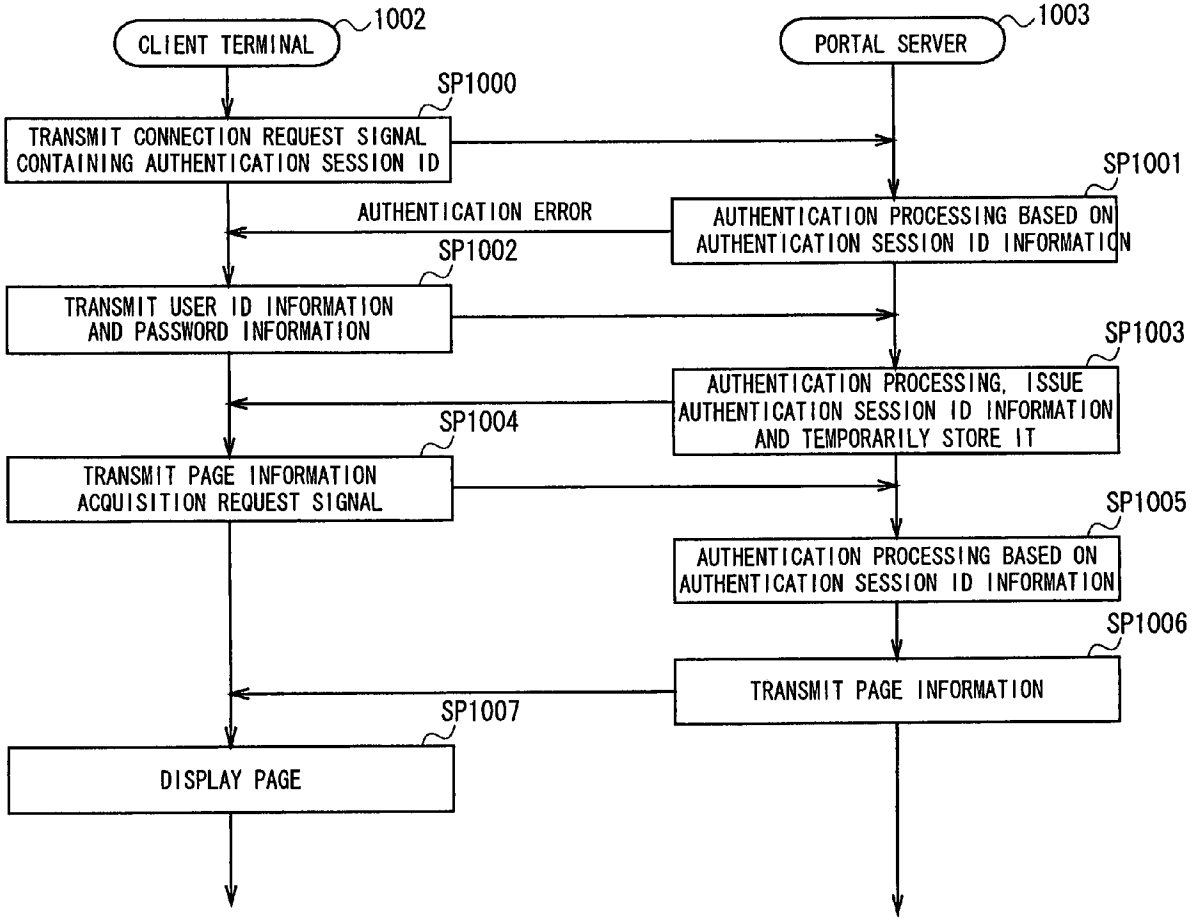
FIG. 21 is a sequence chart showing a user authentication process between the client terminal and the portal server.

With reference to FIG. 21, the following describes a user authentication process performed between the client terminal 1002 and the portal server 1003.

The user of the client terminal 1002 contracts with the service provider of the music related service provision system 1000. For example, the user performs an operation to turn on the client terminal 1002. Alternatively, the user presses a specific operation button on the operation input section 1020. In response to such operation, the operation input section 1020 recognizes an operation input signal. The input processing section 1021 converts this signal into an operation command. The control section 1023 is supplied with this command and starts an authentication request process.

After starting the authentication request process, the control section 1023, at step SP1000, generates a connection request signal containing the authentication session ID information and the like temporarily stored in the authentication information storage section 1038. The control section 1023 sends the generated connection request signal to the portal server 1003 via the communication control section 1032 and the network interface 1033 in order.

The client terminal 1002 establishes a communication connection with the portal server 1003 to perform various processes such as the user authentication process. Each time this communication connection is established, the portal server 1003 issues the authentication session ID information as identification information to identify respective communication connection states (i.e., sessions).

For the use with the user authentication process and the like, the authentication session ID information is assigned with a specified valid period (e.g., approximately one minute) with reference to the time of issuance from the portal server 1003.

The client terminal 1002 acquires the authentication session ID information from the portal server 1003. There may be a case where the client terminal 1002 cannot supply the authentication session ID information to the portal server 1003 within the valid period. In such case, the portal server 1003 determines cancellation of the communication connection state specified by the authentication session ID information.

In this manner, the portal server 1003 prevents the previously issued authentication session ID information from being falsely used by a user not contracted with the service provider of the music-related service provision system 1000.

The authentication information storage section 1038 temporarily stores the authentication session ID information. This authentication session ID information was issued by the portal server 1003 that established communication connection with the client terminal 1002 to perform the user authentication process and the like.

The client terminal 1002 sends a connection request signal. In response to this, at step SP1001, the control section 1050 of the portal server 1003 receives the connection request signal via the network interface 1053 and the communication control section 1052 in order. The received connection request signal contains the authentication session ID information and the like. The control section 1050 sends the authentication session ID information and the like to the authentication processing section 1056.

Under the control of the control section 1050, the authentication processing section 1056 performs the user authentication process based on the authentication session ID information and the like received as the connection request signal from the client terminal 1002.

As a result, the authentication processing section 1056 may not be able to authenticate the user of the client terminal 1002 to be a registered user due to expiration of the valid period specified in the authentication session ID information and the like received from the client terminal 1002. In such case, the control section 1050 sends the authentication error information indicating an authentication error to the client terminal 1002 via the communication control section 1052 and the network interface 1053 in order.

At step SP1002, the control section 1023 of the client terminal 1002 receives the authentication error information sent from the portal server 1003 via the network interface 1033 and the communication control section 1032 in order. In response to this, the control section 1023 reads the user ID information, the password information, and the like stored in the authentication information storage section 1038. The control section 1023 sends the read user ID information, password information, and the like to the portal server 1003 via the communication control section 1032 and the network interface 1033 in order.

At step SP1003, the control section 1050 of the portal server 1003 receives the user ID information, the password information, and the like sent from the client terminal 1002 via the network interface 1053 and the communication control section 1052 in order. The control section 1050 sends these pieces of information to the authentication processing section 1056.

Under the control of the control section 1050, the authentication processing section 1056 performs the user authentication process. Specifically, the authentication processing section 1056 checks if the received user ID information, password information, and the like are included in the customer information registered to the customer database section 1054.

As a result, the authentication processing section 1056 may authenticate the user of the client terminal 1002 to be a registered user. In this case, under the control of the control section 1050, the authentication processing section 1056 issues the portal authentication result information, i.e., the authentication session ID information and the like about communication connection state between the client terminal 1002 and the portal server 1003 at this time. In addition, the authentication processing section 1056 temporarily stores the authentication session ID information and the like in the authentication information storage section 1057.

After the authentication processing section 1056 issued the authentication session ID information and the like to the client terminal 1002, the control section 1050 sends these pieces of information to the client terminal 1002 via the communication control section 1052 and the network interface 1053 in order.

At step SP1004, the control section 1023 of the client terminal 1002 receives the authentication session ID information and the like sent from the portal server 1003 via the network interface 1033 and the communication control section 1032 in order. The control section 1023 then sends the received authentication session ID information and the like to the authentication processing section 1037.

Under the control of the control section 1023, the authentication processing section 1037 temporarily stores the received authentication session ID information and the like in the authentication information storage section 1038.

The control section 1023 sends the page information acquisition request signal to request the-portal server 1003 for the page information. At this time, the control section 1023 also sends the authentication session ID information and the like temporarily stored in the authentication information storage section 1038 to the portal server 1003 via the communication control section 1032 and the network interface 1033 in order.

At step SP1005, the control section 1050 of the portal server 1003 receives the-page information acquisition request signal, the authentication session ID information, and the like sent from the client terminal 1002 via the network interface 1053 and the communication control section 1052 in order. The control section 1050 sends the received authentication session ID information and the like to the authentication processing section 1056.

Under the control of the control section 1050, the authentication processing section 1056 performs the user authentication process. Specifically, the authentication processing section 1056 compares the received authentication session ID information and the like with the authentication session ID information and the like that were issued to the client terminal 1002 at the above-mentioned step SP1003 and were temporarily stored in the authentication information storage section 1057.

As a result, at step SP1006, the authentication processing section 1056 authenticates the user of the client terminal 1002 as a registered user. The authentication processing section 1056 determines that the terminal 1002 issued the valid acquisition request for the page information. The authentication processing section 1056 extends the valid period for the authentication session ID information and the like issued to the client terminal 1002.

At this time, the control section 1050 reads the user-requested page information from the page information storage section 1055. The control section 1050 sends the read page information, the authentication session ID information, and the like to the client terminal 1002 via the communication control section 1052 and the network interface 1053 in order. At this time, the authentication session ID information and the like are assigned with the valid period extended by the authentication processing section 1056.

At step SP1007, the control section 1023 of the client terminal 1002 receives the page information sent from the portal server 1003 and the authentication session ID information with the extended valid period and the like via the network interface 1033 and the communication control section 1032 in order. The control section 1023 sends the-received page information to the page information generation section 1036 and sends the authentication session ID information with the extended valid period and the like to the authentication processing section 1037.

Based on the page information supplied from the control section 1023, the page information generation section 1036 generates video data of the page embedded with links to the music data delivery server 1004, the trade server 1005, and the radio broadcast information delivery server 1006. The page information generation section 1036 sends the generated video data to the display control section 1024.

The display control section 1024 applies a digital-analog conversion process to the video data supplied from the page information generation section 1036. The display control section 1024 then sends the converted analog video signal to the display section 1025. As a result, the display section 1025 displays the page of the portal server 1003 as a video based on the analog video signal.

The authentication processing section 1037 updates the authentication session ID information and the like temporarily stored at the above-mentioned step SP1004 to the authentication session ID information with the extended valid period and the like as follows. Under the control of the control section 1023, the authentication processing section 1037 temporarily stores the authentication session ID information with the extended valid period and the like received from the portal server 1003 in the authentication information storage section 1038 so as to overwrite the authentication session ID information having the valid period not extended and the like.

(1-7-2) User Authentication Process between Client Terminal 1002 and each of Servers 1004 through 1006

Figure 22:
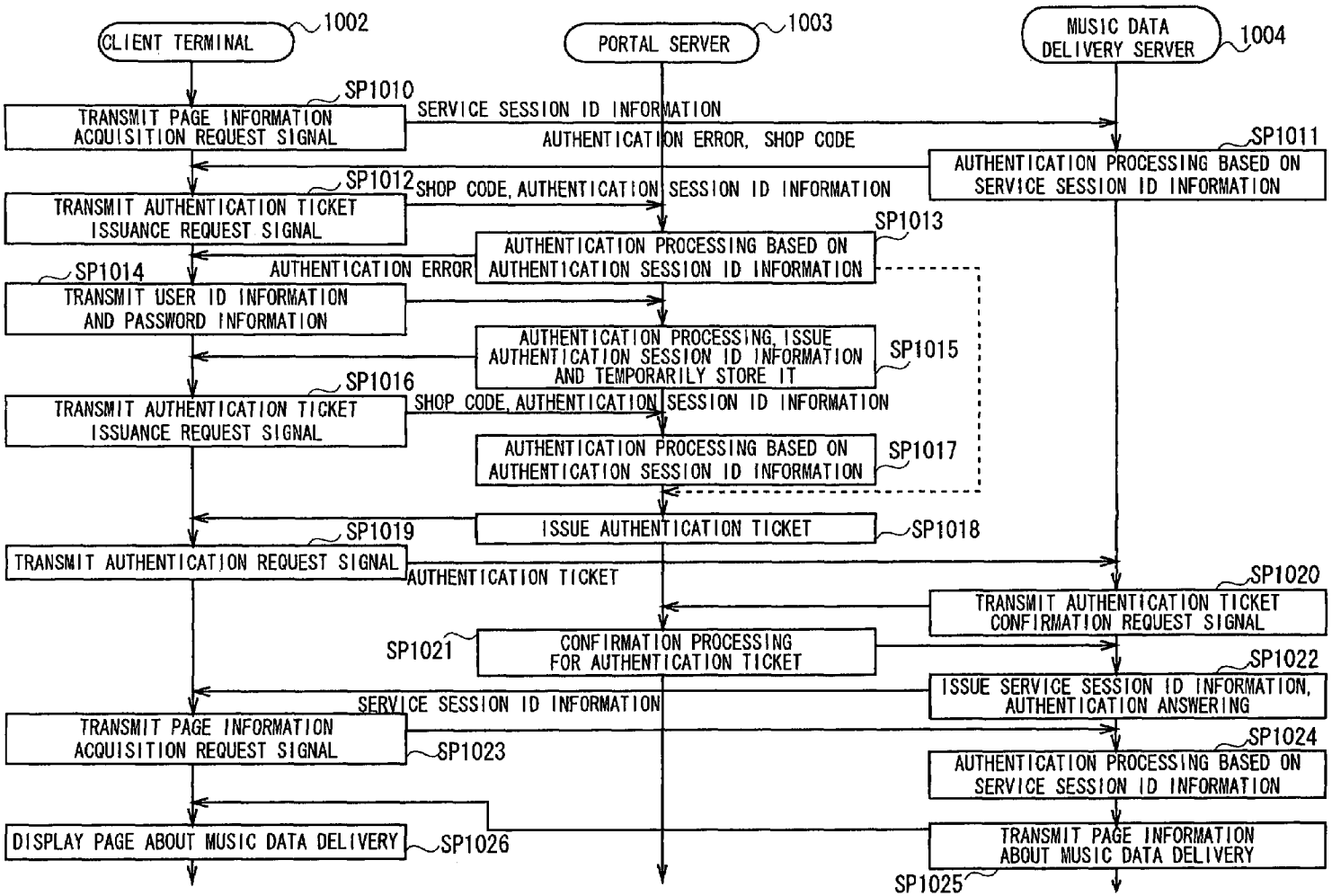
FIG. 22 is a sequence chart showing a user authentication process between the client terminal and the music data delivery server.

With reference to FIG. 22, the following describes the user authentication process performed between the client terminal 1002 and each of the music data delivery server 1004, the trade server 1005, and the radio broadcast information delivery server 1006.

As an example of the user authentication process, the client terminal 1002 once acquires the page information from the portal server 1003 as mentioned above with reference to FIG. 21. The page information contains links for access to the music data delivery server 1004, the trade server 1005, and the radio broadcast information delivery server 1006 to perform the user authentication process. This user authentication process is hereinafter referred to as an indirect access authentication process.

As another example of the user authentication process, the client terminal 1002 does not acquire the page information from the portal server 1003. Instead, previously "bookmarked" URL information and the like are used for direct access to the music data delivery server 1004, the trade server 1005, and the radio broadcast information delivery server 1006. This user authentication process is hereafter referred to as a direct access authentication process.

The indirect access authentication process can be performed just the same in any combinations of the client terminal 1002 and the music data delivery server 1004, the trade server 1005, and the radio broadcast information delivery server 1006.

The direct access authentication process can be also performed just the same in any combinations of the client terminal 1002 and the music data delivery server 1004, the trade server 1005, and the radio broadcast information delivery server 1006.

The indirect access authentication process differs from the direct access authentication process only as to a manner of acquiring URL information used by the client terminal 1002 for access to the music data delivery server 1004, the trade server 1005, and the radio broadcast information delivery server 1006. After the URL information is acquired, the indirect access authentication process and the direct access authentication process can be performed just the same.

In the following description, the music data delivery server 1004 represents an access destination of the client terminal 1002 for simplicity. Further, the indirect access authentication process and the direct access authentication process are described as one user authentication process.

At step SP1010, the control section 1023 of the client terminal 1002 follows the URL information embedded as links in the page information or the URL information and the like already registered as bookmarks. The control section 1023 transmits the service session ID information and the like read from the authentication information storage section 1038 as well as a page information acquisition request signal to the music data delivery server 1004 via the communication control section 1032 and the network interface 1033 in order. The page information acquisition request signal requests to acquire the page information about music data delivery pages. The page information concerns package media sales pages and on-air-list information delivery pages for the trade server 1005 and the radio broadcast information delivery server 1006.

The client terminal 1002 establishes a communication connection with the music data delivery server 1004, the trade server 1005, and the radio broadcast information delivery server 1006 to perform various processes such as the user authentication process. Each time this communication connection is established, the music data delivery server 1004, the trade server 1005, and the radio broadcast information delivery server 1006 accessed by the client terminal 1002 issue the service session ID information as identification information to identify respective communication connection states (i.e., sessions).

For the use with the user authentication process and the like, the service session ID information, like the authentication session ID information, is assigned with a specified valid period (e.g., approximately one minute) with reference to the time of issuance from the music data delivery server 1004, the trade server 1005, and the radio broadcast information delivery server 1006.

The client terminal 1002 acquires the service session ID information from the servers 1004 through 1006. There may be a case where the client terminal 1002 cannot supply the service session ID information to the information-issuing servers such as the music data delivery server 1004, the trade server 1005, and the radio broadcast information delivery server 1006 within the valid period. In such case, the information-issuing'servers such as the music data delivery server 1004, the trade server 1005, and the radio broadcast information delivery server 1006 determine cancellation of the communication connection state specified by the service session ID information.

In this manner, the music data delivery server 1004, the trade server 1005, and the radio broadcast information delivery server 1006 prevent the previously issued service session ID information from being falsely used by a user not contracted with the service provider of the music related service provision system 1000.

The authentication information storage section 1038 temporarily stores the service session ID information. This service session ID information was issued by the music data delivery server 1004, the trade server 1005, and the radio broadcast information delivery server 1006 that established communication connection with the client-terminal 1002 to perform the user authentication process and the like.

At step SP1011, the control section 1070 of the music data delivery server 1004 receives the page information acquisition request signal, the service session ID information, and the like transmitted from the client terminal 1002 via the network interface 1073 and the communication control section 1072 in order. The control section 1070 transmits the received service session ID information and the like to the authentication processing section 1075.

Under the control of the control section 1070, the authentication processing section 1075 performs the user authentication process. Specifically, the authentication processing section 1075 compares the received service session ID information and the like with the service session ID information and the like temporarily stored in the authentication information storage section 1077.

As a result, the authentication processing section 1075 may not be able to authenticate the user of the client terminal 1002 to be a registered user, e.g., due to expiration of the valid period for the service session ID information received from the client terminal 1002. In such case, the authentication processing section 1075 determines that the client terminal 1002 issued an invalid acquisition request for the page information about the music data delivery page.

In this case, the control section 1070 transmits authentication error information and a shop code to the client terminal 1002 via the communication control section 1072 and the network interface 1073 in order. The authentication error information indicates an authentication error. The shop code is provided to identify the music data delivery server 1004.

At step SP1012, the control section 1023 of the client terminal 1002 receives the authentication error information and the shop code transmitted from the music data delivery server 1004 via the network interface 1033 and the communication control section 1032 in order. According to the received authentication error information, the control section 1023 determines that the music data delivery server 1004 does not authenticate the user as a registered user. In addition, the control section 1023 temporarily stores the shop code received from the music data delivery server 1004 in the authentication information storage section 1038.

The control section 1023 generates an authentication ticket issuance request signal that requests the portal server 1003 to issue an authentication ticket for access to the music data delivery server 1004. The control section 1023 then transmits the generated authentication ticket issuance request signal, the shop code of the music data delivery server 1004, the authentication session ID information, and the like to the portal server 1003 via the communication control section 1032 and the network interface 1033 in order. It should be noted that the authentication session ID information and the like are already received from the portal server 1003 and are temporarily stored in the authentication information storage section 1038.

At step SP1013, the control section 1050 of the portal server 1003 receives the authentication ticket issuance request signal, the shop code, the authentication session ID information, and the like sent from the client terminal 1002 via the network interface 1053 and the communication control section 1052 in order. The control section 1050 then sends these pieces of information to the authentication processing section 1056.

Under the control of the control section 1050, the authentication processing section 1056 performs the user authentication process. Specifically, the control section 1056 compares the authentication session ID information and the like with the authentication session ID information and the like temporarily stored in the authentication information storage section 1057.

As a result, the authentication processing section 1056 may not be able to authenticate the user of the client terminal 1002 to be a registered user, e.g., due to expiration of the valid period for the authentication session ID information received from the client terminal 1002. In such case, the authentication processing section 1056 determines that the client terminal 1002 issued an invalid acquisition request for the authentication ticket.

In this case, the control section 1050 sends authentication error information indicating an authentication error to the client terminal 1002 via the communication control section 1052 and the network interface 1053 in order.

By contrast, there may be a case where the valid period still takes effect for the authentication session ID information received from the client terminal 1002. In such case, the authentication processing section 1056 authenticates the user of the client terminal 1002 to be a registered user. The authentication processing section 1056 determines that the client terminal 1002 issues a valid request for the authentication ticket. In this case, the control section 1050 moves to step SP1018 to be described later.

At step SP1014, the control section 1023 of the client terminal 1002 receives the authentication error information sent from the portal server 1003 via the network interface 1033 and the communication control section 1032 in order. The control section 1023 then reads the user ID information, the password information, and the like stored in the authentication information storage section 1038. In addition, the control section 1023 sends the read user ID information, the password information, and the like to the portal server 1003 via the communication control section 1032 and the network interface 1033 in order.

At step SP1015, the control section 1050 of the portal server 1003 receives the user ID information, the password information, and the like sent from the client terminal 1002 via the network interface 1053 and the communication control section 1052 in order. The control section 1050 then sends these pieces of information to the authentication processing section 1056.

Under the control of the control section 1050, the authentication processing section 1056 performs the user authentication process. Specifically, the authentication processing section 1056 checks whether or not the customer information registered to the customer database section 1054 contains the received user ID information, the password information, and the like.

As a result, the authentication processing section 1056 authenticates the user of the client terminal 1002 to be a registered user. Under the control of the control section 1050, the authentication processing section 1056 issues the portal authentication result information, i.e., the authentication session ID information and the like about the state of communication connection between the client terminal 1002 and the portal server 1003 at the present time. The authentication processing section 1056 temporarily stores the issued authentication session ID information and the like in the authentication information'storage section 1057.

After the authentication processing section 1056 issues the authentication session ID information and the like to the client terminal 1002, the control section 1050 sends the authentication session ID information and the like to the client terminal 1002 via the communication control section 1052 and the network interface 1053 in order.

At step SP1016, the control section 1023 of the client terminal 1002 receives the authentication session ID information and the like sent from the portal server 1003 via the network interface 1033 and the communication control section 1032 in order. The authentication processing section 1037 temporarily stores the received authentication session ID information and the like in the authentication information storage section 1038.

The control section 1023 generates an authentication ticket issuance request signal that re-requests the portal server 1003 to issue an authentication ticket. The control section 1023 sends the generated authentication ticket issuance request signal as well as the shop code temporarily stored in the authentication information storage section 1038 and the authentication session ID information and the like temporarily stored at this time to the portal server 1003 via the communication control section 1032 and the network interface 1033 in order.

According to the embodiment, the client terminal 1002 temporarily stores the shop code in the authentication information storage section 1038. The present invention is not limited thereto. When performing the process at steps SP1012 through SP1016, the client terminal 1002 can sequentially exchange the shop code with the portal server 1003. In this manner, the client terminal 1002 need not temporarily store the shop code in the authentication information storage section 1038. Nevertheless, it is possible to send the shop code to the portal server 1003 at step SP1016.

At step SP1017, the control section 1050 of the portal server 1003 receives the authentication ticket issuance request signal, the shop code, the authentication session ID information, and the like sent from the client terminal 1002 via the network interface 1053 and the communication control section 1052 in order. The control section 1050 sends the received authentication ticket issuance request signal and the like to the authentication processing section 1056.

Under the control of the control section 1050, the authentication processing section 1056 performs the user authentication process. Specifically, the authentication processing section 1056 compares the received authentication session ID information and the like with the authentication session ID information and the like temporarily stored in the authentication information storage section 1057.

As a result, there may be a case where the valid period still takes effect for the authentication session ID information and the like received from the client terminal 1002. In such case, the authentication processing section 1056 authenticates the user of the client terminal 1002 to be a registered user. The authentication processing section 1056 determines that the client terminal 1002 issues a valid request for the authentication ticket.

And the control section 1050 proceeds to next step SP 1018, when the authentication processing section 1056 authenticates that the user of the client terminal 1002 is legitimate.

At step SP1018, under the control of the control section 1050, based on the shop code and the authentication ticket issuance request signal received from the client terminal 1002 at the above-mentioned step SP1017. The authentication processing section 1056 issues the portal authentication result information, i.e., an authentication ticket and the like to enable access to the music data delivery server 1004 indicated by the shop code.

Under the control of the control section 1050, the authentication processing section 1056 temporarily stores the issued authentication ticket and the like in the authentication information storage section 1057. In addition, the authentication processing section 1056 extends the valid period for the authentication session ID information and the like issued to the client terminal 1002.

That is to say, the authentication processing section 1056 has issued the authentication ticket and the like and extended the valid period of the authentication session ID information and the like. Thereafter, the control section 1050 sends these authentication ticket and the like and authentication session ID information and the like to the client terminal 1002 via the communication control section 1052 and the network interface 1053 in order.

At step SP1019, the control section 1023 of the client terminal 1002 receives the authentication ticket and the like sent from the portal server 1003 and the authentication session ID information with the extended valid period via the network interface 1033 and the communication control section 1032 in order. The control section 1023 sends the received authentication session ID information to the authentication processing section 1037.

The control section 1023 sends the authentication-ticket and the like received from the portal server 1003 together with the authentication request signal to the music data delivery server 1004 via the communication control section 1032 and the network interface 1033 in order.

At this time, under the control of the control section 1023, the authentication processing section 1037 temporarily stores the authentication session ID information having the extended valid period received from the portal server 1003 in the authentication information storage section 1038 so as to overwrite the authentication session ID information having the valid period not extended. In this manner, the authentication processing section 1037 updates the authentication session ID information temporarily stored at the above-mentioned step SP1616 to the authentication session ID information having the extended valid period.

At step SP1020, the control section 1070 of the music data delivery server 1004 receives the authentication request signal, the authentication ticket, and the like transmitted from the client terminal 1002 via the network interface 1073 and the communication control section 1072 in order.

The control section 1070 transmits the authentication ticket and the like received from the client terminal 1002 together with an authentication ticket confirmation request signal for requesting confirmation of the authentication ticket and the like to the portal-server 1003 via the communication control section 1072 and the network interface 1073 in order.

At step SP1021, the control section 1050 of the portal server 1003 receives the authentication ticket confirmation request signal, the authentication ticket, and the like transmitted from the music data delivery server 1004 via the network interface 1053 and the communication control section 1052 in order. The control section 1050 then transmits the received authentication ticket confirmation request signal, the authentication ticket, and the like to the authentication processing section 1056.

Under the control of the control section 1050, the authentication processing section 1056 performs a confirmation process for the authentication ticket received from the music data delivery server 1004 in response to the authentication ticket confirmation request signal. Specifically, the authentication processing section 1056 compares the received authentication ticket and the like with the authentication ticket and the like temporarily stored in the authentication information storage section 1057.

As a result, the authentication processing section 1056 confirms that the genuine authentication ticket and the like are received from the music data delivery server 1004. In this case, the control section 1050 transmits confirmation result information to the music data delivery server 1004 via the communication control section 1052 and the network interface 1053 in order. The confirmation result information indicates that the received authentication ticket and the like are confirmed to be genuine.

At step SP1022, the control section 1070 of the music data delivery server 1004 receives the confirmation result information transmitted from the portal server 1003 via the network interface 1073 and the communication control section 1072 in order. The control section 1070 transmits the received confirmation result information to the authentication processing section 1075.

Under control of the control section 1070, the authentication processing section 1075 responds to the confirmation result information and issues server authentication result information, i.e., service session ID information and the like about the state of communication connection between the client terminal 1002 and the music data delivery server 1004 at the present time. In addition, the authentication processing section 1075 temporarily stores the issued service session ID information and the like in the authentication information storage section 1077.

After the authentication processing section 1075 issued the service session ID information and the like to the client terminal 1002, the control section 1070 transmits these pieces of information to the client terminal 1002 via the communication control section 1072 and the network interface 1073 in order.

At step SP1023, the control section 1023 of the client terminal 1002 receives the service session ID information and the like sent from the music data delivery server 1004 via the network interface 1033 and the communication control section 1032 in order. The authentication processing section 1037 temporarily stores the received service session ID information and the like in the authentication information storage section 1038.

The control section 1023 transmits the page information acquisition request signal, the service session ID information, and the like to the music data delivery server 1004 via the communication control section 1032 and the network interface 1033 in order. The page information acquisition request signal requests the page information about the music data delivery page. The service session ID information is temporarily stored in the authentication information storage section 1038.

As step SP1024, the control section 1070 of the music data delivery server 1004 receives the page information acquisition request signal, the service session ID information, and the like transmitted from the client terminal 1002 via the network interface 1073 and the communication control section 1072 in order. The control section 1070 then transmits the received service session ID information and the like to the authentication processing section 1075.

Under the control of the control section 1070, the authentication processing section 1075 performs the user authentication process. Specifically, the control section 1070 compares the received service session ID information and the like with the service session ID information and the like that are already issued to the client terminal 1002 at the above-mentioned step SP1022 and are temporarily stored in the authentication information storage section 1077.

As a result, there may be a case where the valid period still takes effect for the service session ID information and the like received from the client terminal 1002. In such case, the authentication processing section 1075 authenticates the user of the client terminal 1002 to be a registered user. The authentication processing section 1075 determines that the client terminal 1002 issues a valid request to acquire the page information about the music data delivery page.

The control section 1070 then proceeds to the next step SP1025. At step SP1025, the control section 1070 reads the page information about the user-requested music data delivery page from the page information storage section 1076. In addition, the control section 1070 allows the authentication processing section 1075 to extend the valid period for the service session ID information and the like issued to the client terminal 1002.

The control section 1070 transmits the page information about the music data delivery page read from the page information storage section 1076 together with the service session ID information and the like to the client terminal 1002 via the communication control section 1072 and the network interface 1073 in order. The service session ID information and the like have the valid period extended by the authentication processing section 1075.

At step SP1026, the control section 1023 of the client terminal 1002 receives the page information about the music data delivery page, the service session ID information having the extended valid period, and the like from the music data delivery server 1004 via the network interface 1033 and the communication control section 1032 in order. The control section 1023 transmits the page information about the received music data delivery page to the page information generation section 1036. In addition, the control section 1023 transmits the received service session ID information and the like to the authentication processing section 1037.

Under the control of the control section 1023, the authentication processing section 1037 temporarily stores the received service session ID information having the extended valid period and the like in the authentication information storage section 1038 so as to overwrite the service session ID information and the like before extension of the valid period. In this manner, the authentication processing section 1037 updates the service session ID information and the like temporarily stored at the above-mentioned step SP1023 to the service session ID information having the extended valid period and the like.

Further, the page information generation section 1036 generates video data based on the page information about the music data delivery page. The page information generation section 1036 transmits the generated video data to the display control section 1024.

The display control section 1024 applies a digital-analog conversion process to the video data supplied from the page information generation section 1036. The display control section 1024 then transmits the obtained analog video signal to the display section 1025. As a result, the display section 1025 displays the music data delivery page as a video based on the analog video signal.

(1-7-3) Music Related Service Provision Processes

With reference to FIGS. 23 through 26, the following describes music related service provision processes. These processes occur after completion of the user authentication process performed between the client terminal 1002 and each of the music data delivery server 1004, the trade server 1005, and the radio broadcast information delivery server 1006 as mentioned above with reference to FIG. 22. During a music related service provision process, the client terminal 1002 uses page information about music data delivery pages, package media sales pages, and on-air-list information delivery pages. The client terminal 1002 acquired the page information during the user authentication process from the music data delivery server 1004, the trade server 1005, and the radio broadcast information delivery server 1006. Using that page information and the like, the client terminal 1002 is provided with music data delivery services, trade services, and radio broadcast information delivery services.

(1-7-3-1) Music Data Delivery Service Provision Process

Figure 23:
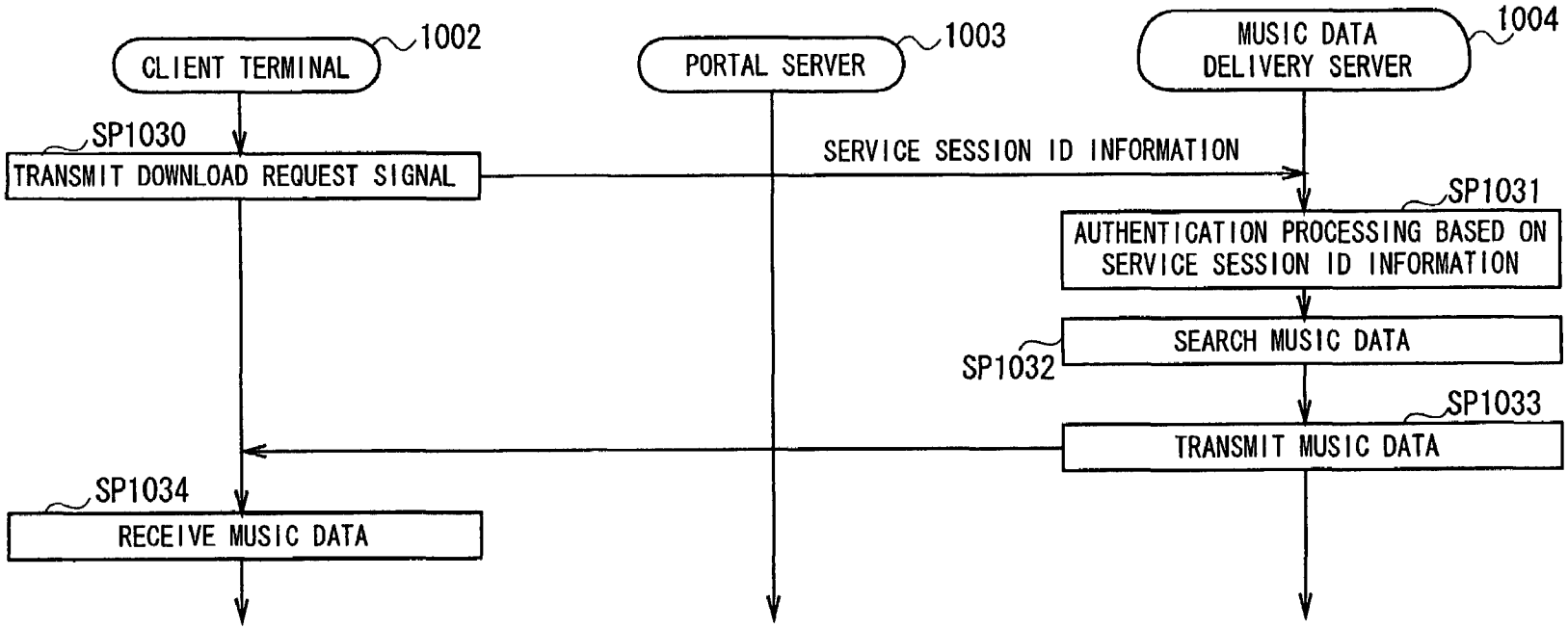
FIG. 23 is a sequence chart showing a music data delivery service provision process.

With reference to FIG. 23, the following describes a music data delivery service provision process. During this process, the client terminal 1002 is provided with music data delivery services from the music data delivery server 1004.

For example, the user uses the input processing section 1021 to enter a control command to select part of the music data delivery page displayed as video on the display section 1025. At step SP1030, the control section 1023 of the client terminal 1002 responds to the entered control command to generate a download request signal that requests to download music data intended for download.

The control section 1023 transmits the download request signal together with service session ID information and the like to the music data delivery server 1004 via the communication control section 1032 and the network interface 1033 in order. The service session ID information and the like are already issued by the music data delivery server 1004 and are temporarily stored in the authentication information storage section 1038.

At step SP1031, the control section 1070 of the music data delivery server 1004 receives the download request signal, the service session ID information, and the like transmitted from the client terminal 1002 via the network interface 1073 and the communication control section 1072 in order. The control section 1070 then transmits the received service session ID information and the like to the authentication processing section 1075.

Under the control of the control section 1070, the authentication processing section 1075 performs the user authentication process. Specifically, the authentication processing section 1075 compares the received service session ID information and the like with the service session ID information and the like temporarily stored in the authentication information storage section 1077.

As a result, the authentication processing section 1075 may authenticate the user to be a registered user who requested to download the music data using the client terminal 1002. In this case, the control section 1070 proceeds to the next step SP1032.

At step SP1032, based on the retrieval key stored in the download request signal, the retrieval section 1079 searches a plurality of pieces of music data in the music data storage section 1078 for music data intended for download, i.e., one matching a retrieval condition indicated by the retrieval key.

Let us assume that the retrieval section 1079 retrieves the music data. The control section 1070 allows the authentication processing section 1075 to extend the valid period for the service session ID information and the like issued to the client terminal 1002. The control section 1070 then proceeds to the next step SP1033.

At step SP1033, the control section 1070 reads the music data intended for download retrieved by the retrieval section 1079 from the music data storage section 1078. In addition, the control section 1070 transmits the read music data intended for download together with the service session ID information and the like to the client terminal 1002 via the communication control section 1072 and the network interface 1073 in order. At this time, the service session ID information has the valid period extended by the authentication processing section 1075.

At step SP1034, the control section 1023,of the client terminal 1002 receives the music data intended for download transmitted from the music data delivery server 1004, the service session ID information having the extended valid period, and the like via the network interface 1033 and the communication control section 1032 in order. The control section 1023 stores the received music data in the storage medium 1029. In addition, the control section 1023 transmits the received service session ID information and the like to the authentication processing section 1037.

Under the control of the control section 1023, the authentication processing section 1037 temporarily stores the received service session ID information having the extended valid period and the like in the authentication information storage section 1038 so as to overwrite the service session ID information and the like before extension of the valid period. In this manner, the authentication processing section 1037 updates the contents of the service session ID information and the like temporarily stored in the authentication information storage section 1038.

In this manner, the client terminal 1002 can download user-specified music data using the music data delivery service provided from the music data delivery server 1004.

(1-7-3-2) Trade Service Provision Process

Figure 24:
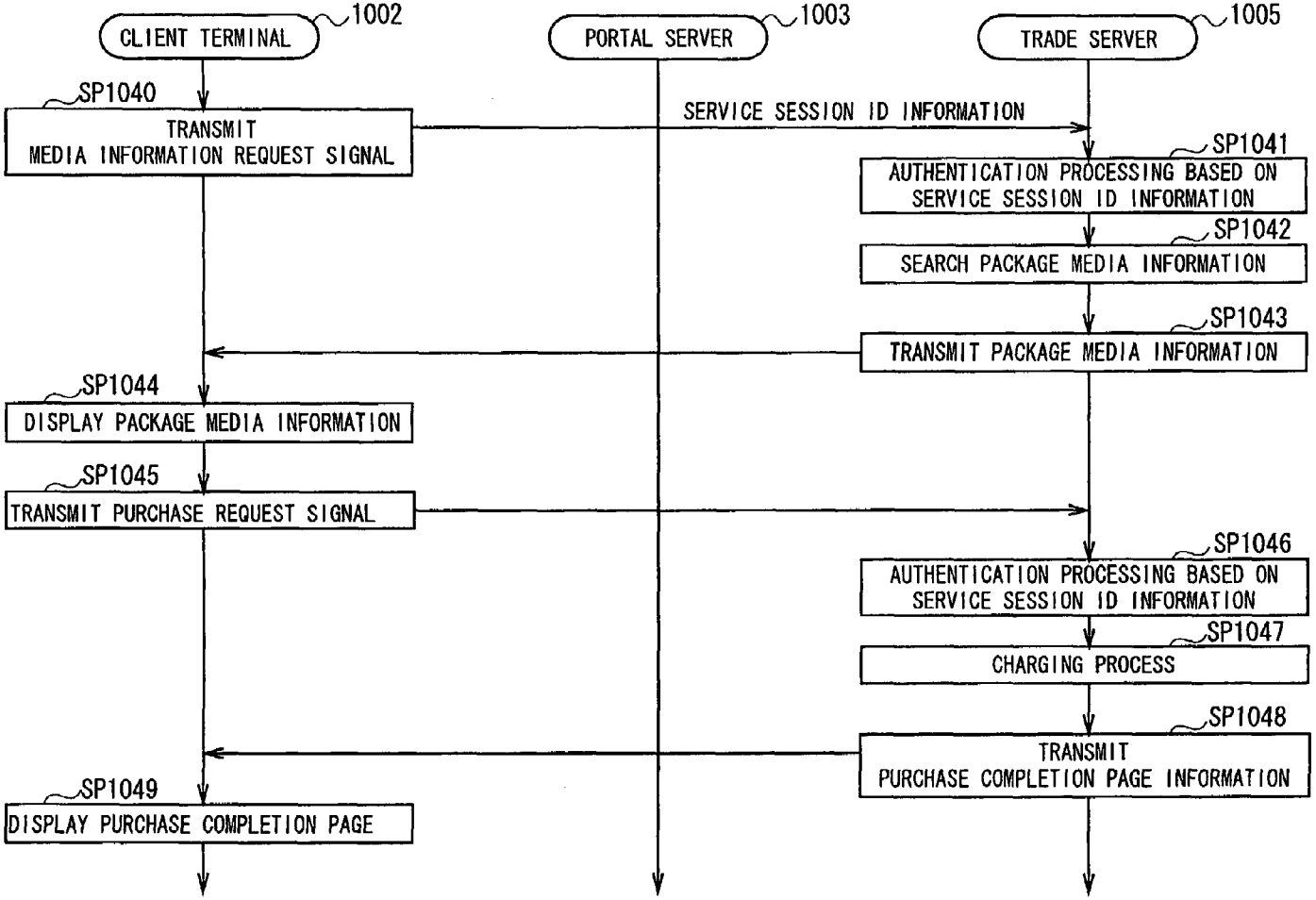
FIG. 24 is a sequence chart showing a trade service provision process.

With reference to FIG. 24, the following describes a trade service provision process during which the client terminal 1002 is provided with trade services from the trade server 1005.

For example, the user uses the input processing section 1021 to enter a control command to select part of the package media sales page displayed as video on the display section 1025. At step SP1040, the control section 1023 of the client terminal 1002 generates a media information request signal that requests package media information about a specific package media corresponding to the entered control command.

The control section 1023 transmits the media information request signal together with service session ID information and the like to the trade server 1005 via the communication control section 1032 and the network interface 1033 in order. The service session ID information and the like are already issued by the trade server 1005 and are temporarily stored in the authentication information storage section 1038.

At step SP1041, the control section 1090 of the trade server 1005 receives the media information request signal, the service session ID information, and the like transmitted from the client terminal 1002 via the network interface 1093 and the communication control section 1092 in order. The control section 1090 then transmits the received service session ID information and the like to the authentication processing section 1095.

Under the control of the control section 1090, the authentication processing section 1095 performs the user authentication process. Specifically, the authentication processing section 1095 compares the received service session ID information and the like with the service session ID information and the like temporarily stored in the authentication information storage section 1097.

As a result, the authentication processing section 1095 may authenticate the user to be a registered user who requested the package media information about the package media using the client terminal 1002. In this case, the control section 1090 proceeds to the next step SP1042.

At step SP1042, based on the retrieval key stored in the media information request signal, the retrieval section 1099 searches a plurality of pieces of package media information in the package media information storage section 1098 for package media information about the specific package media, i.e., one matching a retrieval condition indicated by the retrieval key.

Let us assume that the retrieval section 1099 retrieves the package media information. The control section 1090 allows the authentication processing section 1095 to extend the valid period for the service session ID information and the like issued to the client terminal 1002. The control section 1090 then proceeds to the next step SP1043.

At step SP1043, the control section 1090 reads the package media information retrieved by the retrieval section 1099 from the package media information storage section 1098. In addition, the control section 1090 transmits the read package media information together with the service session ID information and the like to the client terminal 1002 via the communication control section 1092 and the network interface 1093 in order. At this time, the service session ID information has the valid period extended by the authentication processing section 1095.

At step SP1044, the control section 1023 of the client terminal 1002 receives the package media information transmitted from the trade server 1005, the service session ID information having the extended valid period, and the like via the network interface 1033 and the communication control section 1032 in order. The control section 1023 transmits the received package media information to the page information generation section 1036. In addition, the control section 1023 transmits the received service session ID information and the like to the authentication processing section 1037.

Under the control of the control section 1023, the authentication processing section 1037 temporarily stores the received service session ID information having the extended valid period and the like in the authentication information storage section 1038 so as to overwrite the service session ID information and the like before extension of the valid period. In this manner, the authentication processing section 1037 updates the contents of the service session ID information and the like temporarily stored in the authentication information storage section 1038.

The page information generation section 1036 generates video data based on the package media information supplied from the control section 1023. The display control section 1024 converts the generated video data into an analog video signal and transmits it to the display section 1025.

In this manner, the control section 1023 allows the display section 1025 to display the package media information as a video based on the analog video signal. The control section 1023 then proceeds to the next step SP1045.

Let us assume that the user uses the input processing section 1021 to enter a control command to request to purchase a package media corresponding to the package media information displayed as video on the display section 1025. At step SP1045, the control section 1023 responds to the entered control command and generates a purchase request signal to request to purchase the package media.

The control section 1023 transmits the purchase request signal together with service session ID information (i.e., having the extended valid period) and the like to the trade server 1005 via the communication control section 1032 and the network interface 1033 in order. The service session ID information and the like are already received from the trade server 1005 and are temporarily stored in the authentication information storage section 1038.

At step SP1046, the control section 1090 of the trade server 1005 receives the purchase request signal, the service session ID information, and the like transmitted from the client terminal 1002 via the network interface 1093 and the communication control section 1092 in order. The control section 1090 then transmits the received service session ID information and the like to the authentication processing section 1095.

Under the control of the control section 1090, the authentication processing section 1095 performs the user authentication process. Specifically, the authentication processing section 1095 compares the received service session ID information and the like with the service session ID information and the like temporarily stored in the authentication information storage section 1097.

As a result, the authentication processing section 1095 may authenticate the user to be a registered user who requested to purchase the package media using the client terminal 1002. In this case, the control section 1090 proceeds to the next step SP1047.

At step SP1047, the control section 1090 performs purchase processes such as shipping the requested package media to the user of the client terminal 1002. The control section 1090 transmits charging information to the charging server 1008 via the communication control section 1092 and the network interface 1093 in order. The charging information is used to charge the user who purchased the package medium. In this manner, the control section 1090 allows the charging server 1008 to perform a charging process corresponding to the user's purchase of the package medium.

Further, the control section 1090 allows the authentication processing section 1090 to extend the valid period of the service session ID information and the like issued to the client terminal 1002.

After terminating the charging process, at step SP1048, the control section 1090 transmits purchase completion information as well as the service session ID information and the like to the client terminal 1002 via the communication control section 1092 and the network interface 1093 in order. At this time, the purchase completion information indicates completion of the package media purchase process. The authentication processing section 1095 has extended the valid period of the service session ID information.

At step SP1049, the control section 1023 of the client terminal 1002 receives the purchase completion information and the service session ID information and the like via the network interface 1033 and the communication control section 1032 in order. The purchase completion information is transmitted from the trade server 1005. The service session ID information has the extended valid period. The control section 1023 then transmits the received purchase completion information to the page information generation section 1036. In addition, the control section 1023 transmits the service session ID information and the like received from the trade server 1005 to the authentication processing section 1037.

Under the control of the control section 1023, the authentication processing section 1037 temporarily stores the received service session ID information having the extended valid period and the like in the authentication information storage section 1038 so as to overwrite the service session ID information and the like before extension of the valid period. In this manner, the authentication processing section 1037 updates the contents of the service session ID information and the like temporarily stored in the authentication information storage section 1038.

Further, the page information generation section 1036 generates video data based on the purchase completion information supplied from the control section 1023. The display control section 1024 converts the generated video data into an analog video signal and transmits it to the display section 1025.

The control section 1023 allows the display section 1025 to display the purchase completion page as a video based on the analog video signal.

In this manner, the client terminal 1002 can allow the user to purchase intended package media using the trade service provided by the trade server 1005.

(1-7-3-3) On-Air-List Information Delivery Service Provision Process

Figure 25:
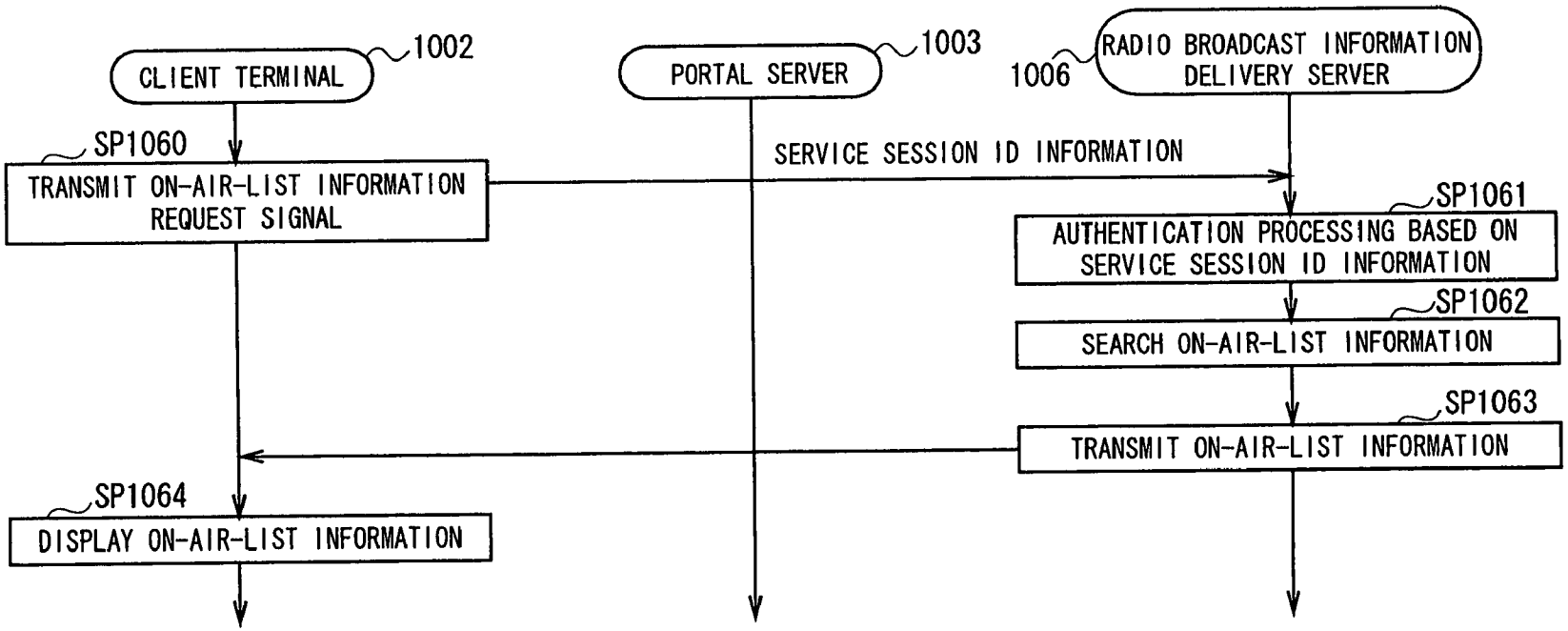
FIG. 25 is a sequence chart showing a radio broadcast information (on-air list information) delivery service provision process (1).

With reference to FIG. 25, the following describes the radio broadcast information delivery service provision process. During this process, the client terminal 1002 is provided with a radio broadcast information delivery service, especially an on-air-list information delivery service from the radio broadcast information delivery server 1006.

For example, the user enters retrieval key to retrieve intended on-air-list information into an input box of the on-air-list information delivery page displayed as a video on the display section 1025. A control command corresponding to a character string indicating the entered retrieval key is input through the input processing section 1021. At step SP1060, the control section 1023 of the client terminal 1002 responds to the entered control command and generates an on-air-list information request signal to request download of the intended on-air-list information.

The control section 1023 sends the on-air-list information request signal together with the service session ID information and the like to the radio broadcast information delivery server 1006 via the communication control section 1032 and the network interface 1033 in order. The service session ID information and the like are already issued by the radio broadcast information delivery server 1006 and are temporarily stored in the authentication information storage section 1038.

At step SP1061, the control section 1110 of the radio broadcast information delivery server 1006 receives the on-air-list information request signal, the service session ID information, and the like sent from the client terminal 1002 via the network interface 1113 and the communication control section 1112 in order. The control section 1110 then sends the received service session ID information and the like to the authentication processing section 1115.

Under the control of the control section 1110, the authentication processing section 1115 performs the user authentication process. Specifically, the authentication processing section 1115 compares the received service session ID information and the like with the service session ID information and the like temporarily stored in the authentication information storage section 1120.

As a result, the authentication processing section 1115 may authenticate the user to be a registered user who requested the on-air-list information using the client terminal 1002. In this case, the control section 1110 proceeds to the next step SP1062.

At step SP1062, based on the retrieval key stored in the on-air-list information request signal, the retrieval section 1118 searches the entire on-air-list information in the on-air-list information storage section 1117 for the targeted on-air-list information within a specified range corresponding to the retrieval condition indicated by the retrieval key.

Let us assume that the retrieval section 1118 retrieves the on-air-list information. The control section 1110 allows the authentication processing section 1115 to extend the valid period for the service session ID information and the like issued to the client terminal 1002. The control section 1110 then proceeds to the next step SP1063.

At step SP1063, the control section 1110 reads the on-air-list information retrieved by the retrieval section 1118 from the on-air-list information storage section 1117. In addition, the control section 1110 sends the read on-air-list information together with the service session ID information and the like to the client terminal 1002 via the communication control section 1112 and the network interface 1113 in order. At this time, the service session ID information has the valid period extended by the authentication processing section 1115.

At step SP1064, the control section 1023 of the client terminal 1002 receives the on-air-list information sent from the radio broadcast information delivery server 1006, the service session ID information having the extended valid period, and the like via the network interface 1033 and the communication control section 1032 in order. The control section 1023 sends the received on-air-list information to the page information generation section 1036. In addition, the control section 1023 sends the service session ID information and the like received from the radio broadcast information delivery server 1006 to the authentication processing section 1037.

Under the control of the control section 1023, the authentication processing section 1037 temporarily stores the received service session ID information having the extended valid period in the authentication information storage section 1038 so as to overwrite the service session ID information having the valid period not extended. In this manner, the authentication processing section 1037 updates the contents of the service session ID information and the like temporarily stored in the authentication information storage section 1038.

The page information generation section 1036 generates video data based on the on-air-list information supplied from the control section 1023. The display control section 1024 converts the generated video data into an analog video signal and sends it to the display section 1025. The display section 1025 displays the on-air-list information as a video based on the analog video signal.

In this manner, the client terminal 1002 can allow the user to acquire intended on-air-list information by using the radio broadcast information delivery service provided by the radio broadcast information delivery server 1006.

(1-7-3-4) Now-On-Air Information Delivery Service Provision Process

Figure 26:
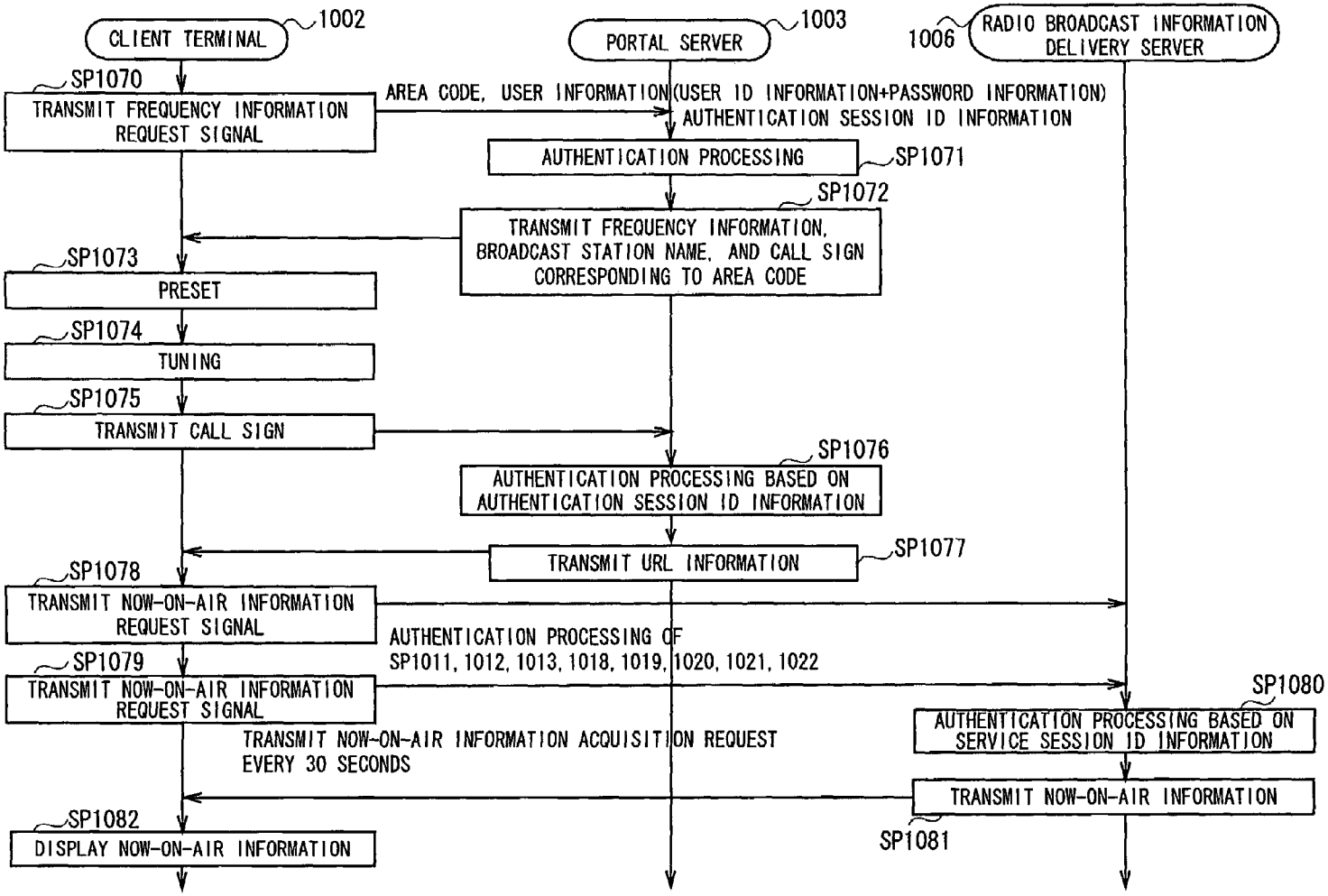
FIG. 26 is a sequence chart showing a radio broadcast information (now-on-air information) delivery service provision process (2).

With reference to FIG. 26, the following describes a radio broadcast information delivery service provision process. During this process, the client terminal 1002 is provided with a radio broadcast information delivery service, especially a now-on-air information delivery service from the radio broadcast information delivery server 1006.

The radio broadcast information delivery server 1006 to supply now-on-air information is provided for each radio station (call sign).

Initially, the client terminal 1002 may not store URL information about the radio broadcast information delivery server 1006 corresponding to each radio station.

The following radio broadcast information delivery service provision process exemplifies a case where the portal server 1003 manages URL information about each radio broadcast information delivery server 1006 for each call sign.

According to the radio broadcast information delivery service provision process, the client terminal 1002 may need to automatically preset a broadcast frequency for each radio station. For this purpose, the client terminal 1002 requests the portal server 1003 for frequency information indicating that broadcast frequency. In such case, it is assumed that the authentication information storage section 1038 does not temporarily store the authentication session ID information and the like. Consequently, the client terminal 1002 first needs to send the user ID information, the password information, and the like to the portal server 1003.

When the input processing section 1021 inputs an operation command to request to automatically preset the broadcast frequency of each radio station. In response to this command, at step SP1070, the control section 1023 of the client terminal 1002 sends a frequency information request signal to request to acquire frequency information about a broadcast frequency which each radio station can receive. The control section 1023 sends the frequency information request signal together with an area code input by the user, the user ID information, the password information, and the like stored in the authentication information storage section 1038 to the portal server 1003 via the communication control section 1032 and the network interface 1033 in order.

At step SP1071, the control section 1050 of the portal server 1003 receives the frequency information request signal, the area code, the user ID information, the password information, and the like sent from the client terminal 1002 via the network interface 1053 and the communication control section 1052 in order. Of these pieces of information, the control section 1050 sends the user ID information, the password information, and the like to the authentication processing section 1056.

Under the control of the control section 1050, the authentication processing section 1056 performs the user authentication process. Specifically, the authentication processing section 1056 compares the received user ID information, the password information, and the like with the customer information registered in the customer database section 1054.

As a result, the authentication processing section 1056 may authenticate the user of the client terminal 1002 to be a registered user. Further, the authentication processing section 1056 may determine that the client terminal 1002 issued a valid request to acquire the frequency information. Under the control of the control section 1050, the authentication processing section 1056 issues the authentication session ID information and the like about the state of communication connection between the client terminal 1002 and the portal server 1003 at the present time. The authentication processing section 1056 temporarily stores the issued authentication session ID information and the like in the authentication information storage section 1057.

The control section 1050 then proceeds to the next step SP1072.

At step SP1072, the control section 1050 performs a search based on the area code received from the client terminal 1002. That is to say, the control section 1050 searches a list of a plurality of frequency information, radio station names, and call signs in the frequency information storage section 1058 for those corresponding to the area code and reads them in a list format.

The control section 1050 reads the frequency information, the radio station name, and the call sign in a list form from the frequency information storage section 1058 and sends them along with the authentication session ID information and the like to the client terminal 1002 via the communication control section 1052 and the network interface 1053 in order. The authentication session ID information and the like were issued to the client terminal 1002 by the authentication processing section 1056 at the above-mentioned step SP1071.

At step SP 1073, the control section 1023 of the client terminal 1002 receives the list of frequency information, radio station name, and call sign sent from the portal server 1003 as well as the authentication session ID information and the like via the network interface 1033 and the communication control section 1032 in order. The control section 1023 sends the authentication session ID information and the like received from the portal server 1003 to the authentication processing section 1037. In addition, the control section 1023 sends the list of frequency information, radio station name, and call sign to the display control section 1024.

Under the control of the control section 1023, the authentication processing section 1037 temporarily stores the received authentication session ID information and the like in the authentication information storage section 1038.

The display control section 1024 is supplied with the list of frequency information, radio station name, and call sign from the control section 1023 and sends the list to the display section 1025. The display section 1025 thus displays the list.

At this time, the control section 1023 identifies a selection command supplied from the input processing section 1021. Based on this command, the control section 1023 stores the selected frequency information, radio station name, and call sign as a preset in the storage medium 1029. The control section 1023 then proceeds to the next step SP1074.

At step SP1074, the control section 1023 identifies a tuning control command supplied from the input processing section 1021. Based on this command, the control section 1023 controls the tuner section 1031 so as to extract a radio broadcasting signal from radio broadcasting waves. This radio broadcasting signal should be used for the radio broadcast carried at the broadcast frequency corresponding to the tuning control command.

A broadcast signal reception section 30 receives radio broadcasting waves. Of these radio broadcasting waves, the tuner section 1031 extracts the radio broadcasting signal carried at the broadcast frequency. The tuner section 1031 applies specified reception processes such as decoding to the extracted radio broadcasting signal. As a result, audio data is generated. The tuner section 1031 sends this audio data to the audio control section 1026.

The audio control section 1026 converts the audio data supplied from the tuner section 1031 into an analog audio signal. Then, the audio control section 1026 outputs the analog audio signal to the speaker 1027. The speaker 1027 thus outputs audio of the selected radio program.

At step SP1075, under the control of the control section 1023, the radio broadcasting display control section 1039 reads a call sign from the storage medium 1029. This call sign is stored correspondingly to the frequency information indicating the broadcast frequency corresponding to the above-mentioned tuning control command. The radio broadcasting display control section 1039 sends the read call sign to the portal server 1003 via the communication control section 1032 and the network interface 1033 in order. Likewise, the radio broadcasting display control section 1039 sends authentication session ID information and the like temporarily stored in the authentication information storage section 1038.

In this embodiment, as described above, the call sign that is stored correspondingly to the frequency information corresponding to the tuning control command (that is, the call sign of the broadcast frequency which is now selected) is transmitted from the radio broadcasting display control section 1039 to the portal server 1003, but not limited to this. It is also possible to transmit other call signs (that is, the call sign of the broadcast frequency which is not selected now) to portal server 1003.

At step SP1076, the control section 1050 of the portal server 1003 receives the call sign, the authentication session ID information, and the like sent from the client terminal 1002 via the network interface 1053 and the communication control section 1052 in order. The control section 1050 sends the received authentication session ID information and the like to the authentication processing section 1056.

Under the control of the control section 1050, the authentication processing section 1056 performs the user authentication process. Specifically, the authentication processing section 1056 compares the received authentication session ID information and the like with the authentication session ID information and the like temporarily stored in the authentication information storage section 1057.

As a result, the authentication processing section 1056 may confirm that the authentication session ID information and the like are received from the client terminal 1002 within the valid period. When the user sent the call sign using the client terminal 1002, the authentication processing section 1056 may authenticate this user to be a registered user. In such case, the control section 1050 proceeds to the next step SP1077.

At step SP1077, the control section 1050 searches a plurality of URL information in the URL storage section 1059 for the URL information corresponding to the call sign based on the call sign received from the client terminal 1002.

The control section 1050 allows the authentication processing section 1056 to extend the valid period of the authentication session ID information and the like issued to the client terminal 1002.

The control section 1050 reads the retrieved URL information from the URL storage section 1059. The control section 1050 sends the read URL information as well as the authentication session ID information and the like having the valid period extended by the authentication processing section 1056 to the client terminal 1002 via the communication control section 1052 and the network interface 1053 in order.

At step SP1078, the control section 1023 of the client terminal 1002 receives the URL information and the authentication session ID information having the extended valid period and the like sent from the portal server 1003 via the network interface 1033 and the communication control section 1032 in order. The control section 1023 sends the received authentication session ID information and the like to the authentication processing section 1037. The control section 1023 sends the URL information to the radio broadcasting display control section 1039.

Under the control of the control section 1023, the authentication processing section 1037 temporarily stores the received authentication session ID information having the extended valid period in the authentication information storage section 1038 to overwrite the authentication session ID information having the valid period not extended. In this manner, the authentication processing section 1037 updates the contents of the authentication session ID information and the like temporarily stored in the authentication information storage section 1038.

Under the control of the control section 1023, the radio broadcasting display control section 1039 temporarily stores the URL information supplied from the control section 1023 in the storage medium 1029 and the like correspondingly to the call sign stored in the storage medium 1029.

Under the control of the control section 1023, the radio broadcasting display control section 1039 follows the URL information temporarily stored in the storage medium 1029 and the like. According to this information, the radio broadcasting display control section 1039 sends a now-on-air information request signal to the radio broadcast information delivery server 1006 via the communication control section 1032 and the network interface 1033 in order. The now-on-air information request signal requests to acquire the now-on-air information. Likewise, the radio broadcasting display control section 1039 sends the service session ID information and the like that are already received from the radio broadcast information delivery server 1006 and are temporarily stored in the authentication information storage section 1038.

In the radio broadcast information delivery service provision process, at step SP1078, the client terminal 1002 sends the now-on-air information request signal, the service session ID information, and the like to the radio broadcast information delivery server 1006. This process corresponds to the process at step SP1010 in FIG. 22 as mentioned above.

Therefore, in the radio broadcast information delivery service provision process, the process at step SP1078 is followed by the user authentication process equivalent to steps SP1011 through SP1013 and steps SP1018 through SP1022 in the client terminal 1002, the radio broadcast information delivery server 1006, and the portal server 1003 as mentioned above with reference to FIG. 22. After these steps are performed in succession, control proceeds to the next step SP1079.

At step SP1079, under the control of the control section 1023, the radio broadcasting display control section 1039 of the client terminal 1002 again follows the URL information temporarily stored in the storage medium 1029 and the like and sends a now-on-air information request signal to the radio broadcast information delivery server 1006 via the communication control section 1032 and the network interface 1033 in order. Likewise, the radio broadcasting display control section 1039 sends the service session ID information and the like that are already received from the radio broadcast information delivery server 1006 and are temporarily stored in the authentication information storage section 1038.

At step SP1080, the control section 1110 of the radio broadcast information delivery server 1006 receives the now-on-air information request signal, the service session ID information, and the like sent from the client terminal 1002 via the network interface 1113 and the communication control section 1112 in order. The control section 1110 sends the received authentication session ID information and the like to the authentication processing section 1115.

Under the control of the control section 1110, the authentication processing section 1115 performs the user authentication process. Specifically, the authentication processing section 1115 compares the received service session ID information and the like with the service session ID information and the like temporarily stored in the authentication information storage section 1120.

As a result, the authentication processing section 1115 may authenticate the user of the client terminal 1002 to be a registered user. In this case, the authentication processing section 1115 determines that the client terminal 1002 issued the valid request to acquire the now-on-air information.

When the authentication processing section 1115 authenticates the user of the client terminal 1002 to be a registered user. In this case, the control section 1110 extends the valid period of the service session ID information and the like issued to the client terminal 1002 by the authentication processing section 1115, and then proceeds to the next step SP1081.

At step SP1081, the control section 1110 reads the now-on-air information from the now-on-air information storage section 1119. The control section 1110 sends the read now-on-air information as well as the service session ID information and the like having the valid period extended by the authentication processing section 1115 to the client terminal 1002 via the communication control section 1112 and the network interface 1113 in order.

At step SP1082, the control section 1023 of the client terminal 1002 receives the now-on-air information and the service session ID information and the like having the extended valid period sent from the radio broadcast information delivery server 1006 via the network interface 1033 and the communication control section 1032 in order. The control section 1023 sends the received service session ID information and the like to the authentication processing section 1037. The control section 1023 sends the now-on-air information to the radio broadcasting display control section 1039.

Under the control of the control section 1023, the authentication processing section 1037 temporarily stores the received service session ID information having the extended valid period and the like in the authentication information storage section 1038 to overwrite the service session ID information having the valid period not extended. In this manner, the authentication processing section 1037 updates the contents of the service session ID information and the like temporarily stored in the authentication information storage section 1038.

Further, the radio broadcasting display control section 1039 sends the now-on-air information supplied from the control section 1023 to the display section 1025 via the display control section 1024. In this manner, the display section 1025 is allowed to display the now-on-air information concerning the radio program in the currently received radio broadcast.

In the radio broadcast information delivery service provision process, the client terminal 1002 thereafter periodically repeats the acquisition request for now-on-air information at step SP1079. The radio broadcast information delivery server 1006 receives the acquisition request from the client terminal 1002 and successively performs the process at steps SP1080 and SP1081.

In this manner, the client terminal 1002 can realtime update the now-on-air information and display it on the display section 1025 of the client terminal 1002. For example, the now-on-air information includes the name of the currently received radio program, the program broadcast start time, the program broadcast end time, the title and artist name of music currently played in the radio program, and the broadcast start time of the music.

With the program modules explained in FIG. 5, the HTTP message program 111 and the communicator program 112 can implement the same functions as the communication control section 1032 (FIG. 15) of the client terminal 1002.

The content reproduction module 113 is a program module capable of implementing the same functions as the encoder/decoder section 1034 (FIG. 15) of the client terminal 1002.

The copyright protection information management module 114 is a program module capable of implementing the same functions as the copyright management section 1035 (FIG. 15) of the client terminal 1002.

The Internet radio channel selection/reproduction module 118 is a program module capable of implementing the same functions as the control section 1023 and the audio control section 1026 (FIG. 15) of the client terminal 1002.

The music purchase/reproduction module 119 is a program module capable of implementing the same functions as the control section 1023 and the audio control section 1026 (FIG. 15) of the client terminal 1002.

The XML browser 151 is a program module capable of implementing the same functions as the input processing section 1021 and the page information generation section 1036 (FIG. 15) of the client terminal 1002.

The hard disk contents controller 117, the database access module 115, and the content data access module 116 are program, modules capable of implementing the same functions as the control section 1023 (FIG. 15) of the client terminal 1002.

The authentication library 131 of the library 130 is a program module capable of implementing the same functions as the authentication processing section 1037 and the authentication information storage section 1038 (FIG. 15) of the client terminal 1002.

The clip library 132 of the library 130 is a program module capable of implementing the same functions as the control section 1023 (FIG. 15) of the client terminal 1002.

The associated information display module 120 is a program module capable of implementing the same functions as the radio broadcasting display control section 1039 (FIG. 15) of the client terminal 1002.

The tuner selection/reproduction/recording module 121 is a program module capable of implementing the same functions as the control section 1023, the audio control section 1026, and the tuner section 1031 (FIG. 15) of the client terminal 1002.

The audio user interface 152 is a program module capable of implementing the same functions as the input processing section 1021, the control section 1023, and the display control section 1024 (FIG. 15) of the client terminal 1002.

The CD reproduction module 141 is a program module capable of implementing the same functions as the audio control section 1026 and the external recording media recording and reproducing section 1028 (FIG. 15) of the client terminal 1002.

The HDD reproduction module 142 is a program module capable of implementing the same functions as the control section 1023 and the audio control section 1026 (FIG. 15) of the client terminal 1002.

That is to say, the CPU 11 of the terminal device 10 can perform the same processes like the client terminal 1002 does by executing these program modules.

By the way, in the aforementioned embodiments, the client terminal 1002 receives radio broadcasts from a radio station. However, the present invention is not limited to this but also the client terminal 1002 may receive Internet radio broadcasts or satellite broadcasts, and obtain their associated information and radio broadcast information. In addition, the client terminal 1002 may receive television broadcasts broadcast by a television station, and obtain various kinds of broadcast information regarding programs in the television broadcasts from servers via the network NT1000.

In the aforementioned embodiments, it has dealt with the case where the hardware circuit block, the function circuit block and the program modules are mounted on the client terminal 1002. However, the present invention is not only limited to this but also they may be mounted on various terminals other than the client terminal 1002, such as a portable telephone set, and a personal computer. Processes that are similar to the aforementioned processes executed by the client terminals 1002 can be brought to realization, if the terminals have the hardware circuit block, the function circuit block and the program modules.

INDUSTRIAL APPLICABILITY

The present invention can be applied to a reproduction apparatus and the like which receive broadcast signals from a broadcast station, and reproduce the broadcast signals, and acquire information that is associated with the broadcast and is supplied by the broadcast station via a network.

Explanation of Reference Numerals

1 . . . Reproduction Apparatus, 2 . . . Broadcast Signal Receiving Means, 3 . . . Broad Signal Reproduction Means, 4 . . . Request Information Transmission Means, 5 . . . Associated Information Receiving Means, 6 . . . Associated Information Display Means, 30 . . . Network, 32A, 32B . . . Broadcast Station, 32AA, 32BA . . . Broadcast Station Server, 1000 . . . Music Related Service Provision System, 1002 . . . Client Terminal, 1003 . . . Portal Server, 1004 . . . Music Data Delivery Server, 1005 . . . Trade Server, 1006 . . . Radio Broadcast Information Delivery Server, 1007 . . . Internet Radio Server, 1008 . . . Charging Server

The invention claimed is:

1. A reproduction apparatus comprising:

a storage configured to store a broadcast station name, a frequency, and a call sign in association with one another;

a broadcast signal receiver configured to receive a broadcast signal of a specific frequency;

a reproducing unit configured to reproduce the broadcast signal received by said broadcast signal receiver;

a request information transmitter configured to transmit request information that represents a request for associated information of a broadcast station which is different from the broadcast station being reproduced by said reproducing unit;

an associated information receiver configured to receive the associated information corresponding to said request information; and a display controller configured to control a display to display the associated information received by said associated information receiver, wherein the broadcast signal of the frequency of the broadcast station selected by a first operation is received, the broadcast signal is reproduced, said request information including the call sign of the broadcast station selected by said first operation is transmitted, the associated information is received, the associated information is displayed, said request information including the call sign of the broadcast station selected by a second operation is transmitted, the associated information is received, and a display is changed.

2. The reproduction apparatus according to claim 1, wherein a reception frequency is switched by a third operation.

3. The reproduction apparatus according to claim 1, wherein:

a plurality of said request information including pre-stored call signs of a plurality of the broadcast stations are transmitted at a certain interval of time, and each associated information is received; and said display controller displays the received associated information at once.

4. The reproduction apparatus according to claim 1, wherein said display controller displays indication of whether or not displaying the associated information of the broadcast station from which the broadcast signal is being received.

5. A reproduction method comprising:

storing a broadcast station name, a frequency, and a call sign in association with one another;

receiving a broadcast signal of a specific frequency;

reproducing the received broadcast signal;

transmitting request information that represents a request for associated information of a broadcast station which is different from the broadcast station being reproduced;

receiving the associated information corresponding to said request information; and displaying the received associated information, wherein the broadcast signal of the frequency of the broadcast station selected by a first operation is received, the broadcast signal is reproduced, said request information including the call sign of the broadcast station selected by said first operation is transmitted, the associated information is received, the associated information is displayed, said request information including the call sign of the broadcast station selected by a second operation is transmitted, the associated information is received, and a display is changed.

6. The reproduction method according to claim 5, wherein a reception frequency is switched by a third operation.

7. The reproduction method according to claim 5, wherein a plurality of said associated information including prestored call signs of a plurality of the broadcast stations are transmitted at a certain interval of time, each associated information is received, and the received associated information is displayed at once.

8. The reproduction method according to claim 5, further comprising:

displaying an indication of whether or not displaying the associated information of the broadcast station from which the broadcast signal is being received.

9. A reproduction method comprising:

receiving a broadcast signal of a specific frequency;

reproducing the received broadcast signal;

transmitting request information that represents a request for associated information of a broadcast station which is different from the broadcast station being reproduced;

receiving the associated information corresponding to said request information; and displaying the received associated information, wherein:

a terminal apparatus which receives the broadcast signal is capable of communicating with an authentication server having an authentication function and an associated information provision server providing the associated information, said terminal apparatus transmits the request information and a service session ID to said associated information provision server, said request information for requesting the associated information of the broadcast station which is different from the broadcast station being reproduced, said service session ID being used as a session ID for said associated information provision server, said terminal apparatus receives information indicating an authentication error and service identification information identifying said associated information provision server, said terminal apparatus transmits authentication ticket issuance request information and an authentication session ID to said authentication server, said ticket issuance request information for requesting an issue of an authentication ticket to be used to access said associated information provision server, said authentication session ID being used as a session ID for said authentication server, said terminal apparatus receives the authentication ticket issued by said authentication server when the authentication is permitted by said authentication server, and transmits authentication request information and said authentication ticket to said associated information provision server, said terminal apparatus receives the service session ID when the authentication is permitted by said associated information provision server, said service session ID being used as a session ID for said associated information provision server, said terminal apparatus transmits the request information for requesting said associated information and said received service session ID to said associated information provision server, and said terminal apparatus receives the associated information corresponding to said request information when the authentication is permitted by the associated information provision server.

10. The reproduction method according to claim 9, further comprising:

receiving information that indicates the authentication error when the authentication conducted by said authentication server becomes an error, and transmitting a user ID and a password to said authentication server;

receiving the authentication session ID when the authentication of said user ID and said password is permitted by said authentication server, said authentication session ID being used as a session ID for the authentication server; and transmitting said authentication ticket issuance request information and said authentication session ID to said authentication server.

11. A storage medium including computer executable instructions, wherein the instructions, when executed by a processor, cause the processor to perform a method comprising:

storing a broadcast station name, a frequency, and a cell sign in association with one another;

receiving a broadcast signal of a specific frequency;

reproducing the received broadcast signal;

transmitting request information that represents a request for associated information of a broadcast station which is different from the broadcast station being reproduced;

receiving the associated information corresponding to said request information; and displaying the received associated information, wherein the broadcast signal of the frequency of the broadcast station selected by a first operation is received, the broadcast signal is reproduced, said request information including the call sign of the broadcast station selected by said first operation is transmitted, the associated information is received, the associated information is displayed, said request information including the call sign of the broadcast station selected by a second operation is transmitted, the associated information is received, and a display is changed.

12. A reproduction apparatus comprising:

means for storing a broadcast station name, a frequency, and a call sign in association with one another;

means for receiving a broadcast signal of a specific frequency;

means for reproducing the received broadcast signal;

means for transmitting request information that represents a request for associated information of a broadcast station which is different from the broadcast station being reproduced;

means for receiving the associated information corresponding to said request information; and means for displaying the received associated information, wherein the broadcast signal of the frequency of the broadcast station selected by a first operation is received, the broadcast signal is reproduced, said request information including the call sign of the broadcast station selected by said first operation is transmitted, the associated information is received, the associated information is displayed, said request information including the call sign of the broadcast station selected by a second operation is transmitted, the associated information is received, and a display is changed.

* * * * *